United States Patent [19]

Takeda et al.

[11] Patent Number: 4,916,489

[45] Date of Patent: Apr. 10, 1990

[54] IMAGE FORMING APPARATUS

[75] Inventors: Hiroaki Takeda; Hideki Adachi, both of Kawasaki; Tadashi Suzuki, Yokohama; Naoyuki Ohki, Tokyo; Masahiro Tomosada, Kawasaki, all of Japan

[73] Assignee: Canon Kabushiki Kaisha, Tokyo, Japan

[21] Appl. No.: 319,866

[22] Filed: Mar. 2, 1989

Related U.S. Application Data

[63] Continuation of Ser. No. 233,907, Aug. 17, 1988, abandoned, which is a continuation of Ser. No. 893,358, Aug. 5, 1986, abandoned.

[30] Foreign Application Priority Data

| | | | |
|---|---|---|---|
| Aug. 9, 1985 | [JP] | Japan | 60-175475 |
| Aug. 9, 1985 | [JP] | Japan | 60-175476 |
| Aug. 9, 1985 | [JP] | Japan | 60-175477 |
| Aug. 9, 1985 | [JP] | Japan | 60-175478 |
| Aug. 9, 1985 | [JP] | Japan | 60-175479 |

[51] Int. Cl.[4] ..... G03G 15/00; G03G 15/01

[52] U.S. Cl. ..... 355/210; 355/218; 355/229; 355/244; 355/326

[58] Field of Search ..... 355/1, 3 R, 7, 14 R, 355/4, 40, 218, 210; 346/160, 154, 153.1

[56] References Cited

U.S. PATENT DOCUMENTS

| | | | |
|---|---|---|---|
| 4,346,982 | 8/1982 | Nakajima et al. | 355/3 R |
| 4,378,156 | 3/1983 | Yajima et al. | 355/77 |
| 4,435,064 | 3/1984 | Tsukada et al. | 355/1 |
| 4,517,579 | 5/1985 | Kitamura | 346/160 |
| 4,552,449 | 11/1985 | Wakamatsu et al. | 355/3 R |

FOREIGN PATENT DOCUMENTS

| | | | |
|---|---|---|---|
| 59-87470A | 5/1984 | Japan | 355/7 |
| 59-93440A | 5/1984 | Japan | 355/7 |

*Primary Examiner*—A. C. Prescott

*Attorney, Agent, or Firm*—Fitzpatrick, Cella, Harper & Scinto

[57] ABSTRACT

There is disclosed an image forming apparatus capable of superposing two desired images, by erasing a part of a latent image with light-emitting elements and forming another image with same light-emitting elements.

25 Claims, 49 Drawing Sheets

| | 1 | 2 | 3 | 4 | 5 | 6 | 7 | 8 |
|---|---|---|---|---|---|---|---|---|
| | 1 | 1 | 1 | 1 | 1 | 1 | 1 | 1 |
| | 1 | 1 | 0 | 0 | 0 | 1 | 1 | 1 |
| | 1 | 1 | 1 | 1 | 1 | 0 | 1 | 1 |
| | 1 | 1 | 1 | 1 | 1 | 0 | 1 | 1 |
| | 1 | 1 | 1 | 0 | 0 | 1 | 1 | 1 |
| | 1 | 1 | 0 | 1 | 1 | 1 | 1 | 1 |
| | 1 | 0 | 0 | 0 | 0 | 0 | 0 | 1 |
| | 1 | 1 | 1 | 1 | 1 | 1 | 1 | 1 |

t

IMAGE FORMING APPARATUS

This application is a continuation of application Ser. No. 233,907 filed Aug. 17, 1988 which is a continuation of application Ser. No. 893,358 filed Aug. 5, 1986, both of which are now abandoned.

BACKGROUND OF THE INVENTION

1. Field of the Invention

The present invention relates to an image forming apparatus capable of forming a desired pattern on a recording medium.

2. Related Background of Art

For such purpose there is already proposed an apparatus provided for example with a semiconductor laser, a scanner and a driving circuit therefor separately from an original copying mechanism, in order to form a desired pattern such as date, page etc. on a recording medium such as a photosensitive member.

Such apparatus is however expensive because the structure is complicated by the addition of a mechanism separate from the copying mechanism.

SUMMARY OF THE INVENTION

In consideration of the foregoing, an object of the present invention is to provide an image forming apparatus capable of forming a desired pattern on a recording medium with a simple structure.

Another object of the present invention is to provide an image forming apparatus capable of forming a desired pattern with a simple operation.

Still another object of the present invention is to provide an image forming apparatus capable of selecting the direction, position etc. of a pattern with a simple operation.

Still another object of the present invention is to provide an image forming apparatus capable of forming a desired pattern without sacrificing the image forming speed.

The foregoing and still other objects of the present invention will become fully apparent from the following description.

BRIEF DESCRIPTION OF THE DRAWINGS

FIG. 9-1 is a perspective view showing an embodiment of a copying apparatus to which the invention is applied;

FIG. 9-2 is a top view of an original mounting plate;

FIG. 15-1 is a diagram of color detection circuits of developing devices;

FIG. 15-2 is a diagram showing an arrangement of a memory representing the registration of areas;

FIG. 15-3 is a diagram showing the content of the memory upon correction of areas;

FIGS. 15-4 to 15-7 are flowcharts showing the processes when the key regarding the registration or correction of areas is inputted, respectively;

FIGS. 16-1 to 16-3 are flowcharts showing an embodiment of the invention, respectively;

FIG. 16-4 is a diagram showing an example when an area is designated and the variable magnification copy is this area;

DETAILED DESCRIPTION OF PREFERRED EMBODIMENTS

An embodiment of the present invention will now be described hereinbelow with reference to the drawings.

Figure 1:
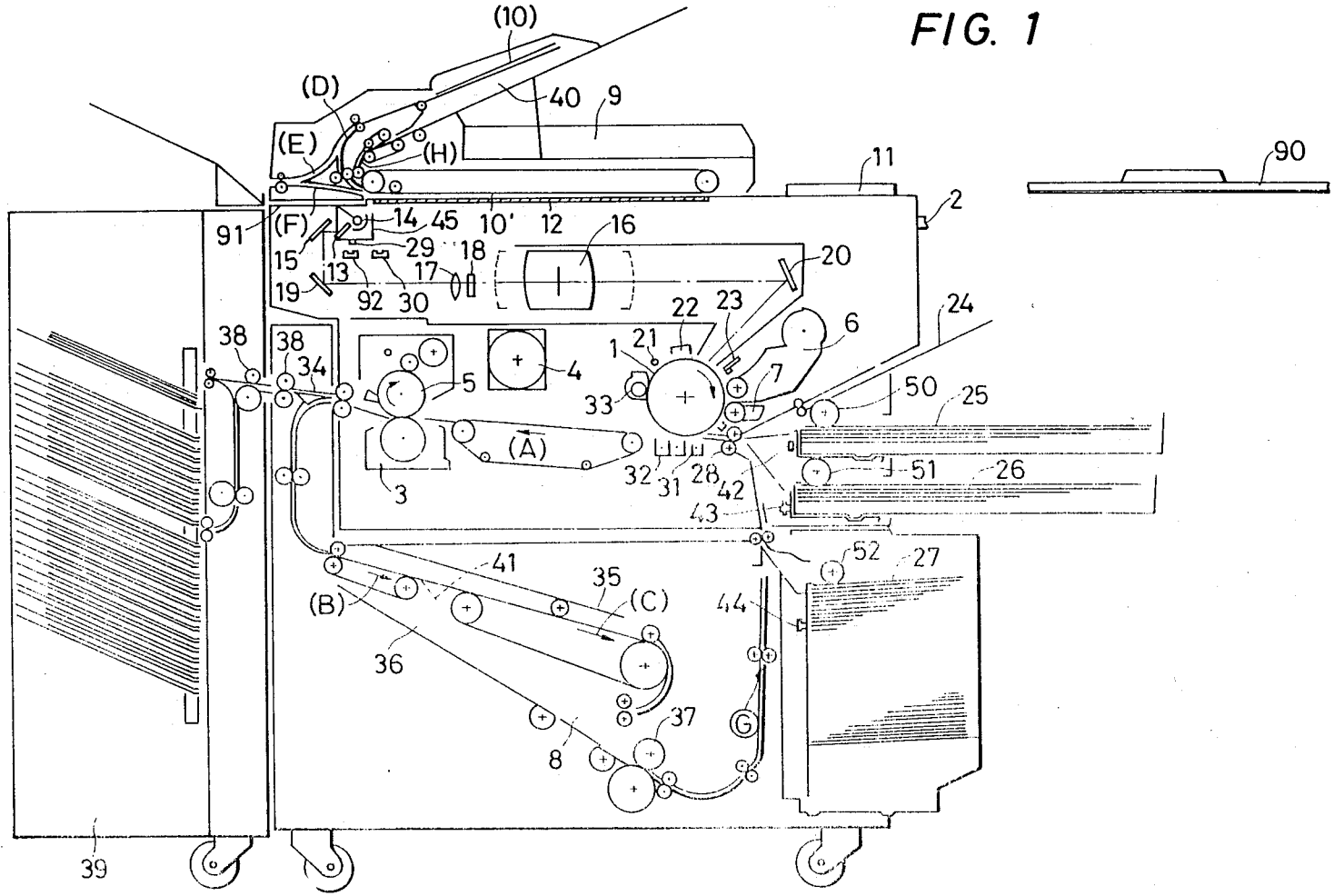
FIG. 1 is a cross sectional view showing a constitution of an embodiment of a copying apparatus to which the invention is applied.

FIG. 1 is a cross sectional view showing a constitution of an embodiment in the case where an RDF (automatic original feeding apparatus) 9 and a sorter 39 are attached to a two-sided copying apparatus to which the present invention is applied. There is also another copying apparatus in which a pressing plate 90 is set in place of the RDF 9. In the diagram, the surface of a drum 1 consists of a seamless photosensitive material using amorphous silicon and the drum is axially rotatably supported. When a power source is supplied by turning on a power switch 2, a fixing device 3 is heated. When the fixing device 3 reaches a predetermined temperature, the drum 1, conveying sections A, B, and C, and a fixing roller 5 start rotating in the directions indicated by arrows by a main motor 4. When the fixing device 3 becomes a predetermined temperature at which the fixing can be performed, a voltage control process (initial process), which will be explained later, and a discrimination to see if the toners exist in developing devices 6 and 7 or not are executed. Thereafter, the main motor 4 is stopped and the apparatus becomes the standby mode and waits until a copy start signal is inputted.

The copy mode which can be executed by the copying apparatus of the invention will be first simply described and the copy procedure will then be sequentially described. The copy mode includes the one-sided copy mode in which after an image was formed on one side of a transfer paper, the paper is ejected out, the two-side copy mode in which after images were formed on both sides of a transfer paper, the paper is ejected out, and the multi-copy mode in which after a plurality of images were synthesized on one side of a transfer paper, the paper is ejected out. The copy is carried out using a middle tray 8 in the two-sided and one-sided copy modes. On one hand, by providing a plurality of developing devices 6 and 7, the copy can be executed in a plurality of colors on a transfer paper. In addition, the AMS (automatic variable magnification selection) and APS (automatic paper selection) functions are provided by detecting a size of original. The apparatus is also provided with the zoom function and the like.

(Two-sided copy mode)

The procedure to obtain the two-sided copy from a two-sided original will be first described. After an original 10 was set to the RDF 9, a key to perform the two-sided copy from the two-sided original is inputted by an operating section 11, which will be explained later. Then, a copy quantity is set and the black developing device 6 is designated and thereafter, a copy start key is inputted. The original 10 set to the RDF 9 is conveyed onto an original glass 12. In the main body of the copying apparatus, an illumination lamp 14 which is constituted integrally with a first scan mirror 13 is set at a reference position 92, and a voltage control (which will be explained later) and a control of an incident light into a CCD for detection of the original (the detail will be explained later) are executed.

The original 10 is illuminated by the illumination lamp 14 and the reflected light is scanned by the first scan mirror 13 and a second scan mirror 15. The first and second scan mirrors 13 and 15 move at the velocity ratio of 1:½, thereby scanning the original while always keeping constant the distances of optical paths in front of a projection lens 16 and an original detecting lens 17. Thus, the reflected light image is formed onto a detecting element (CCD image sensor) 18 through the lens 17 and is also formed on the drum 1 through the projection lens 16, a third mirror 19, and a fourth mirror 20.

On the other hand, after the drum 1 was discharged by a pre-exposure lamp 21, it is corona charged (for example, to the positive charges) by a primary charging device 22. Thereafter, the image illuminated by the illumination lamp 14 is exposed through a slit to form an electrostatic latent image. During the scan to detect the size of original, the latent image is erased by an erasure lamp 23 and at the same time, a proper bias is given to remove the AC component of the bias of developing device and thereby to prevent deposition of the toner due to the DC component. The reflected light on a front original glass 91 is inputted as original information to the CCD 18 for detection of the size of original. However, an intensity of reflected light of the portion where no original exists is set to be very low. The process using the CCD will be explained later. The scan to copy is executed after completion of the CCD process and the electrostatic latent image is formed in a manner similar to the above. Then, the latent image is developed as a visible image by the developing device 6 or 7 designated. A transfer paper is fed by a paper feed roller 50, 51, or 52 from a paper delivery port of selected one of hand inserting means 24, an upper cassette 25, a lower cassette 26, and a deck 27 and conveyed to the position in front of a registration roller 28. After a member 29 attached to the unit of the illumination lamp 14 constituted integrally with the first scan mirror 13 (hereinafter, referred to as the movement optical system) was detected by a sensor 30 to detect the head position (image tip) of the original, the registration roller 28 is driven after an expiration of a predetermined time T and the transfer paper is sent toward the photo sensitive drum 1 at an accurate timing such that the latent image tip coincides with the head of the transfer paper. Thereafter, the transfer paper passes through the gap between the drum 1 and a transfer charging device 31, so that the toner image on the drum 1 is transferred onto the transfer paper. After completion of the transfer, the paper is separated from the drum 1 by a separation charging device 32. Then, the surface of the drum 1 is cleaned by a cleaning apparatus 33 and at the same time, a variation in voltage is also uniformed by the pre-exposure lamp 21, thereby enabling those components to be repeatedly used.

In addition, after the transfer paper separated from the drum 1 was led to the fixing device 3 by the conveying unit (A) and fixed, the paper path is switched such that the paper is conveyed to a two-sided unit 35 by a flapper 34. The transfer paper then passes through the conveying sections (B) and (C) and is switched back and collected onto the middle tray 8. After completion of the exposing operations commensurate with the set copy quantity, an original 10′ on the original plate 12 is switched back by way of paths (D), (E), and (F) of the RDF 9 and again set on the original plate 12 such as to copy the back side of the original 10′. After the original 10′ was set, the transfer paper fed from the middle tray 8 by a paper feed roller 37 passes through a conveying path (G) and is conveyed to the position in front of the registration roller 28. After the member 29 attached to the movement optical system unit was detected by the sensor 30, the registration roller 28 is driven after an elapse of a predetermined time $T_1$. The paper is sent toward the drum 1 at the accurate timing such that the latent image tip coincides with the head of the transfer paper. After that, the transfer paper passes through the gap between the drum 1 and the transfer charging device 31, so that the toner image on the drum 1 is transferred onto the paper. After the end of transfer, the paper is separated from the drum 1 by the separation charging device 32. The surface of the drum 1 is cleaned by the cleaning apparatus 33 and a variation in potential is also uniformed by the pre-exposure lamp 21, thereby enabling those components to be repeatedly used.

The transfer paper separated from the drum 1 is led to the fixing device 3 by the conveying unit (A) and fixed. Subsequently, it is ejected out to the sorter 39 through a paper delivery roller 38 by the flapper 34. The copy operation is completed by repeating the above-mentioned operations a number of times as many as the set copy quantity. The original 10′ on the original glass 12 is ejected out onto an original tray 40 through the paper path (D).

It is also possible to perform the two-sided copy from a one-sided original. In this case, the original 10 set to the RDF 9 passes through a paper path (H) and is set on the original glass 12 and the exposing operation is repeatedly executed a number of times as many as the set copy quantity. The transfer paper is collected onto the middle tray 8 as mentioned above. After completion of the exposing operations as many as the set copy quantity, the original 10′ is ejected out onto the original tray 40 through the paper path (D). The next original feeding operation is executed in parallel with the original ejecting operation and the original is set onto the glass 12. This original is exposed to copy the other side of the transfer paper in which one side was copied and which was collected onto the middle tray 8. Then, the copied paper is ejected out to the sorter 39. After the end of exposing operations as many as the set copy quantity, the original is delivered onto the original tray 40 through the paper path (D). This operation is repeated until the original is once circulated.

(Multi-copy mode)

The fundamental process in the multi-copy mode and the movement of transfer material will then be explained. After the original was set to the RDF 9, the multi-copy mode is designated by a key in the operating section 11, which will be explained later, and the copy quantity is set. The developing device which is used is selected from among a plurality of developing devices and designated. Then, the copy start key is inputted. Thus, the original 10 set to the RDF 9 is conveyed to the exposing position on the original glass 12. The toner image is formed on the photo sensitive drum 1 and transferred onto the transfer paper in a manner similar to the case in the two-sided copy mode. The transfer paper separated from the drum 1 is led to the fixing device 3 by the conveying unit (A) and fixed. Subsequently, the paper path is switched such that the transfer paper is conveyed to a multi (two-sided) copy unit by the flapper 34 Due to this, the transfer paper passes through the conveying section (B) and is collected onto the middle tray 8 by a switching device 41. The copy operation is completed by repeating the above operation a number of times as many as the set copy quantity. After the original 10′ on the original plate 12 was ejected onto the original tray through the path (H) of the RDF, the next original is taken out from the RDF 9 and set on the plate 12 as mentioned above. Thereafter, the transfer paper fed by the paper feed roller 37 from the middle tray 8 is conveyed to the position in front of the registration roller 28 by way of the conveying path (G), thereby to execute the copy on the same side of the transfer paper. The copy operation is carried out in a manner similar to the copy of the back surface in the two-sided copy mode. The transfer paper separated from the drum 1 is led to the fixing device 3 by the conveying unit A and fixed. Thereafter, the paper passes through the paper delivery roller 38 by the flapper 34 and is ejected out to the sorter. The copy operation is completed by repeating the above operation a number of times as many as the set copy quantity.

In addition, the original on the glass 12 is delivered onto the original tray 40 through the paper path (H).

The continuous copy mode will then be described. After the original was set to the RDF 9, the key to execute the continuous copy is inputted by the operating section 11, which will be explained later, and then the copy quantity is set. The embodiment includes the mode to designate the developing device which is used among the developing devices and the mode in which the color of the first side and the color of the second color for the continuous copy are automatically preliminarily determined. An explanation will be made hereinafter with respect to the operation in the following case where: the size of original is A3; the direct copy is executed (i.e., the magnification is equal); the APS (automatic paper selection) mode is selected; and the developing devices of the first and second sides are preliminarily determined (for example, the black developing device is for the first side and the red developing device is for the second side). The copy size of the first side is set to A4 size (½ of the original size of A3). As described above, the original which is fed to the exposing position by the RDF 9 is scanned by the first scan mirror and illumination lamp 14 and the electrostatic latent image is obtained in a manner as mentioned above. Thereafter, the latent image is developed as a visible image by the predetermined black developing device. The paper feed port of the upper or lower cassette or deck where the transfer papers of the A4 size are set is selected by paper size sensors 42, 43, and 44 attached to those cassettes or deck. For example, in the case where the transfer papers of the A3 size, A4 size, and B4 size are respectively set into the upper cassette 25, lower cassette 26, and deck 27, the papers are fed by the paper feed roller from the paper feed port of the lower cassette 26 in which the transfer papers of the A4 size are set. The papers are then conveyed to the position in front of the registration roller 28. After the member attached to the movement optical system unit was detected by the image tip sensor 30, the registration roller 28 is driven after an expiration of a predetermined time $T_1$. The paper is sent toward the photo sensitive drum 1 at an accurate timing such that the latent image tip coincides with the head of the transfer paper. Thereafter, as mentioned above, the paper is subjected to the transfer process and fixing process through the conveying system and ejected out, so that the copy operation is completed. The operation advances to the copy of the second side. The apparatus is constituted in a manner such that the movement optical system is automatically returned to the optical system reference position 15 (home position) after completion of the exposure scan of the first side. The copy of the second side starts from the reference position 15 and after the member 29 attached to the movement optical system unit 45 was detected by the image tip detection sensor 30, the erasure lamp is lit up for a predetermined time $T_2$ (corresponding to the width of paper of the A4 size). The latent image of the first side and the potentials of the unnecessary areas are erased and the latent image of the second side is obtained. The latent image of the second side is developed to a visible image by the predetermined red developing device (color developing device). The transfer paper is fed by the paper feed roller from the paper feed port of the lower cassette 26 in which the transfer papers of the A4 size are set. This paper is conveyed to the position in front of the registration roller 28. Next, the roller 28 is driven after an expiration of a predetermined time $T_3$ and the paper is sent toward the drum 1 at the accurate timing such that the latent image tip coincides with the head of the transfer paper. Thereafter, the paper is subjected to the transfer process and fixing process through the conveying system as mentioned above, so that the copy operation is completed. In addition, as described above, the following combinations can be designated by the operating section, which will be explained later; namely, the combination of the two-sided copy mode and a plurality of developing devices; the combination of the two-sided copy mode and the continuous copy mode; and the combination of the multi-copy mode and a plurality of developing devices; the combination of the multi-copy mode and the continuous copy mode; and the like. There is another function to vary the processing speed (peripheral speed of the drum 1). In other words, the processing speed is changed when an amount of illumination light to the photo sensitive drum 1 lacks. In the case where the writing function is selected by the operating section 11, the processing speed is automatically set to a low speed.

The apparatus also has the following function. A number of light emitting elements are finely arranged to constitute the erasure lamp and this lamp is provided and lit up before development after completion of the exposure of the image so that arbitrary portions of the latent image on the drum 1 can be erased. An arbitrary latent image can be erased by lighting up arbitrary light emitting elements of the light emitting section. The images can be synthesized by combining the multi-copy mode and the colors of a plurality of developing devices.

Figure 2:
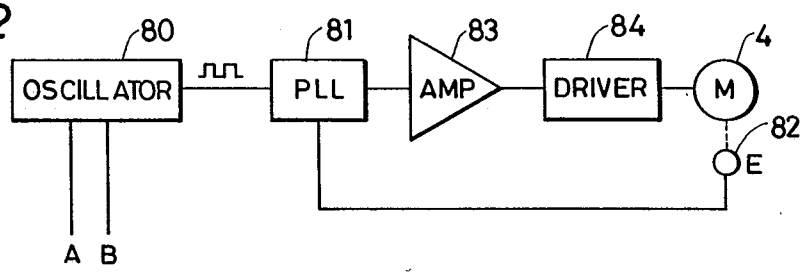
FIG. 2 is a block diagram of a circuit to determine a processing speed.

On the other hand, to vary the processing speed as mentioned above, in the embodiment, a DC motor 4 is used as a drive source and the speed is variably controlled in a PLL control manner as shown in FIG. 2. Practically speaking, a signal from an oscillator 80 is used as a reference signal. A speed signal from an encoder 82 connected to the DC motor 4 is fed back to a PLL control circuit 81. An output of the PLL control circuit 81 is amplified by an amplifier 83 and outputted to a driver 84. The DC motor 4 is driven by the driver 84 such that the reference signal from the oscillator 80 is synchronized with the signal fed back to the PLL control circuit 81. An oscillating frequency of the output of the oscillator 80 is changed in response to input signals A and B, thereby varying the speed. The signals A and B are connected to a speed command circuit (not shown).

Figure 3:
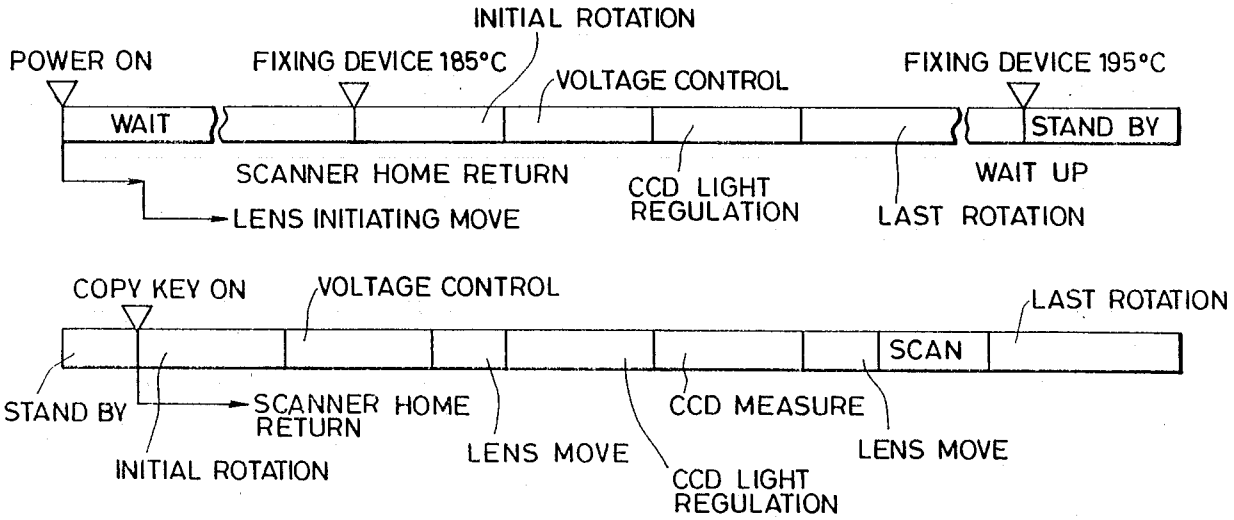
FIG. 3 is a timing chart for the whole apparatus.

FIG. 3 shows a timing chart for the whole apparatus. FIGS. 4 to 8 show timing charts for the initial rotation, voltage control, CCD light regulation and CCD measurement, scan, and last rotation, respectively. In FIG. 3, when a power switch is turned on, a fixing heater is turned on and a scanner is returned to the home position and the lens is initialized and moved. When the fixing temperature becomes 185° C., the initial rotation, voltage control, CCD light regulation, and last rotation are executed. When the fixing temperature becomes 195° C., the apparatus enters the standby mode and waits until the copy start key is inputted. When the copy start key is turned on, the voltage control is performed due to the initial rotation. Upon full scan, the lens is moved to the position where the second mirror doesn't collide with the lens in order to perform the CCD measurement scan. Next, the CCD light regulation and CCD measurement are executed and a size and a concentration of original are detected. Thereafter, the lens is moved in accordance with the magnification which is derived due to the calculation of the AMS or the magnification which is designated. After the scanning operation was repeated a number of times as many as the set copy quantity and the last scan was reversed, the last rotation is performed.

Figure 4:
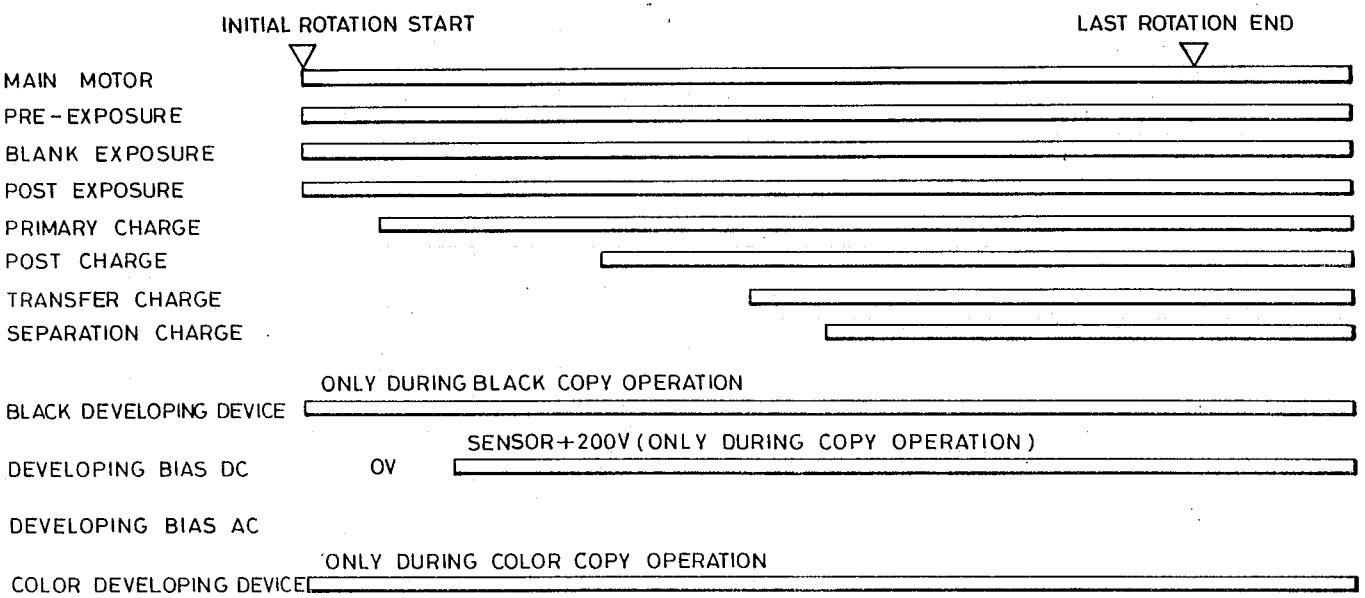
FIG. 4 is a timing chart for the initial rotation.

FIG. 4 is a timing chart for the initial rotation. The pre-exposure, blank exposure, and post exposure are started synchronously with the main motor. Subsequently, the primary charge, post charge, transfer charge, and separation charge are sequentially started. The initial rotation ends when the drum has been once rotated after the start of the pre-exposure. In the copy operation, the designated developing device is driven synchronously with the main motor. When the developing device passes the position of the voltage sensor from the pre-exposure, the developing bias is controlled to the output voltage of +200V of the sensor. The other developing device is in the floating state.

Figure 5:
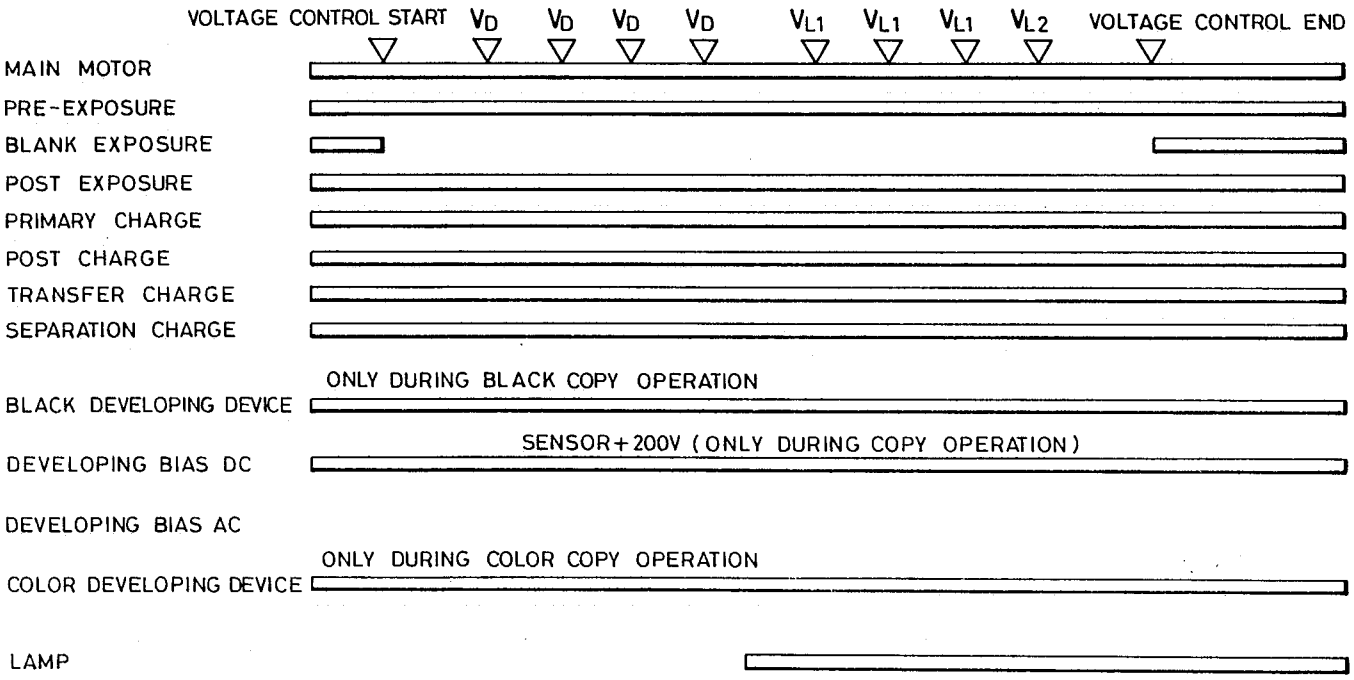
FIG. 5 is a timing chart for the voltage control.

FIG. 5 is a timing chart for the voltage control. When the voltage control starts, the blank exposure is turned off to form the dark section voltage on the drum. This voltage is measured by the voltage sensor and the current of the primary charge is controlled so as to approach the object voltage of 450V. This voltage control is referred to as $V_D$ control. The $V_D$ control is executed four times. Next, an amount of light of the illumination lamp is controlled due to the primary current which is derived by the $V_D$ control. The lamp is lit up to form the bright section voltage on the drum. This voltage is measured by the voltage sensor. The amount of light of the illumination lamp is controlled so as to approach the object voltage of 50V. This voltage control is referred to as $V_{L1}$ control and executed three times. The bright section voltage is measured again by the light amount which is derived due to the $V_{L1}$ control and the measured voltage is referred to as $V_{L2}$. The voltage $V_{L2}$ is used to determine the developing bias DC. After completion of the measurement of $V_{L2}$, the post voltage control is finished.

Figure 6:
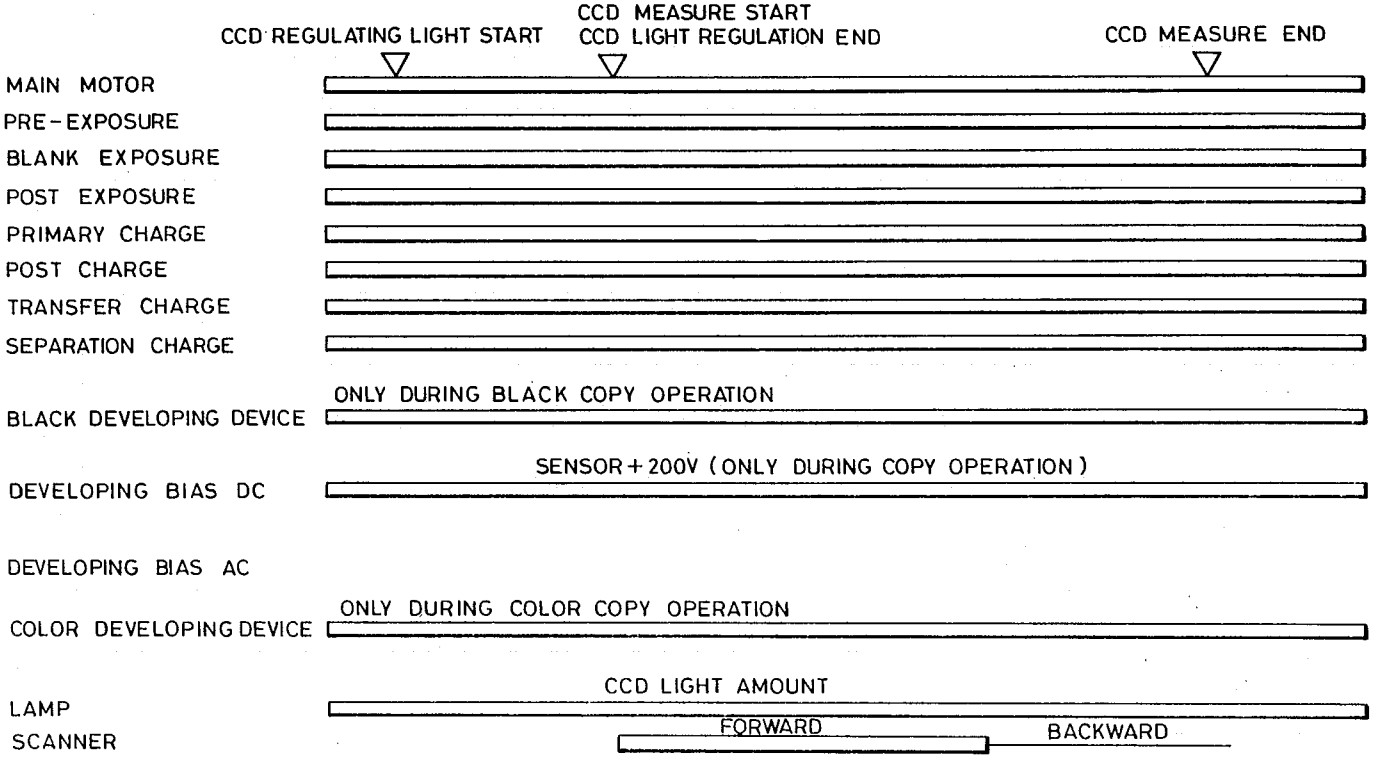
FIG. 6 is a timing chart for the CCD light regulation and CCD measurement.

FIG. 6 is a timing chart for the CCD light regulation and CCD measurement. For the CCD light regulation, the light amount of the illumination lamp is set to a value suitable for CCD measurement. The scanner is set at the home position. A standard white board is exposed. An amount of reflected light is measured by the CCD. The light amount is controlled such that the maximum value of one scanning line of the CCD becomes a predetermined level. After the end of this control, the optical system fully scans to detect the size, concentration, and mounting position of the original. If the absence of original is detected, the threshold level and the light amount of lamp are changed and the scan is restarted.

Figure 7:
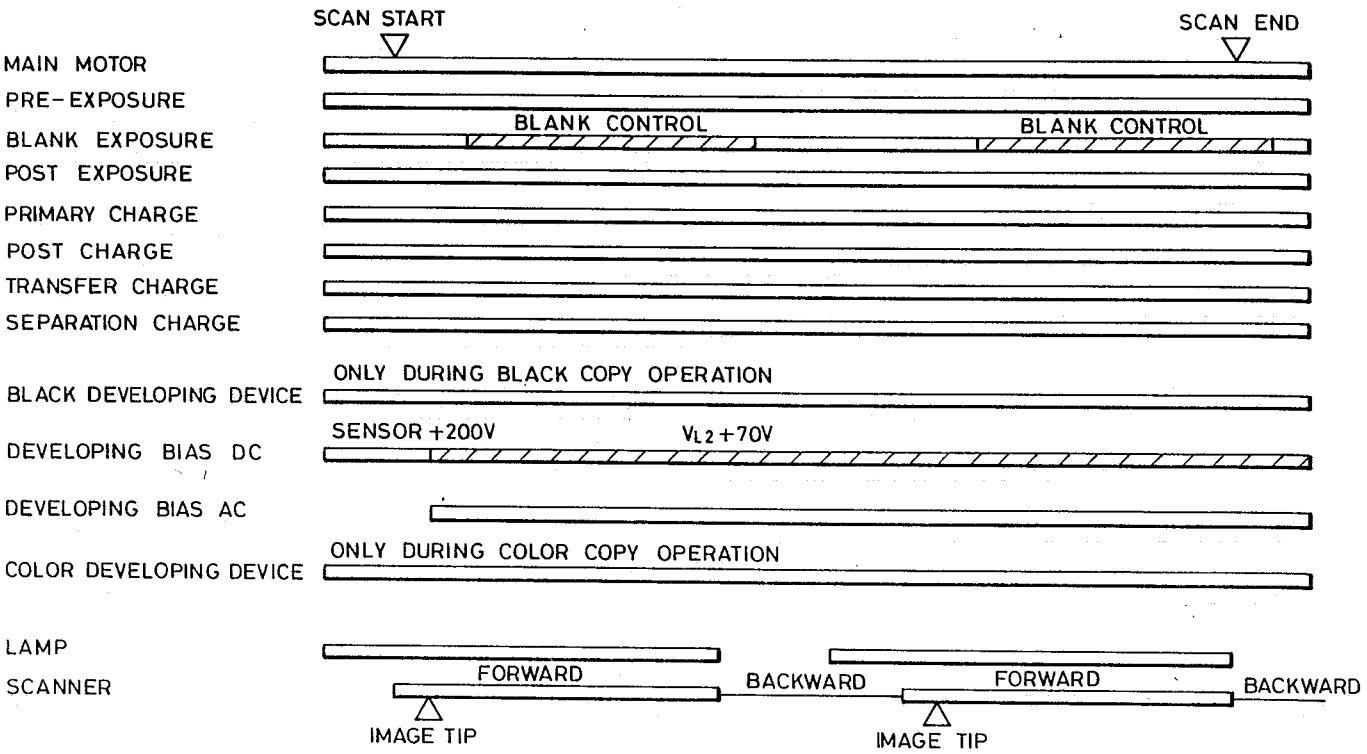
FIG. 7 is a timing chart for the scan.

FIG. 7 is a timing chart for the copy scan. When the image tip is detected after the optical system started forward, the developing bias DC becomes $V_{L2}+70$ V and the developing bias AC is also turned on. Further, after the image tip was detected, a desired blank light-up control is performed at a predetermined timing.

Figure 8:
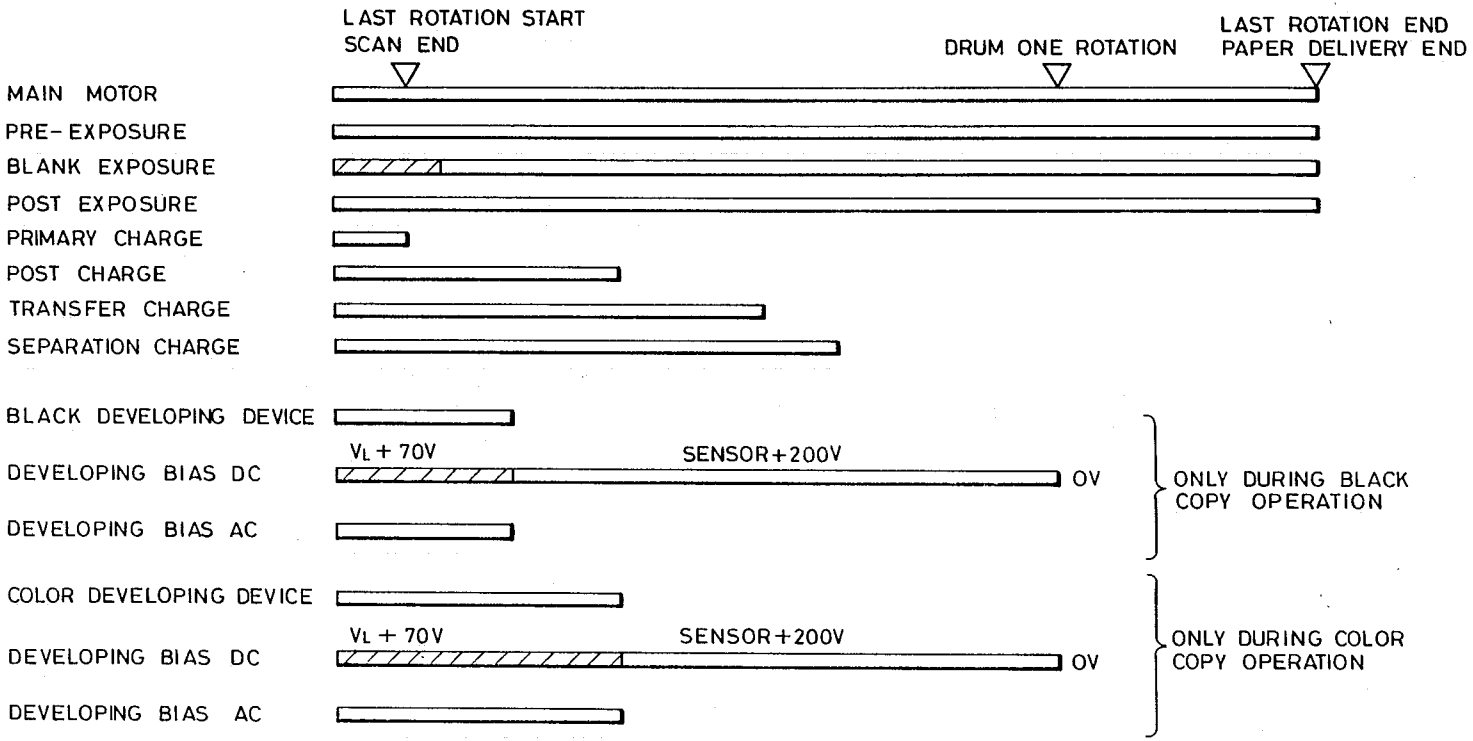
FIG. 8 is a timing chart for the last rotation.

FIG. 8 is a timing chart for the last rotation. After the final reverse of the scan, the last rotation is performed. After the primary charge was turned off, the developing device, developing bias DC, and developing bias AC are sequentially turned off. The sensor +200V is turned off. Further, the post charge, transfer charge, and separation charge are turned off. After the drum was once rotated from the turn-off of the primary charge, the developing bias DC becomes 0V.

After the last paper was ejected out, the main motor, blank exposure, post exposure, and pre-exposure are turned off and the apparatus enters the standby mode.

(OPERATING SYSTEM)

Figures 1, 9:
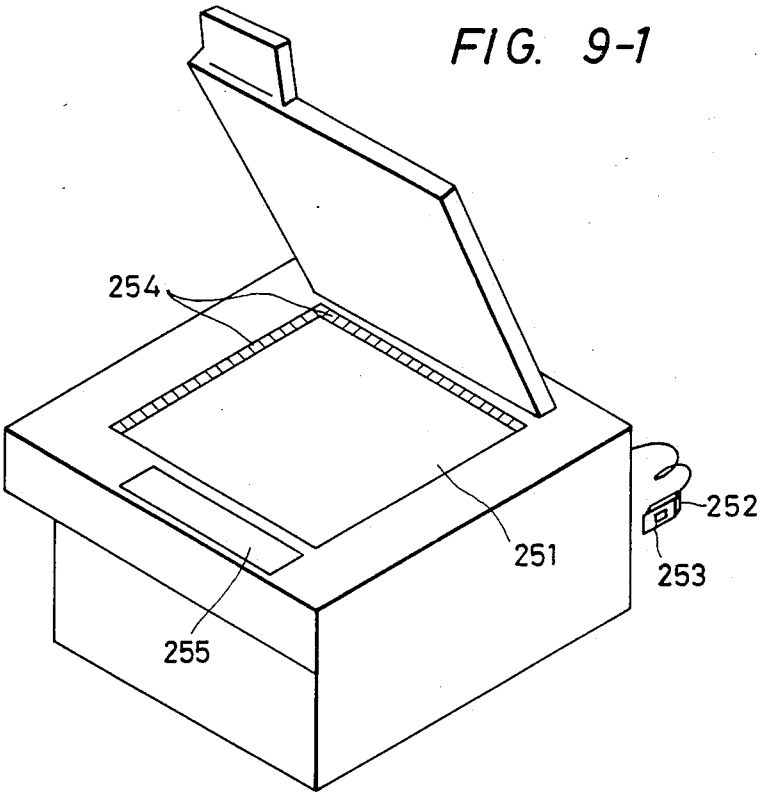
Figures 2, 9:
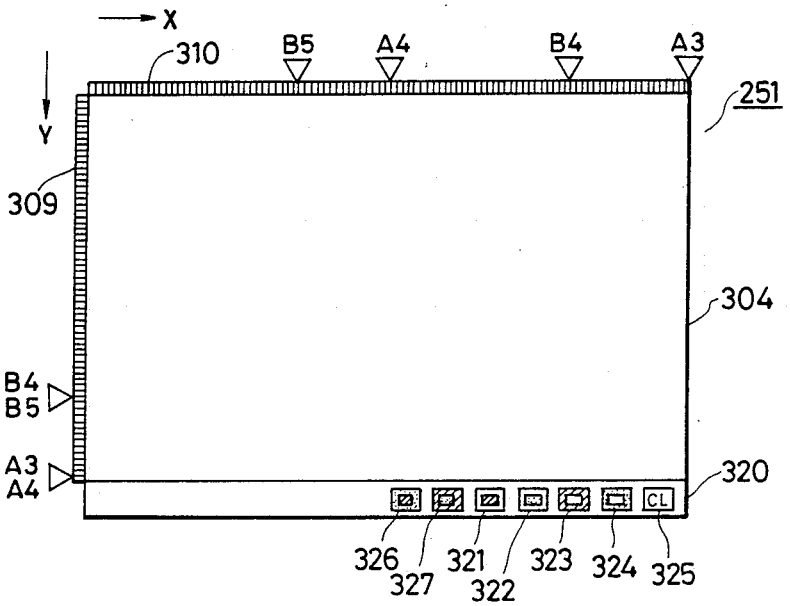

FIG. 9-1 is a perspective view of the copying apparatus according to the present invention. Reference numeral 251 denotes an original mounting glass and a touch panel (digitizer) using a transparent electrode is provided on the surface of the glass. The coordinates of the position designated can be detected by putting and pushing a pressure pen 252 onto the glass 251. The principle of the touch panel is omitted in this specification. It will be appreciated that even when the original is exposed to form an image, the latent image which is formed on the photo sensitive material will not be influenced at all since the transparent electrode is used. The pen 252 is formed with a switch 253. The coordinates can be inputted only when the switch 253 is pressed. An LED array 254 is attached at the edges of the glass 251 along the X and Y directions and can be arbitrarily lit up or off on the basis of an instruction from the CPU of the main body. An operating section 255 is used to give input/output control commands to the copying apparatus. The touch panel may be independently provided.

Figure 10:
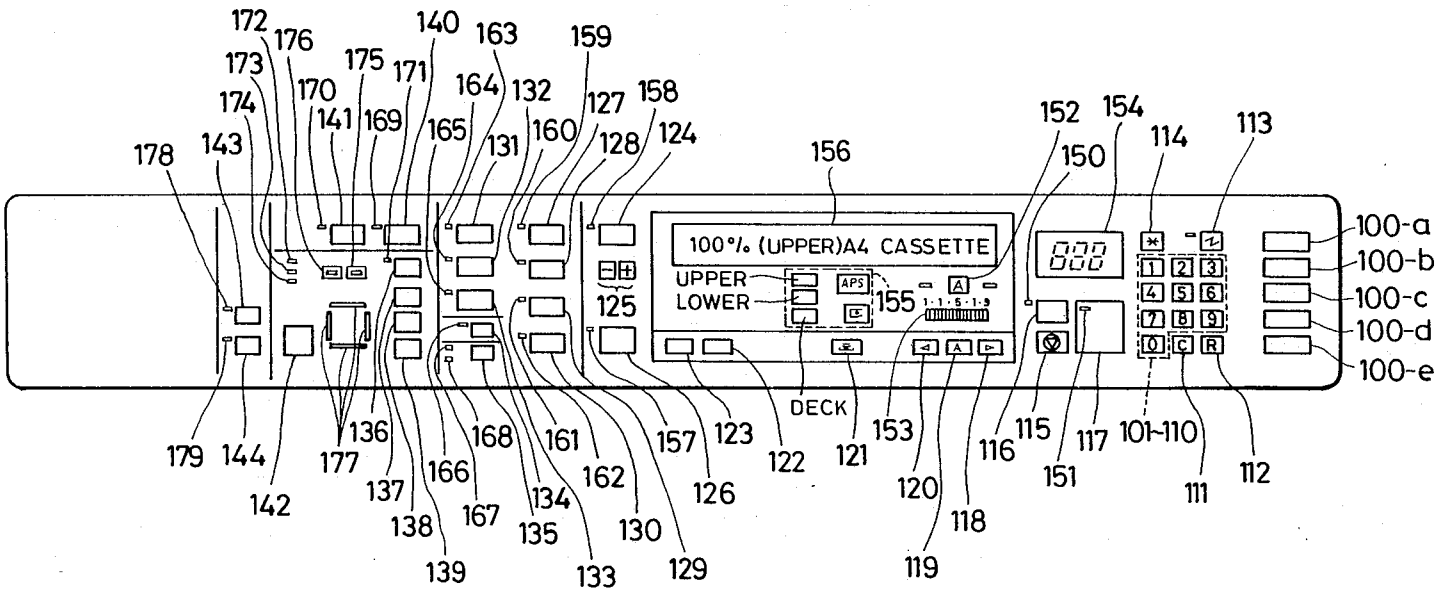
FIG. 10 is a top view of an operating section unit.

FIG. 10 is top view of the operating section unit. The functions of respective keys will be sequentially described hereinbelow.

Function keys 100-*a* to 100-*e* serve to store and access the copy mode which is arbitrarily set by each key of the operating section. Up to five kinds of modes can be stored. Namely, the mode which is ordinarily used by the user may be stored. The special magnifications which are used by the users or the areas which are designated due to an area designating process, which will be explained later, or the like can be stored. A desired copy mode can be promptly set merely by pressing one of those keys. In the copying apparatus, the memory contents are always held due to a backup power source.

Numerals 101 to 110 denote a ten-key having an ordinary function to set a copy quantity and a function to input various kinds of data in various kinds of asterisk modes by combining an asterisk key 114.

A clear key 111 is used to clear the set copy quantity or data. A reset key 112 cancels the set mode and returns to a predetermined standard mode. Numeral 113 is a pre-heating key; 114 is the asterisk key to shift to various asterisk modes; 115 a copy stop key; and 116 a color key to select arbitrary ones of a plurality of developing devices equipped in the main body of the apparatus. When the color developing device is selected, a built-in LED 150 is lit up for the purpose of warning as well.

Numeral 151 denotes a copy start key having an LED. This LED is lit up in green when the copy can be executed (excluding the time during the copy operation) and in red in the other cases. An AE key 119 selects the AE mode in which a concentration of original is detected and the developing bias is corrected and the copy of a proper concentration can be obtained. When the AE mode is selected, a display device 152 is lit up. A desired concentration can be obtained by increasing or decreasing the concentration level using manual concentration adjustment keys 118 and 120. Pressing the key 118 increases the concentration (i.e., thick concentration). Pressing the key 120 contrarily decreases the concentration (i.e., thin concentration). A concentration level of a display device 153 changes in accordance with depression of the keys 118 and 120. The display devices 152 and 153 indicate the foregoing concentration conditions. A seven-segment display device 154 displays a copy quantity.

A cassette selection key 121 is used to manually select an arbitrary cassette of transfer papers. This copying apparatus has the APS (Auto Paper Select) function. A display device 155 indicates the cassette which is selected by the cassette selection key 121 or the APS mode.

Reference numeral 122 denotes a selection key to select a fixed enlargement magnification; 123 is a selection key to select a fixed reduction magnification; and 124 is an AMS (Auto Magnification Select) key. The AMS key 124 has the function to automatically select the proper magnification on the basis of the size of original detected and the cassette size selected. The original size is detected by the CCD 18. When the AMS mode is selected, a display device 158 is lit up. A zoom key 125 makes it possible to adjust the magnification on a one-percent unit basis using the keys of "+" and "−". A direct copy key 126 sets the copy magnification to the equal magnification (100%). A display device 157 is lit up in the direct copy mode. Numeral 156 denotes a fluorescent indicative tube of the dot matrix type. The indicative tube 156 ordinarily indicates the set copy magnification, selected cassette size, copy mode, etc. and also functions as a message display to display complicated operation procedure or the like when an abnormality occurs in the apparatus or when the user erroneously operates.

Numeral 127 denotes a [one-sided→two-sided] copy selection key to automatically copy two one-sided originals onto two sides of a single paper using the middle tray in the main body of the apparatus. A [two-sided→one-sided] copy selection key 128 is used to copy a two-sided original to one side of each of two sheets of papers using an automatic circulating type original feeding apparatus (RDF). A [two-sided→two-sided] copy selection key 129 is used to copy a two-sided original to both sides of a single paper using the middle tray and RDF. A multi-copy selection key 130 is used to execute the multi-copy by overlapping two or more images on a single paper using the middle tray.

Pressing either one of the keys 127 to 130 allows one of display devices 159 to 162 to be lit up in correspondence to the key pressed.

A continuous copy selection key 131 is used to select the mode in which the original put on the original plate is divided into right and left parts and these two parts are exposed and scanned due to a single operation and two copies (which are respectively referred to as an A copy and a B copy) can be obtained.

A continuous copy/multi-copy selection key 132 has the function to multi-copy the A and B copies in the continuous copy mode mentioned above onto the same paper.

A continuous copy/two-sided copy selection key 133 has the function to copy the A and B copies onto the front and back surfaces of the same paper using the middle tray.

A frame deletion key 134 has the function to erase the shade which is caused at the edges of a book or in the central portion of double-spread pages in the continuous copy mode.

An image shift key 135 can shift an image to either the left or right. An amount of shift can be also adjusted by pressing the ten-key with the image shift key 135 pressed. The shift amount can be also stored by the function keys 100-*a* to 100-*e*. On the other hand, in the case where the multi-copy mode is set when the copy is executed in two different colors, the registration timing is controlled such that the shift amounts upon first and second copies coincide. The same shall also apply to the case of the monochromatic copy.

An area designation key 136 is used to designate areas and also used to cancel the areas designated. For the area designation, it is possible to select either one of two modes: in which a priority is given to the original (the size of area to be designated can be also varied in accordance with the variable magnification); and in which a priority is given to the cassette (the size of area to be designated is constant irrespective of the variable magnification). An X/Y key 137 serves as a data input key to input the coordinates of the area which is designated by the ten-key.

An in/out key 138 is used to select whether only the inside or outside of the area designated is developed.

A correction key 139 serves as a data recall key to call and correct the set area data.

An automatic switching key 140 is used to switch in/out of the area in the multi-copy mode and the developing colors. When the key 140 is pressed in the multi-copy mode, in/out and colors are automatically switched in accordance with the A copy and B copy.

An automatic color switching key 141 is used in the continuous copy mode and has the function to automatically switch the developing colors in the case of the A and B copies. A display device 170 is lit up when the key 141 is pressed.

Each LED indicated by numerals 157 to 171 denotes a mode display device to show the mode selected. Display sections 172 to 174 show the numbers of set areas. In the copying apparatus of the embodiment, up to three areas can be set. Display sections 175 and 176 indicate in/out of the area and either one of these display sections corresponding to the mode which is set by the key 138 is lit up. A group of LEDs indicated at 177 are display devices to show which one of the $X_{min}$, $X_{max}$, $Y_{min}$, and $Y_{max}$ the value of the set area is.

Numeral 142 denotes an area designation key using a CCD. Pressing the key 142 allows the optical system to start scanning and execute only the function to recognize the designated area by reading the markers written on the original.

A sort key 143 and a collate key 144 are also provided.

Display devices 178 and 179 display the sort mode and collate mode, respectively.

Figure 11:
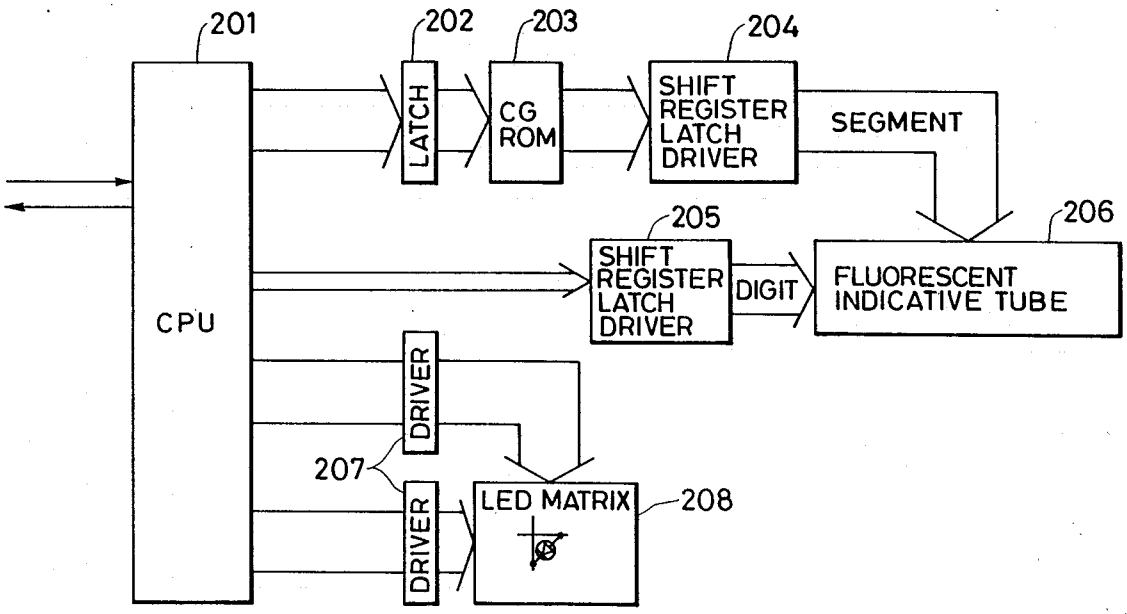
FIG. 11 is a block diagram showing an arrangement of a display section.

FIG. 11 is a fundamental block diagram showing an arrangement of the display section.

A CPU 201 is a microcomputer to control each display device and the display elements. The contents of display are based on the data from the CPU of the main body.

A fluorescent indicative tube 206 can display forty characters each consisting of 5×7 dots. The data of 7 bits×5 bytes is needed to constitute one character. The data of thirty-five bits is sequentially read out from a character generator 203 in response to an instruction of the CPU 201 and transferred to a shift register latch driver 204. The data as much as five bytes, namely, 35 bits is latched by the driver 204. Thereafter, a digit signal to determine the timing when one character is displayed is driven by the driver 205, so that one character is displayed. In this manner, the characters are displayed one by one by dynamically lighting up the fluorescent tube. The duty ratio is 1/40 or less (because of the blanking period).

Numeral 208 denotes another LED matrix in the display section. This LED matrix is driven by dynamically lighting up each LED.

Figure 12:
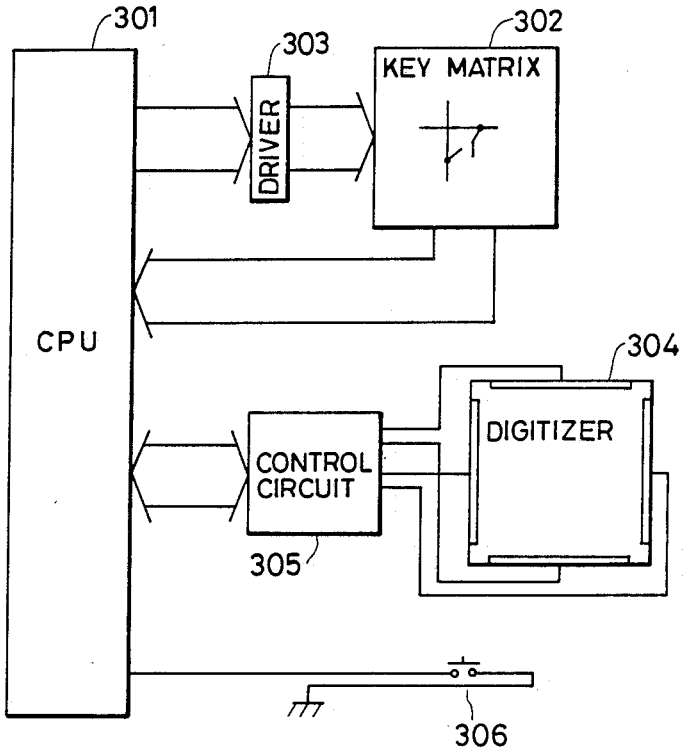
FIG. 12 is a block diagram of an input section.

FIG. 12 is a block diagram of the peripheral components of the input section of a CPU 301 to control the main body. A key matrix 302 is a group of switches which are provided for the respective input keys and is dynamically processed by the CPU 301 due to a well-known technique, thereby determining which key was pressed.

Numeral 304 denotes a digitizer. The x and y coordinates of the position which is indicated by pressing a light pen are detected by a control circuit 305.

The light pen is formed with a coordinate input trigger signal switch 306. The CPU 301 reads the coordinates of the portion pressed by the pen synchronously with the trigger edge of the coordinate input trigger signal.

Figure 13:
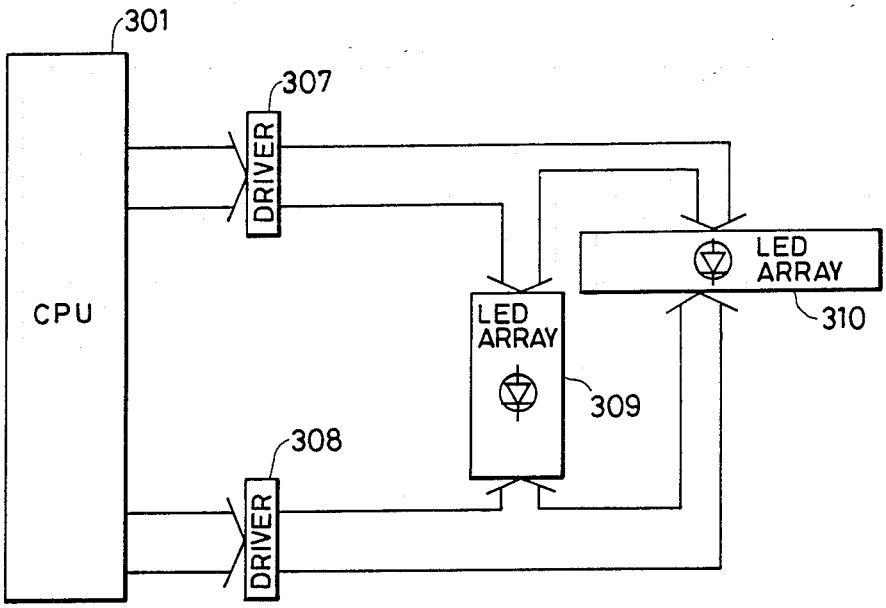
FIG. 13 is a block diagram of a drive circuit of an LED array.

FIG. 13 is a drive block diagram of the LED array arranged at the frame of the original glass plate for displaying the designated areas.

LED arrays 309 and 310 are arranged along the frame of the glass in the X and Y directions, respectively, and dynamically lit up by the CPU 301.

Figure 14:
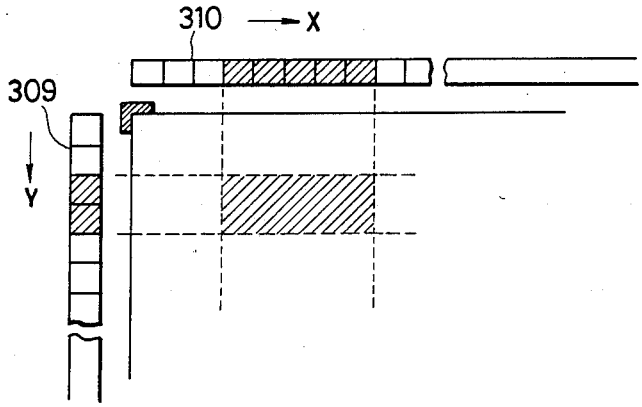
FIG. 14 is a diagram showing the situation in which the LED array was lit up.

FIG. 14 shows the situation of the LED arrays 309 and 310 when they were lit up. When it is now assumed that the copy in the area in the hatched portion in FIG. 14 was designated, the LEDs representing the x and y coordinates corresponding to the area where an image is formed are lit up (as shown by the hatched portions of the LEDs in the diagram).

On the contrary, if the copy out of the area was designated, only the LEDs of the hatched portions are lit off and the other LEDs are lit up.

On the other hand, the LEDs of the portion where no image is formed in the designated area may be lit up contrarily.

Figures 1, 15:
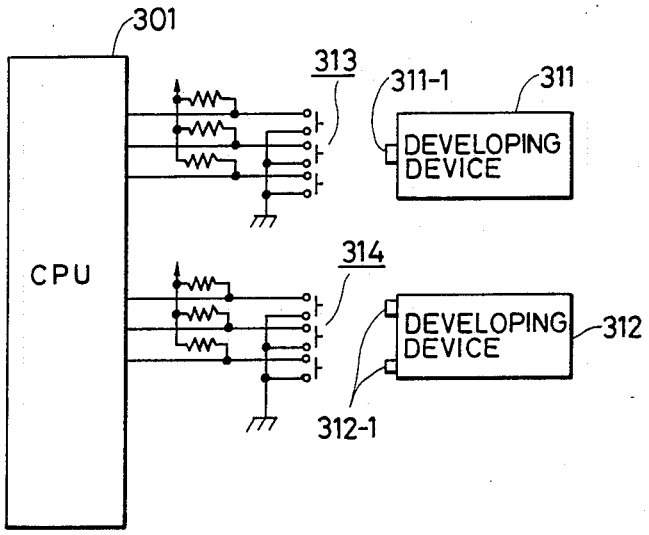
Figures 2, 15:
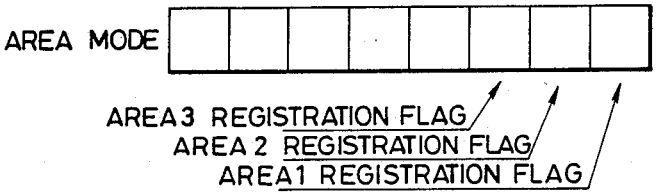
Figures 3, 15:
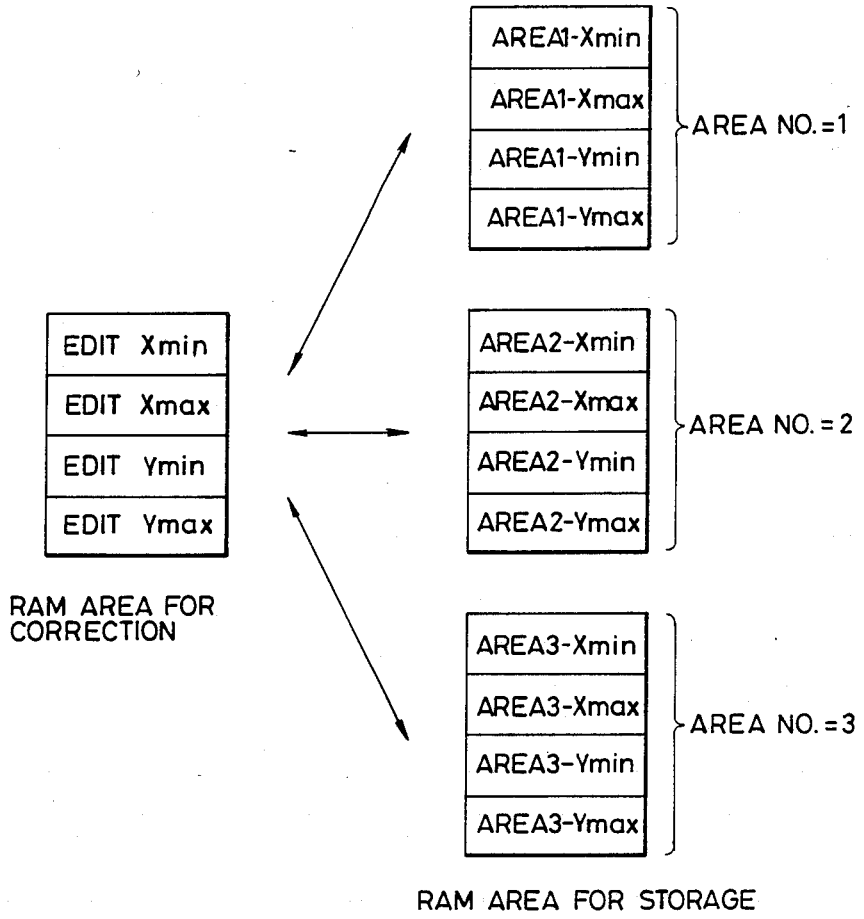
Figures 4, 15:
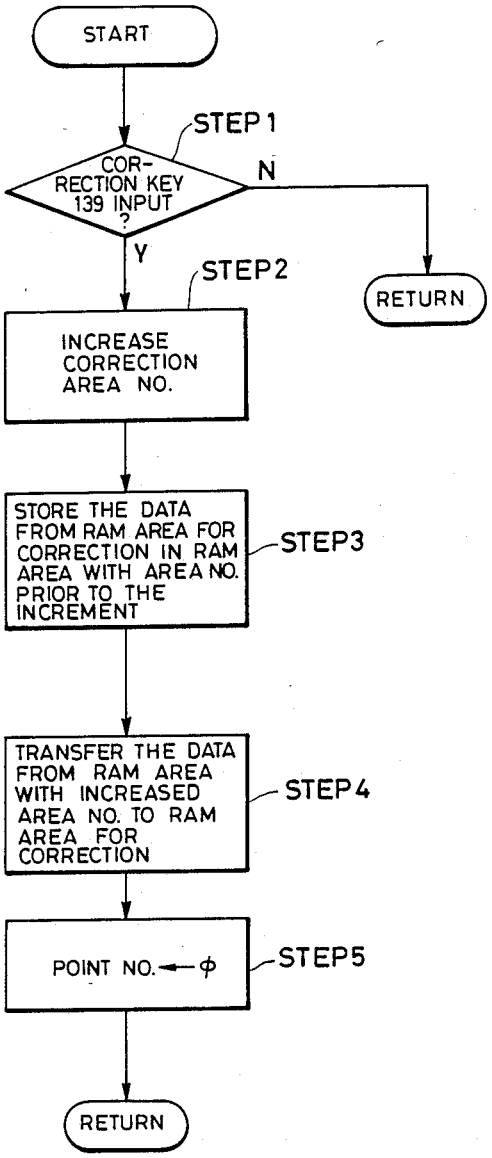
Figures 5, 15:
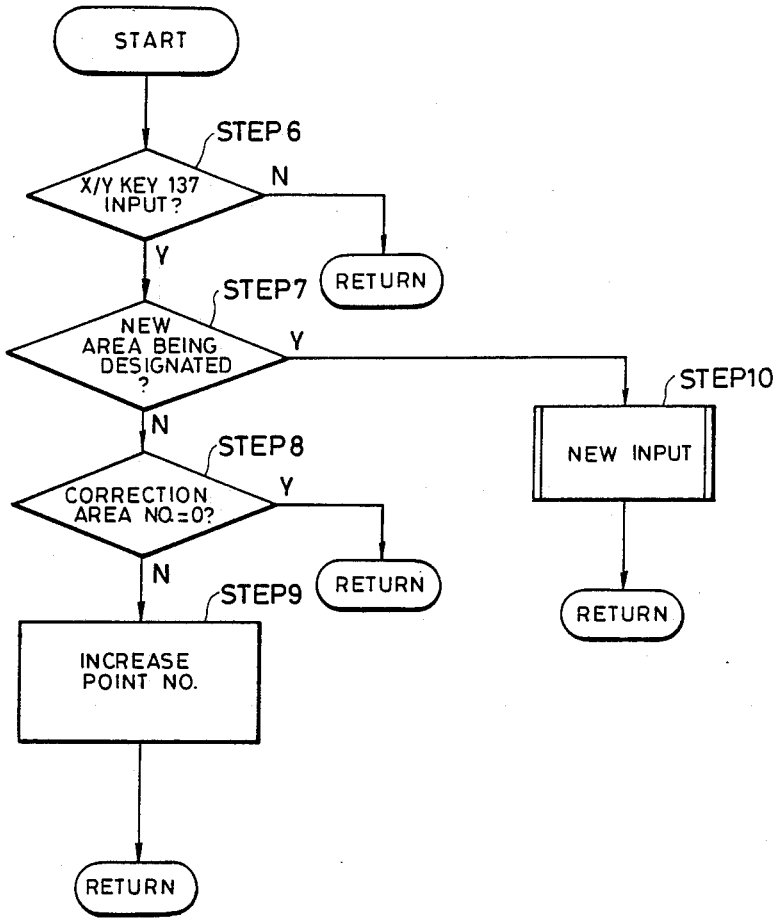
Figures 6, 15:
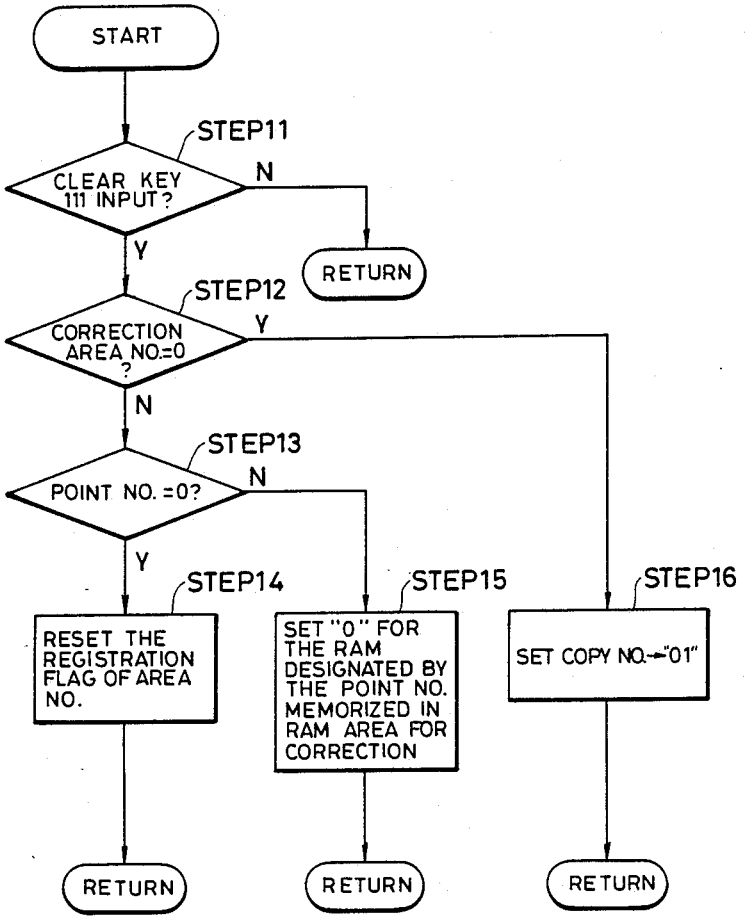
Figures 7, 15:
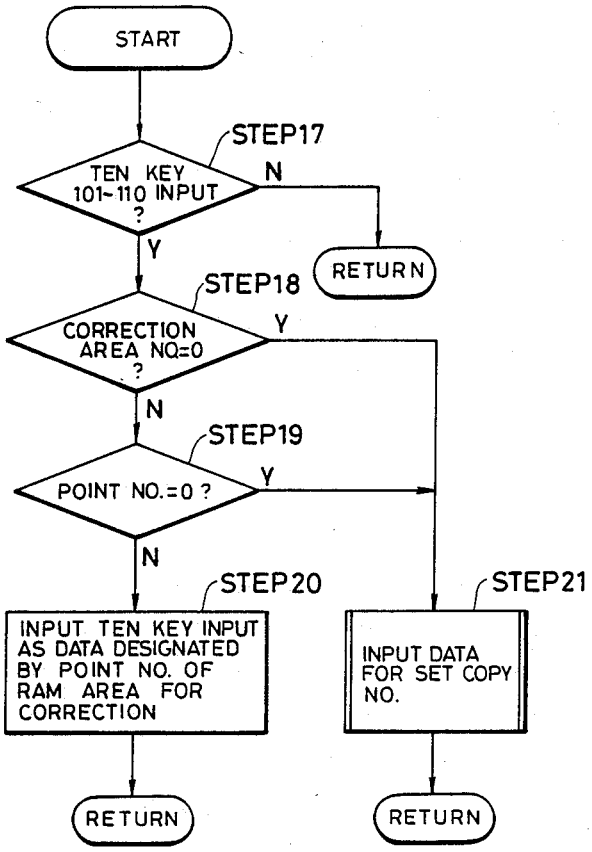

FIG. 15-1 shows color detection circuits of the developing devices.

Color detection switches 313 and 314 are closed by projections 311-1 and 312-1 provided for developing devices 311 and 312. The CPU 301 determines the color of the developing device which is set in dependence on the ON/OFF states of the color detection switches 313 and 314. Namely, each developing device has a peculiar switch pattern for every color. For instance, in the case where three color detection switches are used as shown in FIG. 15-1, seven ($2^3-1$) kinds of colors can be discriminated.

The case of setting areas will then be considered.

When the area designation key 136 in FIG. 10 is pressed, "Area Designation . . . 1: Original Standard 2: Cassette Standard" are displayed on the message display 156 The message corresponding to the content which is currently selected is displayed as a flashing message indication. The mode can be also changed by pressing "1" or "2" of the ten-key. A series of these display operations are executed only when the key 136 is pressed.

An explanation will be made with respect to the case of selecting the area designation mode of the original reference. In this mode, the values of the X axis (sub-scanning direction, i.e., the scanning direction of the optical system) and Y axis (main scanning direction, i.e., the scanning direction of the CCD) from the origin of the coordinates determined with regard to the original are inputted to designate the area. The designated area is also automatically enlarged or reduced in the variable magnification copy mode.

Four points are designated by the ten-key 101 to 110 and X/Y key 137 in accordance with the sequence of the $X_{min}$ coordinate, $X_{max}$ coordinate, $Y_{min}$ coordinate, and $Y_{max}$ coordinate and the designation of one area is completed. Practically speaking, each data is inputted in accordance with the sequence of "X/Y", $X_{min}$, "X/Y", $X_{max}$, "X/Y", $Y_{min}$, "X/Y", $Y_{max}$, "X/Y". Each coordinate is set on a one-millimeter unit basis.

When the "X/Y" key 137 is inputted after the numerical values were set, a group of LEDs of 177 are sequentially lit up. Thus, the user can confirm that the coordinate of each point is inputted. In this case, each coordinate is inputted on the basis of the interactive manner by way of the message display 156, such as "Area 1: Coordinate to Xmin . . . o o o mm". Therefore, even in the case of the user which uses the apparatus for the first time, he can easily set the necessary data.

After one area was set by inputting four points in this manner, the LED 172 is lit up to inform that one area was set. In addition, the out mode (copy in the area) is automatically selected and the display device 175 is lit up. It is possible to change to the in mode (copy out of the area) by the in/out key 138.

On the other hand, an area can be also designated by way of the touch panel using a group of switches of the transparent electrode on the original plate 251.

In this case, the original is set on the original plate such that the image side faces upwardly. However, a reference point in this case is located leftwardly on this side of the original plate and differs from the reference point (leftward on the back side) when the copy is actually executed. In this state, two points on a diagonal line of the designated area (which is limited to only a rectangle) on the original are pointed by pressing the pressure pen 252. The input switch 253 is then pushed with the pressure pen 252 pressed. The coordinates of the portion pushed by the pen 252 are inputted by a signal which is instantaneously generated when the input switch 253 was pressed or removed. No coordinate is inputted even when the coordinates are designated by the pressure pen in the state in which the input switch 253 is continuously depressed.

In the case of designation of the coordinates by the pen, two coordinates of X and Y are simultaneously designated merely by pressing a single point. Therefore, two of the LEDs of 172 are simultaneously lit up. In addition, since the coordinates inputted are displayed as the numerical values in the message display section 156 simultaneously with the input of the coordinates, they can be confirmed by the eyes. As described above, the area can be set merely by designating two points on a diagonal line due to such a transparent digitizer input method.

The area designation by way of a CCD will then be described.

First, the original whose area is designated is set on the original plate and copied using a color developing device (other than black). A desired area is thickly marked like a frame on the copied paper using a marking pen or the like. The reason why the original was developed in color is because it is necessary to obtain the concentration difference between this color and the color of the marking pen. It is desirable to develop in slightly thin color so that a desired area can be distinguished. In addition, the original may be covered with a transparent sheet or a thin paper or the like and a desired area may be marked on this sheet or paper. Next, the marked original (including the transparent sheet or thin paper or the like) is reset on the original plate and the area designation key 142 is pressed. Thus, the optical system starts scanning and the marked area on the original is recognized by the CCD 18 arranged on the optical path. It is now assumed that upon area detection, only one portion can be recognized by a single scan. The recognized area can be confirmed since the coordinates are displayed by the message display.

In this manner, the area can be designated by three kinds of input methods using the ten-key, touch pen, and CCD. Up to three areas can be designated by arbitrarily combining these methods.

When the areas are designated, they can be also stored using the function keys **100*a* to 100*e***.

Further, the inputted area data can be confirmed by the message display 156 and can be also checked by the eyes by the LED array 254 arranged along the X and Y axes of the original glass plate 251.

Upon confirmation, the areas can be selected by the correction key 139. Namely, the first area is selected by once pressing the key 139. The second area is selected by again pressing the key 139. The third area is selected by further pressing the key 139. Then, the correction mode is canceled by pressing the key 139 still again and the first area is again selected by moreover pressing the key 139. In addition, by selecting the X and Y coordinates by the X/Y key 137, these coordinates can be sequentially accessed on the message display. In this state, by changing the area data stored in the memory using the ten-key, the set area can be also corrected. Obviously, the numerical values inputted by the transparent digitizer (touch panel) or CCD or the like can be also corrected by the ten-key.

In addition, by selecting the area by the correction key and pressing the clear key 111, only the special area can be also deleted.

After the area was set and the in/out was set as described above, the latent image corresponding to the portion in or out of the area is erased by the erasing means in the copy process, so that a desired copy can be derived.

On the other hand, by constituting the apparatus such that ON/OFF of the LED array can be instructed by the operating section and by lighting up the LEDs in a desired range, the area can be also designated.

After the CPU 301 confirmed the coordinates of the area, it lights up (copy out of the area) or lights off (copy in the area) the blank exposure lamp (LED array) at the timings corresponding to the $X_{min}$ to $X_{max}$ of the image formed on the drum with respect to the sub-scanning direction (X direction). The CPU 301 lights up (copy out of the area) or lights off (copy in the area) the LED array in the range corresponding to the $Y_{min}$ to $Y_{max}$ of the image formed on the drum with respect to the main scanning direction (Y direction). Due to this, the copy in or out of the area is obtained.

The key input upon area designation will then be described.

FIG. 15-2 shows a RAM of the area mode and lower three bits are flags indicative of registration of areas 1 to 3. When an area is set by the ten-key or digitizer or the like, the flag of the number of this area is set.

FIG. 15-3 is a conceptional diagram showing the contents of the RAM when the area is corrected. When the new area is set, the flag indicative of the number of the new area is set, and at the same time the data of four points ($X_{min}$, $X_{max}$, $Y_{min}$, $Y_{max}$) is stored for each area. Since up to three areas can be set, memory locations as many as the areas are provided in the RAM.

In the case of correcting or erasing the area, the area is selected by the correction key 139 and the data in the selected area is loaded into the area for correction in the RAM. Further, the points are selected by the X/Y key 137 and the relevant data is corrected by the ten-key and clear key and the data is again stored into a predetermined area in the RAM and the correction is completed. The area correcting procedures which are executed for every key will then be described hereinbelow with reference to flowcharts.

FIG. 15-4 is a flowchart when the correction key 139 was inputted.

In step 1, a check is made to see if the correction key has been inputted or not. If it is YES, the correction area number is increased and the area number of 1, 2, or 3 is selected (step 2). However, in the case where the area which is indicated by the area number is not registered yet, this number is skipped (namely, when none of the areas is registered, the correction area number is always "0"). After the area No. 3, the area No. 1 is selected.

In step 3, the data which has already been stored into the RAM area for correction is stored into a predetermined RAM area and the data of the area No. which is newly selected is loaded into the RAM area for correction (step 4).

At this time, the point number is set to "0" (step 5).

FIG. 15-5 is a flowchart when the X/Y key 37 was inputted.

When the X/Y key 137 was inputted (step 6), a check is made in step 7 to see if the new area is at present being set or not. If the new area is set, the different processes are executed; however, the description is omitted (step 10).

The correction area number is checked in step 8. When the correction area No. = "0" (namely, in the case where the correction is not being performed) the input of the X/Y key 137 is ignored. When the correction area number was given, the point number is selected in step 9 in a manner such that:

Point No. 0 (inital)→ Point No. 1 ($X_{min}$)→

Point No. 2 ($X_{max}$)→ Point No. 3 ($Y_{min}$)→

Point No. 4 ($Y_{max}$)→ Point No. 0

FIG. 15-6 is a flowchart when the clear key 111 was inputted.

When it is determined that the clear key 111 was inputted in step 11, a check is made in step 12 to see if the designated area is at present being corrected or not. In the case where the correction (including the designation) is not being executed, the set copy quantity is cleared (step 16). When the area is being corrected, a check is made in step 13 to see if the point number has been designated or not (i.e., the point No. = 0 or not). If it is NO (=0), the registered area is canceled (i.e., the registration flag of the area mode is reset) in step 14. When the point number was designated (≠0), the RAM data of the designated point is cleared (set to "00") in step 15. For example, when the point No. = 1, "0" is substituted for the edit $X_{min}$ of the RAM area for correction.

FIG. 15-7 is a flowchart when the ten-key 101 to 110 was inputted.

When it was determined that the ten-key was inputted in step 17, steps 18 and 19 follow. When it is decided that the area is being corrected (including the case where the area is being designated) in steps 18 and 19, the data which is inputted by the ten-key is inputted as the data which is designated by the point number of the RAM area for correction in step 20.

On the contrary, when the area is not being corrected, the input ten-key data is inputted as the numerical data for the set copy quantity or the like (step 21).

FIG. 9-2 is a diagram showing the original mounting plate. A command section 320 is provided on this side in the digitizer 304 which is formed from the transparent electrode. A command is selected by pressing with the pen in a manner similar to the input of the coordinates in the case of the area designation. In this case, the coordinates pushed by the pen are read. If the coordinates which are read lie in the original mounting area, the area designation or magnification designation is determined. If the coordinates lie in the command section area, the command corresponding to the coordinates is selected. Reference numeral 321 denotes a command to copy the portion inside of the designated area in black; 322 is a command to copy the portion inside of the designated area in color (for instance, red); 323 a command to copy the portion out of the designated area in black; 324 a command to copy the portion out of the designated area in color; 325 a command to clear the coordinates inputted by the pen; 326 a command to copy the portion inside of the designated area in black and to copy the portion out of the designated area in color; and 327 a command to copy the portion inside of the designated area in color and to copy the portion out of the designated area in black. In this manner, the area and color can be designated by the digitizer.

It will be appreciated that the digitizer is not arranged on the original glass plate but may be provided on the front side of the original cover or may be provided separately from the main body of the copying apparatus.

As the principle of the digitizer, it is possible to consider various kinds of principles such as detection of a position by way of detection of a resistance value, and electrostatic capacitance, or a distortion factor, or by way of the light, or the like.

The copying apparatus of this embodiment has the original size detecting means using the CCD 18 and comprises the cassette size input means and the zoom lens 16 for continuous variable magnification, thereby realizing the AMS and APS.

When a copy start key 117 is pressed, the optical system starts pre-scanning. The original image at this time is inputted to the CCD to detect the original size. The pressing plate 90 is formed as the mirror surface for this purpose and the concentration difference between the original and the mirror surface is provided, thereby detecting the original size on the basis of the position where the concentration changes. The erasure means prevents that the toner is deposited onto the latent image corresponding to the mirror surface portion and formed as a visible image. There are some originals which are decided such that no original is set because they have thick concentrations. Therefore, in the case where it has once been determined that no original is set, the lighting voltage and discrimination reference level and the like are changed and the pre-scan is again executed, thereby detecting the original size.

In the case where the set position of the original detected is deviated from the reference point by a distance larger than a predetermined value, this fact is warned by the message display 156 as the wrong original set position. The execution of the copy sequence after that is stopped. In a manner similar to the above, when it is detected by the CCD 18 that the original is obliquely set, the alarm indication is also performed and the subsequent copy sequence is stopped. In this case, the oblique setting of the original is detected by the coordinates of the corner portion of the original or from the gradient of the edge of original.

However, there is also a case where the user purposely sets the original obliquely. Therefore, even in such a case, if the alarm canceling mode is selected by an alarm canceling switch (not shown), the copy sequence can be executed. In this case, the X and Y coordinates of the point at the farthest position from the reference point are determined as the original size and the AMS and APS can be executed. The erasure means is apparently needed to erase the portion which was decided to be out of the original.

Further, if the original is set at the position which is deviated with respect to the X axis (in the scanning direction of the optical system), the image is automatically shifted and the scan timing and the paper feed timing (operation timing of the registration roller 28) are adjusted and the proper image can be also derived.

On one hand, even if an alarm was generated, by pressing again the copy key, the copy may be executed by ignoring the warning.

When either one of the selected cassette size or copy magnification was designated for the original size detected as mentioned above, the other can be automatically calculated and determined (AMS, APS).

The paper size which is calculated from the original size and magnification is not always the formal size. Therefore, in this calculation, the minimum cassette size including this calculated paper size is considered as the first condition. In order to prevent that the original size is erroneously determined to be the size which is one-stage larger due to the slight missetting or misdetection, the data indicative of the original size is processed in a manner such as to be handled as the size which is slightly smaller than the actual size (in other words, an allowance is given). Practically speaking, an allowance of a few millimeters is given in each of the X and Y directions.

On the other hand, the proper magnification is determined by the original size and cassette size. However, it is a general manner to copy from a formal size to another formal size at a variable magnification (including the direct copy mode, i.e., the copy from a formal size to the same formal size). Therefore, in the case where the detected original size coincides with or is nearly equal to the formal size, the peculiar magnification between those formal sizes may be also preferentially selected in place of the accurately calculated magnification.

For the copy paper size, as well as the standard size which is prepared by the maker side, there are some cases where special sizes are frequently used by the user or country. In the copying apparatus of this invention, to execute the AMS and APS in correspondence to these special sizes as well, the X and Y dimensions can be also registered with respect to these universal cassette. The setting method in this case includes three kinds similarly to the area designation.

First, the apparatus is set to the standby mode by the asterisk (*) mode. At this time, the dimensions are displayed and instructed on the message display in an interactive manner.

"Univeral 1: *X* (vertical): - - - mm",
*Y* (horizontal): - - - mm"

In the initial state in which nothing is instructed, the maximum paper size of A3 or LGR or the like is set.

The dimensions in the X and Y directions are inputted by the ten-key on a 1-mm unit basis in this state.

The original is set onto the original plate 251 and the paper size can be set by the transparent electrode, or the paper size can be detected and registered due to the CCD scan as well. The CCD scan is executed by the area designation key 142. These size detection and registration are effective only in the universal cassette registration mode among the asterisk modes (*).

As described above, the APS and AMS can be also executed with respect to informal original size, informal paper size, and between arbitrary magnifications.

On the other hand, the copying apparatus of this invention having the area designating function can also execute the AMS or APS on the basis of the size of designated area and paper size or magnification instead of the original size.

The magnification setting method will then be described.

In this copying apparatus, the magnification can be also set using the transparent digitizer on the original plate in addition to the setting of the magnification by the fixed magnification selection keys 122 and 123, arbitrary magnification (zoom) selection key 125, automatic magnification selection key 124, etc. In this case as well, the magnification can be set by selecting the magnification setting mode among the asterisk (*) modes and indicating two points on the digitizer on the original plate. That is, the magnification is set in correspondence to the ratio between the distance from the point indicated by the first push to the reference point of the original and the distance from the point indicated by the second push to the reference point of the original. If a distant point than the point indicated by the first push is indicated by the second push, the enlarged image can be obtained. Contrarily, if a near point is indicated, the reduced image can be obtained. This instruction is also displayed on the message display.

"1 push: 2 push = - - - mm: - - - mm - - -> - - - %"

The variable magnification can be also decided by substituting two values using the ten-key in a manner similar to the above. There is also a case where the calculated magnification exceeds the possible variable magnification which can be set by the copying apparatus due to those two magnification deciding methods. In this copying apparatus, in order to make it possible to obtain a desired magnification by repeating the copy up to two times, if tee magnification cannot be obtained by only the first copy, the second copy magnification can be simultaneously instructed as shown below.

"o o o% 1st: o o o%, 2nd: o o o%"

After the first copy was performed, the paper which was copied at a variable magnification is set onto the original plate and the displayed magnification is inputted and the copy is again executed, so that the copy of a desired magnification can be obtained.

Therefore, this apparatus having the copy magnifications of 50 to 150% can instruct the copy magnification within a range of 25 to 225%.

After completion of the first copy, the magnification of the second copy may be automatically set.

In addition, the copy magnification can be also determined by way of a combination of the digitizer input and the original detection due to the CCD. Namely, the position corresponding to a desired size to which the copy area is enlarged or reduced by the digitizer is designated by the pen. Then, the original is set and the original size is detected upon pre-scanning. The copy magnification may be determined from the ratio between those two sizes. The repetitive number of copy times may be set to an arbitrary value as far as a deterioration of picture quality is permitted.

Figures 1, 16:
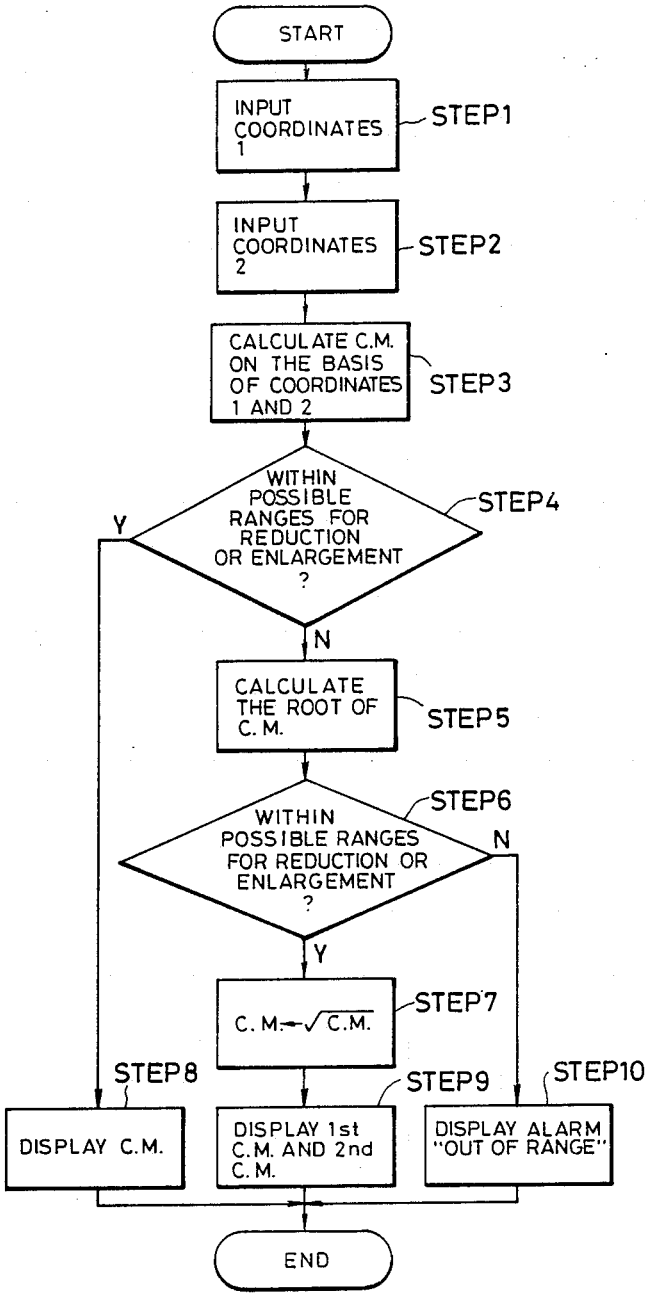
Figures 2, 16:
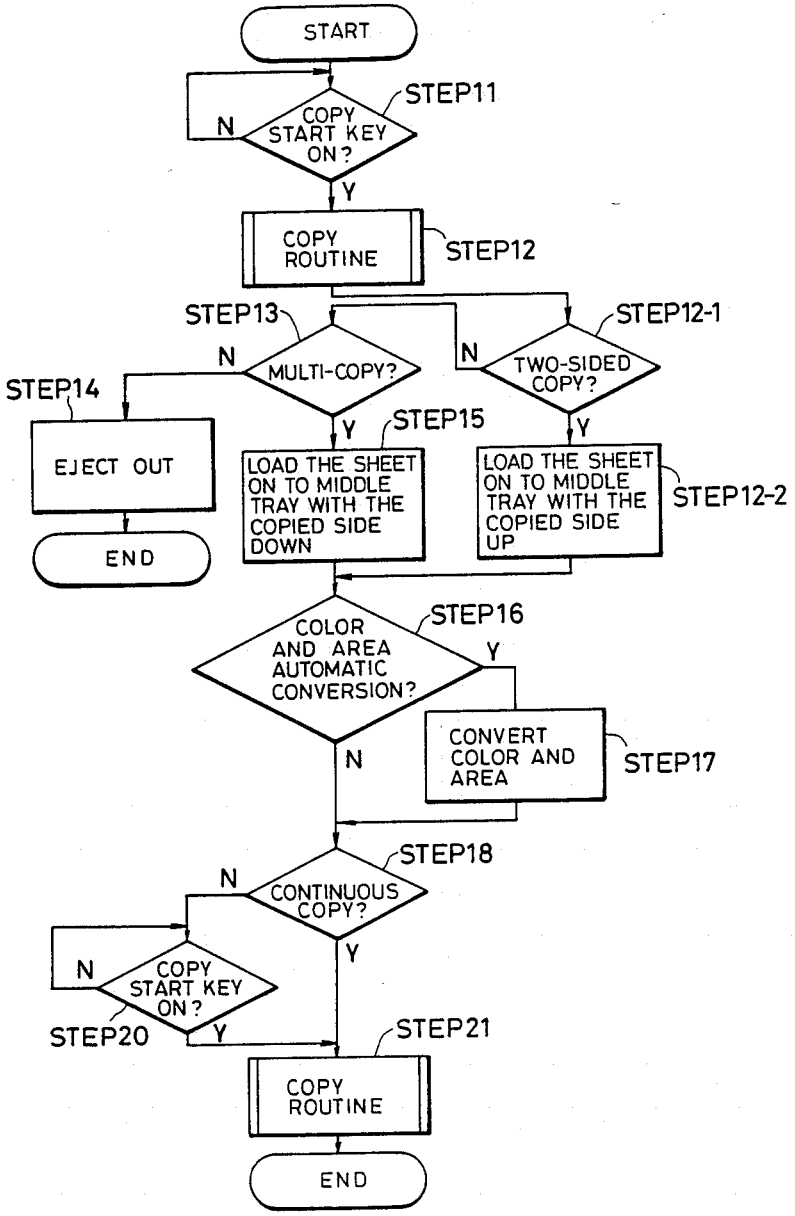
Figures 3, 16:
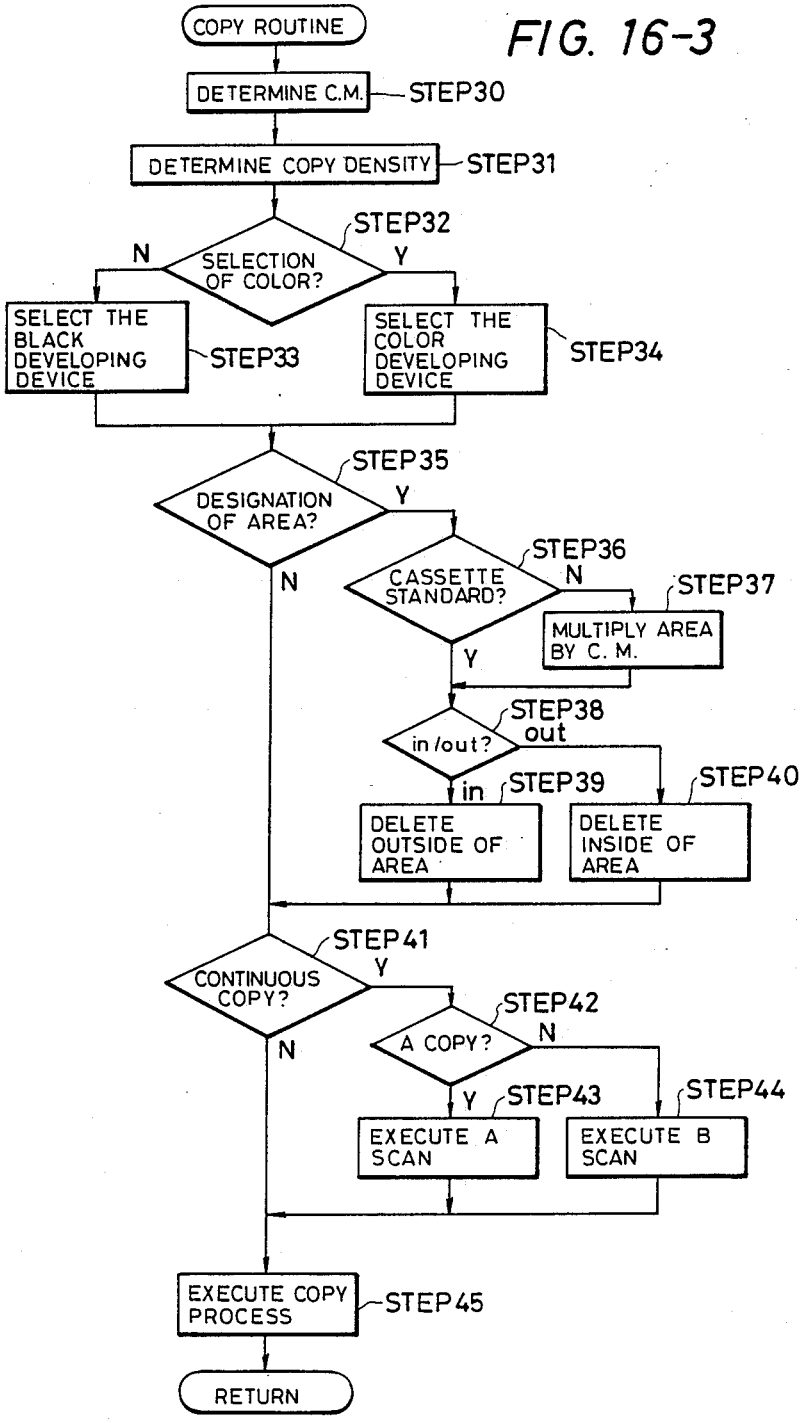
Figures 4, 16:
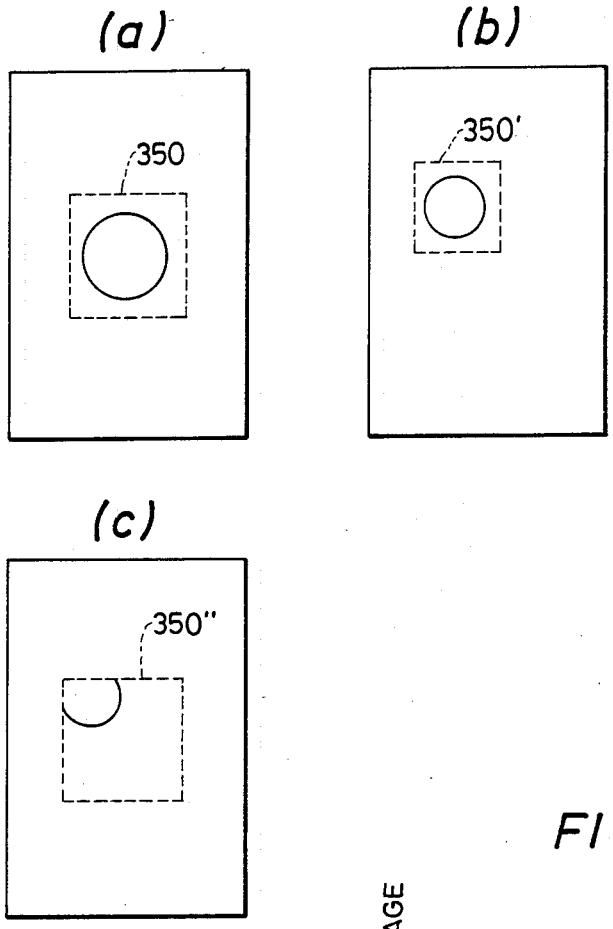

FIG. 16-1 is a flowchart in the case of determining the copy magnification using the digitizer or ten-key. The first coordinates corresponding to the size of original, for example, are first inputted by the light pen or ten-key (step 1). Next, the second coordinates, e.g., coordinates corresponding to a desired copy size are inputted (step 2). For the input of the coordinates, the point on a diagonal line of the origin on the original glass plate is designated. In the case of inputting the coordinates by the ten-key, it is sufficient to input only the X or Y coordinate. The copy magnification (C.M) is calculated from the ratio of the coordinate 2/coordinate 1 which are inputted (step 3). A check is made to see if the calculated copy magnification lines within a possible range for reduction or enlargement of the apparatus or not (step 4). If it lies within the possible range, the magnification at this time is displayed (step 8). If it is out of the possible range, the root of the calculated C.M. is obtained to check whether or not the copy can be completed by executing twice (step 5). A check is made on the basis of the value of the root to see if the C.M. lies within the possible range or not (step 6). If it lies within the possible range, the value of the root obtained is used as the C.M. and the first and second copy magnifications are displayed (step 9). If it is out of the possible range, this fact is warned by displaying on the message display (step 10).

If the first and second C.M. are the same, namely, they are the root of a desired magnification, there is no need to set the second C.M.

The first and second C.M. are not necessarily obtained by the root. The possible C.M. upon the first copy is set to the first C.M. The value of quotient of the division between the C.M. as a divided which was calculated for the first time and the resultant first C.M. as a divisor may be also used as the second C.M. Therefore, several kinds of combinations exist. In addition, it will be obviously understood that unless the picture quality is considered, a further wide magnification can be derived due to the copy of three or four times.

The control of the copy operation will then be described with reference to flowcharts of FIGS. 16-2 and 16-3 with respect to the functions of the continuous copy, multi-copy, area designation, etc. In step 11, a check is made to see if the copy start key is ON or not. If it is ON, the copy routine is executed (step 12).

The copy routine of FIG. 16-3 will be explained. First, the copy magnification (C.M.) and copy concentration are determined and the position of the lens and the developing bias and the like are adjusted (steps 30 and 31). A color selection is discriminated, namely, a check is made to see if the color copy mode has been designated or not (step 32). Unless the color mode is selected, the black developing device is selected (step 33). If the color mode was selected, the color developing device is selected (step 34). A check is then made to see if an area has been designated or not (step 35). If an area was designated, a check is made to see if it is based on the cassette standard of a variable magnification or not (step 36). Unless it is the cassette standard, it is the original standard and the area itself is also enlarged or reduced in accordance with the variable magnification. Therefore, the area which is obtained by multiplying the designated area with the C.M. determined in step 30 is used as the set area (step 37). Therefore, in the case of performing the copy out of or in the area, it is sufficient to light up the LEDs for blanking corresponding to the new area. A check is then made to see into which mode the in/out key has been set, in other words, to see if the copy mode has been set to the in-mode or out-mode (step 38). In the case of the in-mode, the flag is set so as to delete the portion out of the area by controlling the blank exposure lamp (step 39). In the case of the out-mode, the flag is set so as to delete the portion inside of the area (step 40).

If no area is designated, the above-mentioned control is not executed. A check is made to see if the copy mode is the continuous copy mode or not (step 41). If it is YES, a check is made to see if the A copy (the left half portion of the original put on the original plate is copied) is performed or not to determine the scan width (step 42). If it is the A copy, the flag is set so as to perform the A scan (the left half portion of the original put on the original plate is scanned) (step 43). Unless it is the A copy, the flag is set so as to execute the B scan (the right half portion of the original is scanned) (step 44). Unless it is the continuous copy mode, the scan corresponding to the size of original is performed. The copy processes of the exposure, development, transfer, fixing, and the like are executed in accordance with the conditions which are determined in the above discrimination steps (step 45).

The copy routine is executed as described above. Returning to FIG. 16-2, a check is made to see if the copy mode is the two-sided copy mode or not in step 12-1. If it is YES, the sheet is loaded onto the middle tray with 'the copied side up (step 12-2). If it is NO, a check is made to see if the copy mode is the multi-copy mode or not in step 13. Unless it is the multi-copy mode, the paper is ejected out onto the paper delivery tray (step 14). If it is the multi-copy mode, the sheet is loaded onto the middle tray with the copied side down (step 15). A check is made to see if the apparatus is in the automatic conversion mode of color and area or not, namely, to see if the key 140 or 141 to perform the automatic conversion of the in/out modes of the area and the automatic color conversion between the first and second copies has been pressed or not (step 16). If the automatic conversion mode has been set, the color and in/out modes of the area are converted (step 17). A check is made to see if the copy mode is the continuous copy mode or not (step 18). If it is NO, the apparatus waits until the copy start key is manually pressed (step 20). If it is YES, the copy routine is again executed (step 21).

FIG. 16-4 shows an example when the area was designated and the copy was performed at a variable magnification in the out-mode.

(a) shows an original and a broken line 350 indicates the designated area. When the copy was executed at a variable magnification on the basis of the original standard, as shown in (b), the area is also enlarged or reduced, so that the image is fully copied within the enlarged or reduced area without a lack of image. However, in the case where the copy was carried out at a variable magnification on the basis of the cassette standard, as shown in (c), the area is not enlarged or reduced and only the image is enlarged or reduced, so that there is also a case where a part of image lacks.

The color conversion in the two-sided copy in the continuous copy mode will then be described. Two originals (A4 size or smaller) are set on the original plate. The continuous copy/two-sided copy selection key 133 is pressed. The automatic color switching key 141 is pressed. Thus, the mode to execute the two-sided copy in different colors in the continuous copy mode is set. When the copy start key 151 is pressed in this mode, only the original set on the left side is scanned and copied on the front side of the recording paper. The paper is then loaded onto the middle tray. At this time, the switching device 41 is set to the upper side, so that the recording paper is loaded onto the middle tray with the copied side up. To change the color, the developing device is automatically changed and the next original is scanned. In this state, the blank exposure lamp is lit on during the scanning of the first original and the latent image of the first original is not formed. The recording paper loaded onto the middle tray is fed to the position of the registration roller and sent toward the drum at the timing when the latent image tip of the second original coincides with the head of the recording paper. In the case of forming a binding margin, the timing is advanced or delayed by a time corresponding to the binding margin. The original image on the right side is copied on the back side of the recording paper and the copied paper is then ejected out of the apparatus. In this way, the two-sided copy in which the images were copied in different colors on the front and back sides is obtained.

If the switching device 41 is set to the lower side, the recording paper is loaded onto the middle tray with the copied side down. Thus, the multi-copy in which the image of the left original and the image of the right original were copied in different colors is derived.

On one hand, when the two-sided copy or multi-copy is executed, the area can be designated and copied.

The color conversion can be also performed in the mode other than the continuous copy mode. In the cases of the multi-copy mode and two-sided copy mode, after the first scan, the developing device is automatically exchanged and the apparatus waits for the second scan.

(Operation of the CCD)

Figure 17:
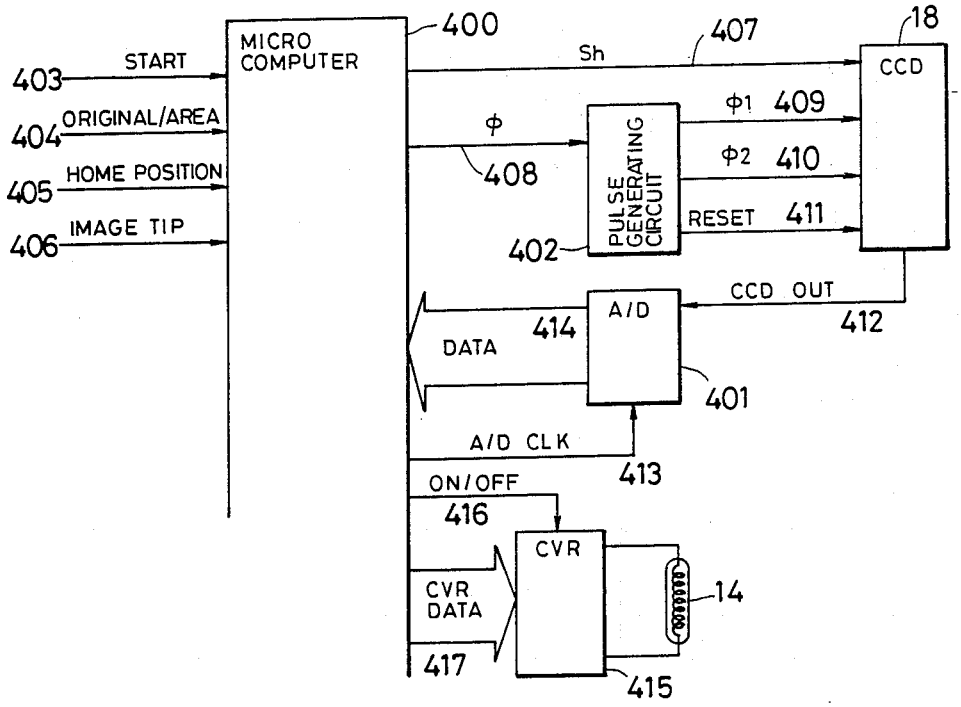
FIG. 17 is a circuit block diagram of an embodiment of invention.

FIG. 17 is a circuit block diagram of the embodiment. Reference numeral 400 denotes a microcomputer for control; 18 is the CCD image sensor; 401 is an A/D converter; and 402 is a CCD drive pulse generating circuit. Numeral 403 denotes a copy start signal from an external circuit; 404 is likewise an original/area mode switching signal from the external circuit; 405 a home position signal from an optical system home position sensor 15; 406 an image tip signal from the image tip sensor 30; 407 a shift pulse signal of the CCD image sensor 18; 408 a reference clock signal $\phi$; 409 a transfer clock signal $\phi_1$ of the sensor 18; 410 likewise a transfer clock signal $\phi_2$; 411 a reset pulse RS of the sensor 18; 412 an output signal CCD OUT of the sensor 18; 413 a clock signal A/D CLK of the A/D converter 401; 414 a digital signal DATA after the A/D conversion of the output of the sensor 18; 14 the original illumination lamp; 415 a lamp light regulation circuit; 416 ON/OFF signal of the lamp; and 417 a light regulation data.

The light regulation circuit 415 applies to the lamp 14 the voltage which proportionally corresponds to the value of the light regulation data 417.

The operation will be simply explained. First, when the copy start signal 403 is supplied to the microcomputer 400 from the outside, the programs to detect the original and recognize the area, which will be explained later, are read out from a ROM (not shown) and started.

First, the microcomputer 400 outputs the reference clock signal $\phi$ 408 and A/D converter lock signal A/D CLK 413 to the pulse generating circuit 402 and A/D converter 401 using a timer function equipped in the microcomputer 400, respectively. The transfer clocks $\phi_1$ 409 and $\phi_2$ 410 and the reset pulse RS 411 are produced from the reference clock signal $\phi$ 408 by the CCD drive pulse generating circuit 402. The output signal CCD OUT 412 of the CCD image sensor 18, which is driven by these clock pulses, is A/D converted by the A/D converter 401. The digital output DATA 414 is read from the input port of the microcomputer 400. The original/area mode switching signal 404, home position signal 405, and image tip signal 406 will be described with reference to flowcharts, which will be explained later.

When the light regulation is needed for the sensor 18, the light regulation circuit 415 lights up the lamp 14 in response to the ON/OFF signal 416 of the lamp. The microcomputer 400 checks the A/D converted value DATA 414 of the output signal of the sensor 18 and changes the light regulation data CVR DATA 417, thereby regulating the light of the lamp 14 so as to obtain the proper brightness. The value of the light regulation data 417 at this time is stored.

Upon AE execution the value of the light regulation data 417 is changed by the AE data, which will be explained later, and the lighting voltage of the lamp 14 is controlled so that the proper exposure is obtained.

Figure 18:
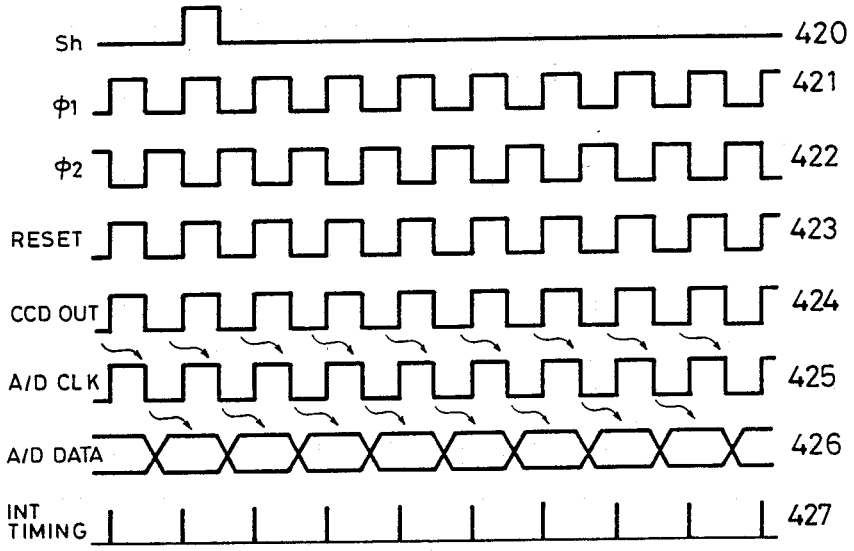
FIG. 18 is a timing chart of control pulses.

FIG. 18 is a timing chart showing the phase relations among a shift pulse sh 420, transfer clocks $\phi_1$ 421, and $\phi_2$ 422, a reset pulse RESET 423, an output signal CCD OUT 424 of the CCD, an A/D converter clock A/D CLK 425, an output DATA 426 of the A/D converter, and an interruption timing 427. The interruption program will be explained later.

Figure 19:
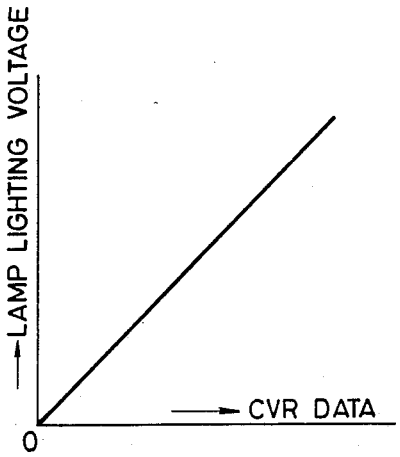
FIG. 19 is a diagram showing the relation between the CVRDATA and the lighting voltage of a lamp.

FIG. 19 is a diagram showing the relation between the CVR DATA and the lighting voltage of the lamp.

Figure 20:
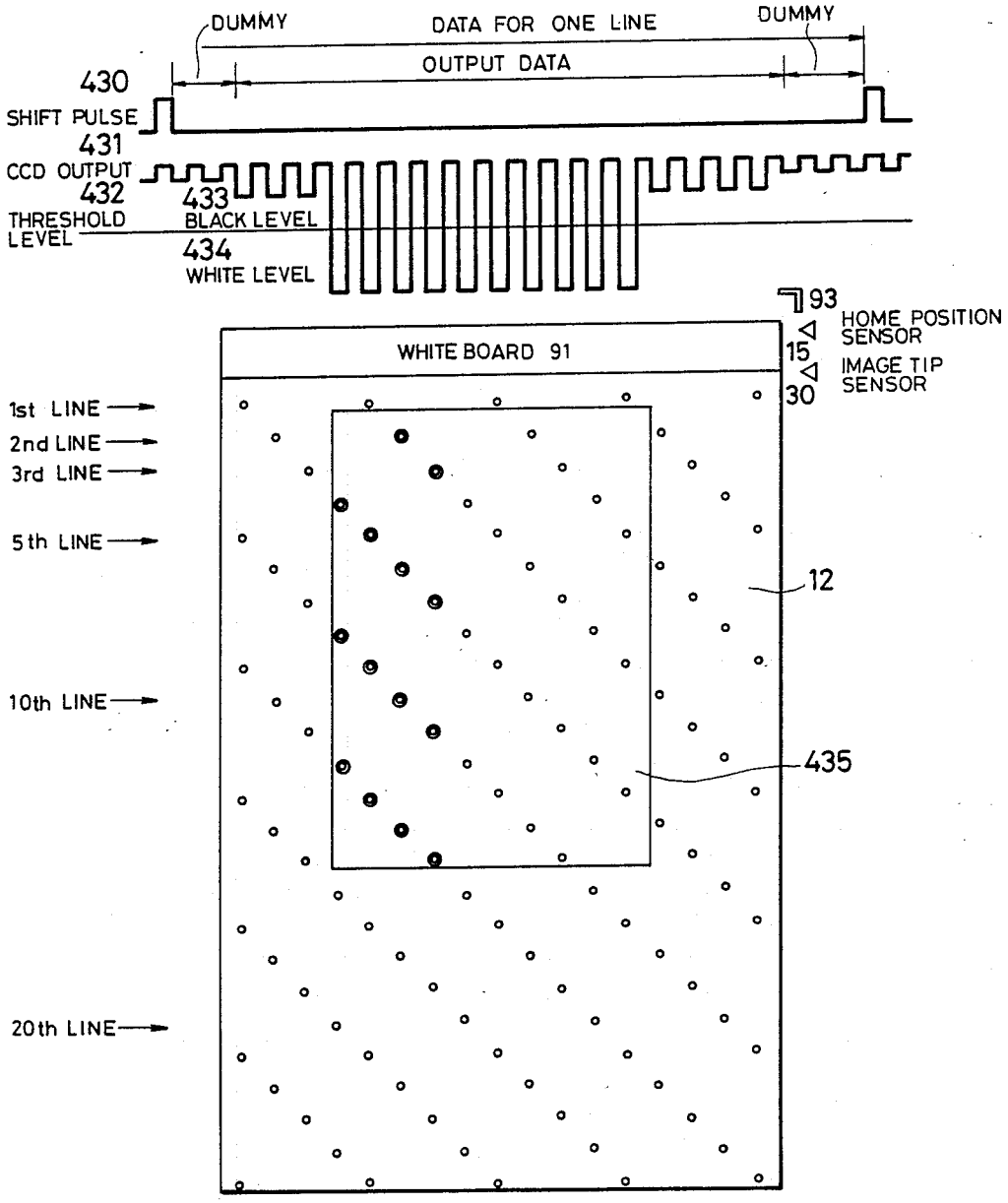
FIG. 20 is a diagram for explaining an original detecting method.

FIG. 20 is a simple principle diagram of the original detecting method. Numeral 430 corresponds to the shift pulse signal sh 407 of the CCD image sensor; 431 corresponds to the output signal CCD OUT of the CCD image sensor; 432 is a threshold level; 91 is a standard white board; 93 an original mounting reference position; 15 is the optical system home position sensor; 30 an image tip sensor; 12 the original plate; 435 an original; and 436 a position where the output of the CCD image sensor is processed by the microcomputer 400.

As shown in the diagram, all of the output data of the CCD image sensor are not processed in each line but processed at regular intervals. This is because no problem will be caused even if the processing speed of the microcomputer 400 is slow. The reason why the processing position is shifted for every line is because it is intended to prevent a deterioration in detection accuracy as possible.

Figure 21:
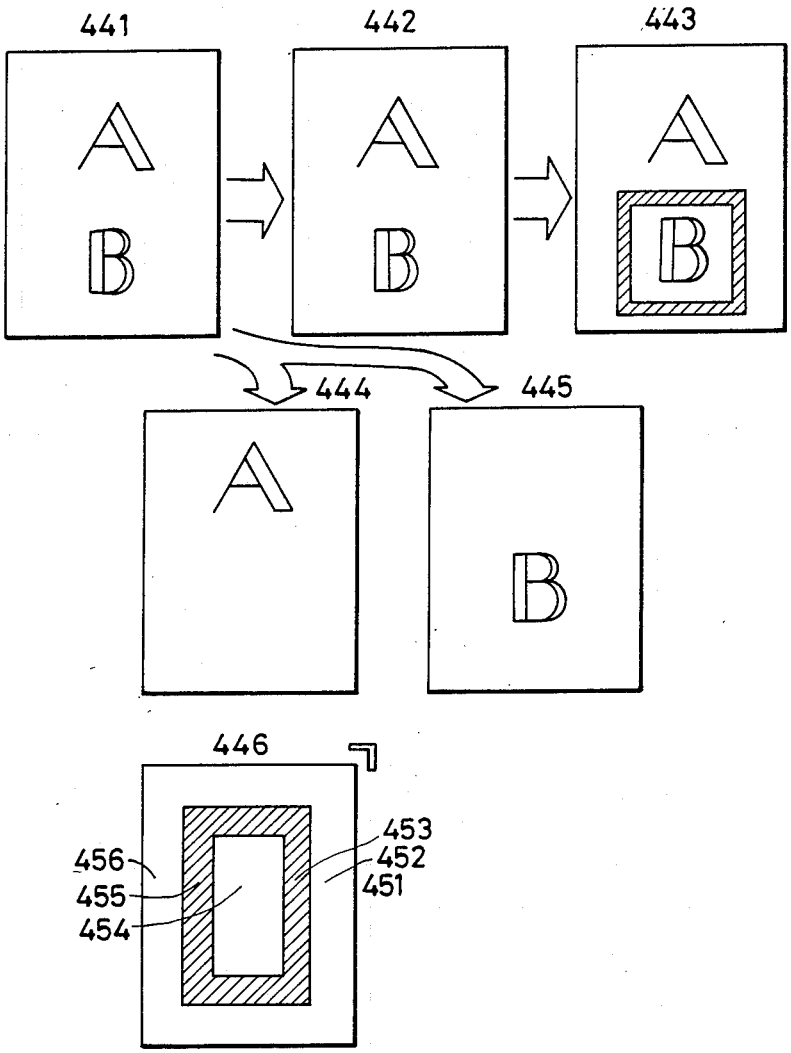
FIG. 21 is a diagram for explaining the designation of areas due to the marking.

FIG. 21 is a conceptional diagram for the area designation by way of the marking. Numeral 441 denotes an original; 442 is a dummy copy which is formed from the original 441 (this dummy copy is used as an original for area recognition by the CCD); 443 shows the dummy copy after the marking; and 444 and 445 are copies obtained.

The procedure will then be described. First, the original 441 is set onto the original plate and the copy operation is executed in the dummy copy mode and the dummy copy 442 in thin color is obtained using the color toner of red or the like. The area to be designated of the dummy copy 442 is marked using a black marking pen or the like as shown at 443. Next, the marked dummy copy is set onto the original plate and the optical system is scanned in the area recognition mode, thereby detecting the marked area. Then, the original 441 is once set onto the original plate and the portion in or out of the area is designated and copied, so that the copy as shown at 444 or 445 can be obtained.

Numeral 446 shows denominations of the respective portions when the marked original is processed in accordance with the programs to detect the original and recognize the area, which will be explained hereinafter, and numerals 451 to 456 are referred to as the first to sixth stages, respectively.

Figure 22:
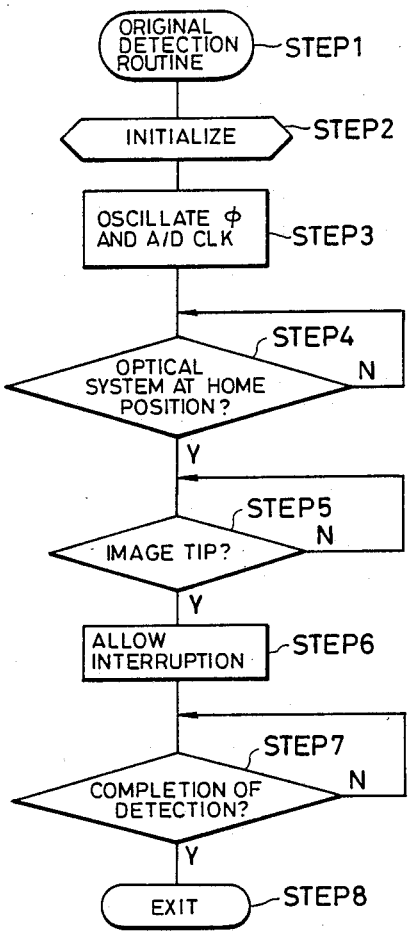
FIGS. 22 to 31 are sequence flowcharts for the detection of an original and recognition of areas, respectively.

FIG. 22 is a main flowchart of the programs for original detection and area recognition. The whole control program is constituted such that these programs are executed when it is necessary to detect the original or recognize the area in the copy sequence flow. The flowchart will now be described with reference to FIG. 22. First, when there occurs necessity of the original detection or area recognition as mentioned above, the program based on the flowchart is executed from step 1. In step 2, various counters (clock counter, line counter) and the like in the RAM are first initialized. Next, the reference clock $\phi$ 408 and clock pulse A/D CLK 413 of the A/D converter are outputted to generate various kinds of pulses to drive the CCD image sensor in step 3. In this embodiment, two clock pulses are oscillated due to the timer function (with the interruption function) built in the microcomputer 400. In the next step 4, the apparatus waits until the optical system home position signal 405 is inputted. When the signal 405 is detected, the apparatus waits until the image tip signal 406 is inputted in step 5. When the image tip signal 406 is detected, the interruption is permitted in step 6. In step 7, the apparatus waits until the flag indicative of the end of detection of the original or area is set. If it is set, this program is ended in step 8 and another program follows.

Figure 23:
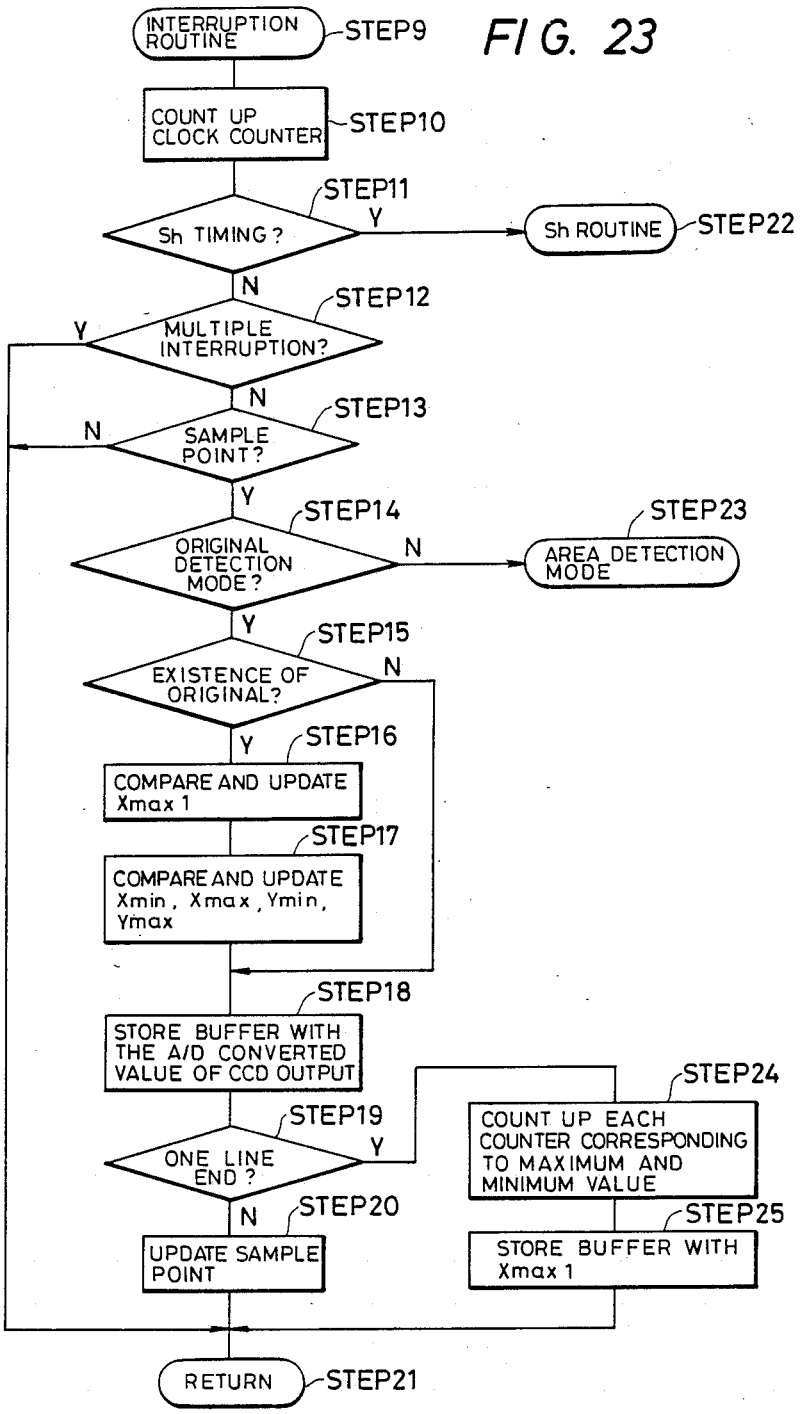

FIG. 23 shows a part of interruption routine of the programs for the original detection and area recognition and is a flowchart which is executed at the timings shown in FIG. 18. When the interruption occurs, this flow starts from step 9. In step 10, the clock counter which counts the number of output data for every series which is time-sequentially outputted from the CCD image sensor is counted up. In step 11, a check is made to see if it comes the timing to output the shift pulse 407 or not from the value of the clock counter. If it is YES, the sh routine as shown in step 22 follows. If it is NO, a check is made from the flag in step 12 to see if the program which is at present being executed is the multiple interruption or not. In the case of the multiple interruption, the interruption program is ended in step 21. If it is NO, in step 13, a check is made to see if it comes the data reading position (timing) or not duelto the comparison between the value of the sample point and the value of the clock counter (i.e., in dependence on whether these values coincide or not). If these values differ, step 21 follows and the interruption program is finished. If they coincide, it is determined that the reading position came, and step 14 follows and the mode is decided by the original/area signal 404. In the case of the area detection mode, as shown in step 23, the routine in the area detection mode is executed. In the case of the original detection mode, step 15 follows and a check is made to see if the original is set at the position on the original plate 12 which is indicated by the current values of the line and clock counters due to the comparison between the A/D converted value of the output of the CCD image sensor and the value of the set threshold level. If no original is set, step 18 follows. If the original has been set, step 16 follows and the value of the clock counter is loaded as $X_{max1}$ into the buffer. This value is updated every time the existence of original is detected in one line. Finally, the value of the clock counter in the case of the data in which it was decided at last that the original existed among the data of the line is all stored for every line.

In the next step 17, the maximum value $X_{max}$ and the minimum value $X_{min}$ among the values of the clock counter and the maximum value $Y_{max}$ and the minimum value $Y_{min}$ among the values of the line counter in all of the lines processed so far when it was determined that the original existed are compared with the current values of the clock and line counters. These values are updated as necessary.

In the next step 18, the A/D converted value of the output of the CCD image sensor is stored into the buffer of one line. In step 19, a check is made from the value of the clock counter to see if the data processes of one line have been completed or not. If it is NO, the sample point which is the collecting position of the AE data is updated in step 20. Then, step 21 follows and the interruption program is ended. If it is YES in step 19, step 24 follows and each AE data counter corresponding to the maximum and minimum values from among the data from the first data when it was determined that the original existed to the last data when it was decided that the original existed among the A/D converted values of the output of the CCD image sensor of one line is counted up. However, when the area for collection of the AE data has been set, the AE data counters only in this area are counted up.

The AE data counters are prepared for all possible values with regard to the maximum and minimum values of each line and their AE data become the data for executing the AE. In the next step 25, the value of $X_{max1}$ is stored into the RAM which is peculiar to the line so that it is not updated by the next line process. Then, step 21 follows and the interruption program is ended.

Figure 24:
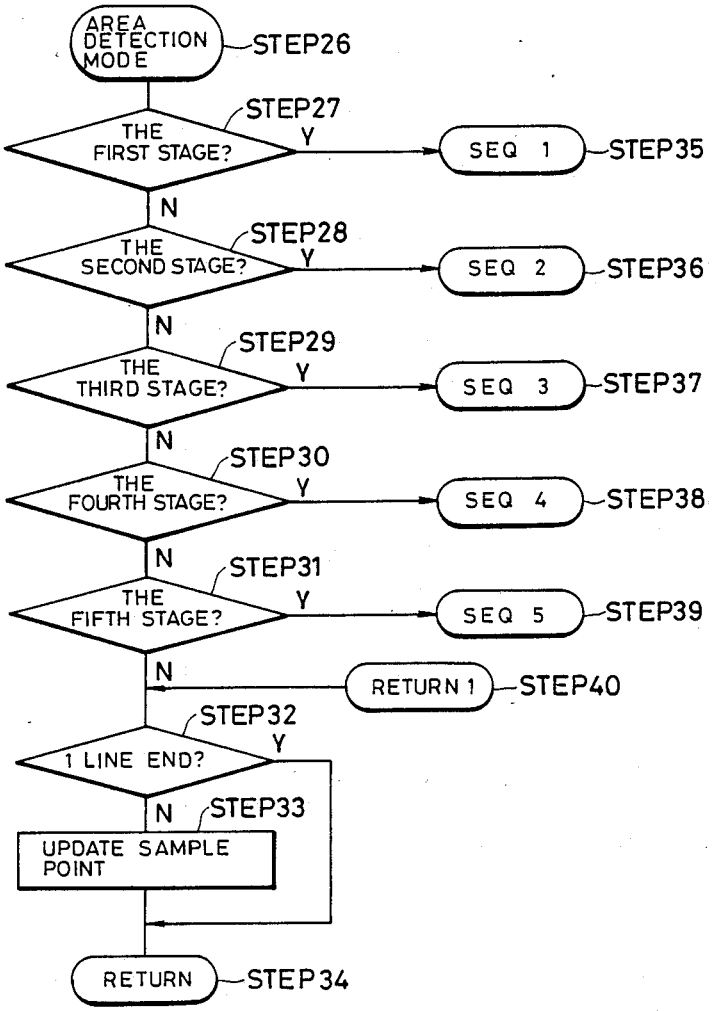

FIG. 24 shows a part of interruption routine of the programs for the original detection and area recognition. If the area detection mode was determined in step 14 in FIG. 23, step 26 in FIG. 24 follows as shown in step 23 in FIG. 23. In step 27, a check is made from the flag to see if the stage is the first stage in FIG. 21 or not. In the case of the first stage, the $SEQ_1$ routine follows as shown in step 35. In a manner similar to the above, each check is made to see if the stage is the second, third, fourth, and fifth stages in FIG. 21 or not from the flags in steps 28 to 31. If they are YES, respectively, the $SEQ_2$, $SEQ_3$, $SEQ_4$, and $SEQ_5$ routines follow as shown in steps 36 to 39. If they are NO, step 32 follows.

In step 32, a check is made to see if the data process of one line has been completed or not by the value of the clock counter. If it is YES, step 34 follows and the interruption program is ended. If it is NO, the sample point is updated in step 33 and then step 34 follows and the interruption program is finished.

Figure 25:
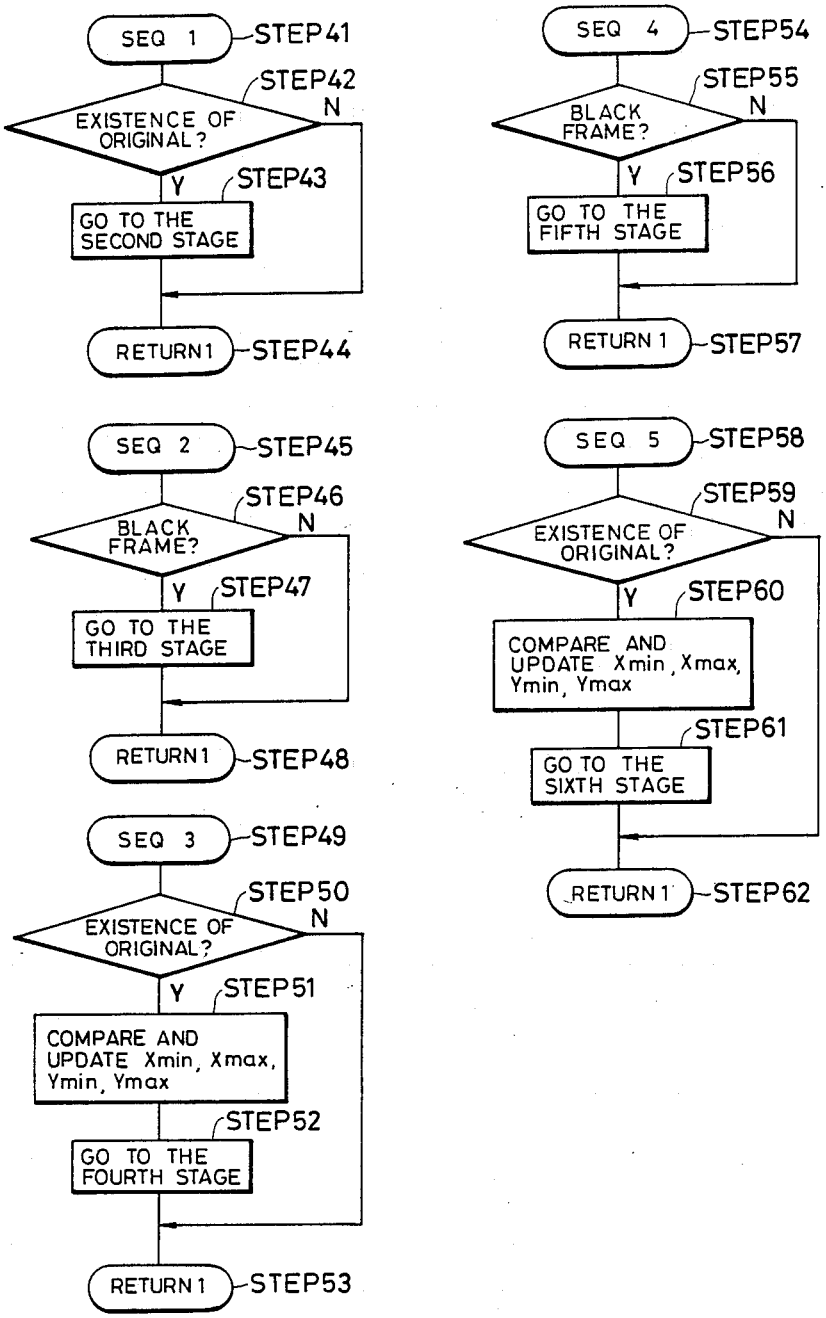

FIG. 25 shows a part of the interruption routine of the programs for the original detection and area recognition. After steps 27, 28 29, 30, and 31 in FIG. 24, steps 41, 45, 49, 54, and 58 in FIG. 25 are executed, respectively.

When the processing routine advances to step 41, the A/D converted value of the output of the CCD image sensor is compared with the value of the set threshold level in step 42 and a check is made to see if the original has been set at the position on the original plate 12 which is indicated by the current values of the line and clock counters. If no original exists, step 44 follows and step 40 in FIG. 24 is executed. If the original existed, the flag is set to the second stag in step 43. And after step 44, step 40 in FIG. 24 is executed.

When the processing routine advances to step 45, the A/D converted value of the output of the CCD image sensor is then compared with the value of the set threshold level and a check is made to see if the level indicates the black frame level or not in step 46. If it is NO, step 40 in FIG. 24 is executed through step 48. If it is the black frame level, the flag is set to the third stage in step 47 and step 40 in FIG. 24 is then executed through step 48.

When the processing routine advances to step 49, a check is similarly made to see if the original has been set or not in step 50. If no original exists, step 53 follows and step 40 in FIG. 24 is then executed. If the original existed, step 50 follows and the values of $X_{min}$, $X_{max}$, $Y_{min}$, and $Y_{max}$ are compared with the current values of the line and clock counters and updated. In the next step 52, the flag is set to the fourth stage and step 53 follows and step 40 in FIG. 24 is then executed.

When the processing routine advances to step 54, a check is made to see if the level is the black frame level or not in step 55 in a manner similar to the above. If it is NO, step 57 follows and step 40 in FIG. 24 is executed. If it is the black frame level, the flag is set to the fifth stage in step 56 and step 40 in FIG. 24 is then executed through step 57.

When the processing routine advances to step 58, a check is made to see if the original has been set or not in step 59 in a manner similar to the above. If no original is set, step 40 in FIG. 24 is executed through step 62. If the original existed, the values of $X_{min}$, $X_{max}$, $Y_{min}$, and $Y_{max}$ are compared with the current values of the line and clock counters and updated in step 60. In the next step 61, the flag is set to the sixth stage and then step 40 in FIG. 24 is executed through step 62.

Figure 26:
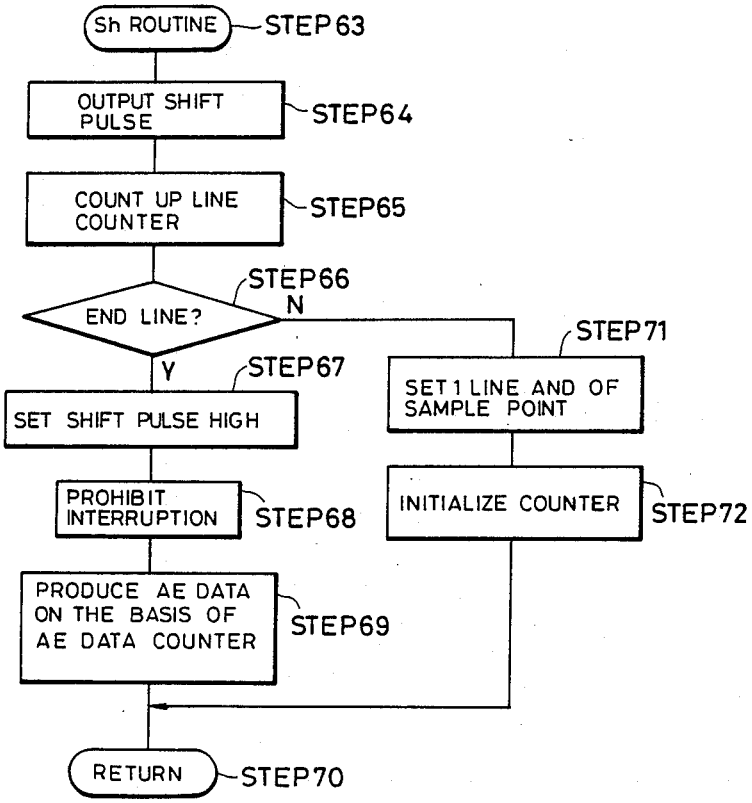

FIG. 26 shows a part of the interruption routine of the programs for the original detection and area recognition. When it is determined that it came the timing to output the shift pulse (407) in step 11 in FIG. 23, step 63 in FIG. 26 follows as shown in step 22 in FIG. 23. In the next step 64, the shift pulse 407 is outputted at the timing as shown in FIG. 18. The line counter is counted up in step 65. Then, a check is made to see if the last line to be processed has been completed or not in step 66 on the basis of the value of the line counter. If it is YES, step 67 follows and the output level of the shift pulse 407 is fixed to a high level. The interruption is inhibited in step 68. The AE data is produced in step 69. Then step 70 follows and the interruption program is ended. If it is NO in step 66, step 70 follows and the sample point and the value of one line end are set. The counters and the like are initialized in step 71. Then, step 72 follows and the interruption program is ended.

Figure 27:
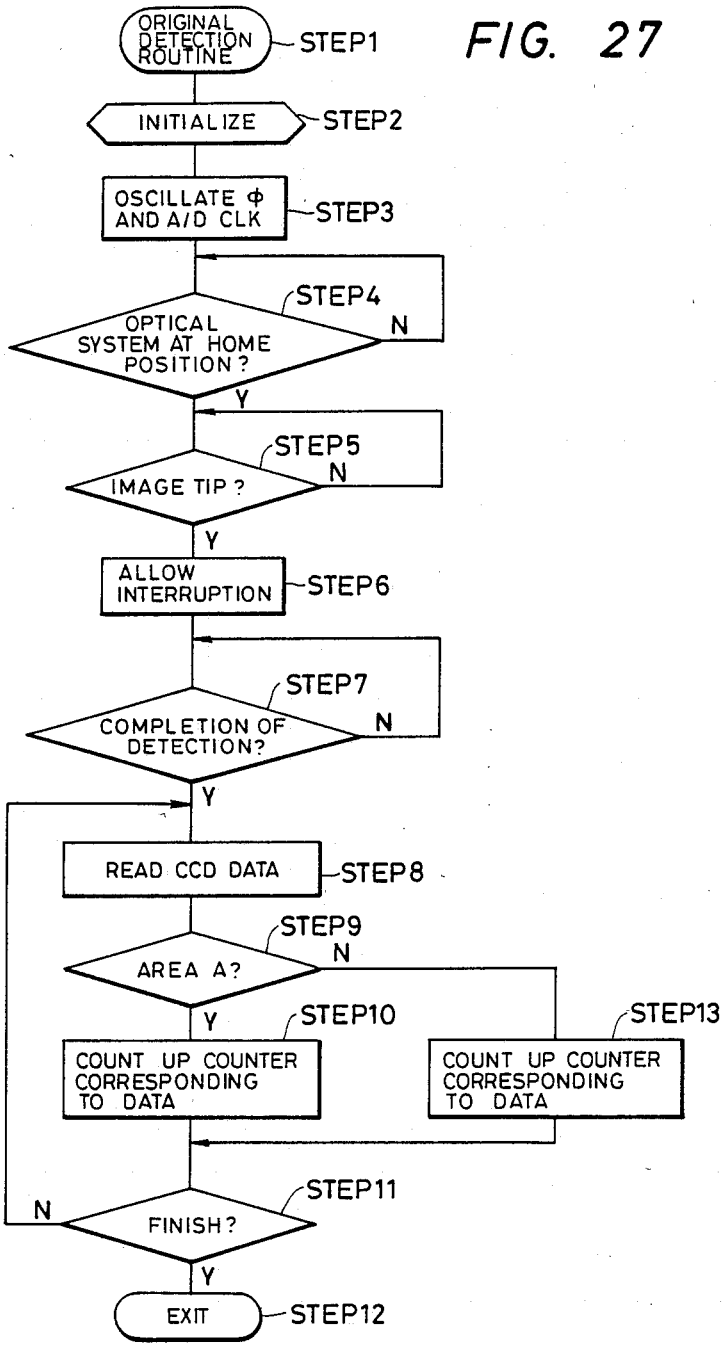

FIG. 27 is a main flowchart of the programs for the original detection and area recognition when a page memory was used. The whole control program is constituted such that when there occurs necessity of original detection or area recognition in the copy sequence flow, this program is executed. The flowchart will then be explained with reference to FIG. 27. First, as mentioned above, when a necessity of the original detection or area recognition occurs, the program based on the flowchart is executed after step 1. In step 2, various counters (clock counter, line counter) and the like in the RAM are first initialized. In the next step 3, the reference clock $\phi$ 408 and the clock pulse A/D CLK 413 of the A/D converter are outputted to generate various pulses to drive the CCD image sensor. In this embodiment, two clock pulses are oscillated due to the timer function (with the interruption function) provided in the microcomputer 400. Then, the apparatus waits until the optical system home position signal 405 is inputted in step 4. If the signal 405 was detected, the apparatus then waits until the image tip signal 406 is inputted in step 5. If the signal 405 was detected, the interruption is permitted in step 6. The apparatus waits until the flag indicative of the end of original or area detection is set in step 7. If the flag was set, the CCD output data in the page memory is sequentially read out in step 8. A check is made to see if the area A (FIG. 21) has been set or not in step 9. If it is YES, the AE data counter corresponding to the data in the area A is counted up in step 10. If it is NO, the AE data counter corresponding to the data in the area B (FIG. 21) is counted up in step 13. Steps 8 to 11 are repeated until the processes regarding all of the data are finished in step 11. If the processes of all of the data have been completed, step 12 follows and this program is ended.

Figure 28:
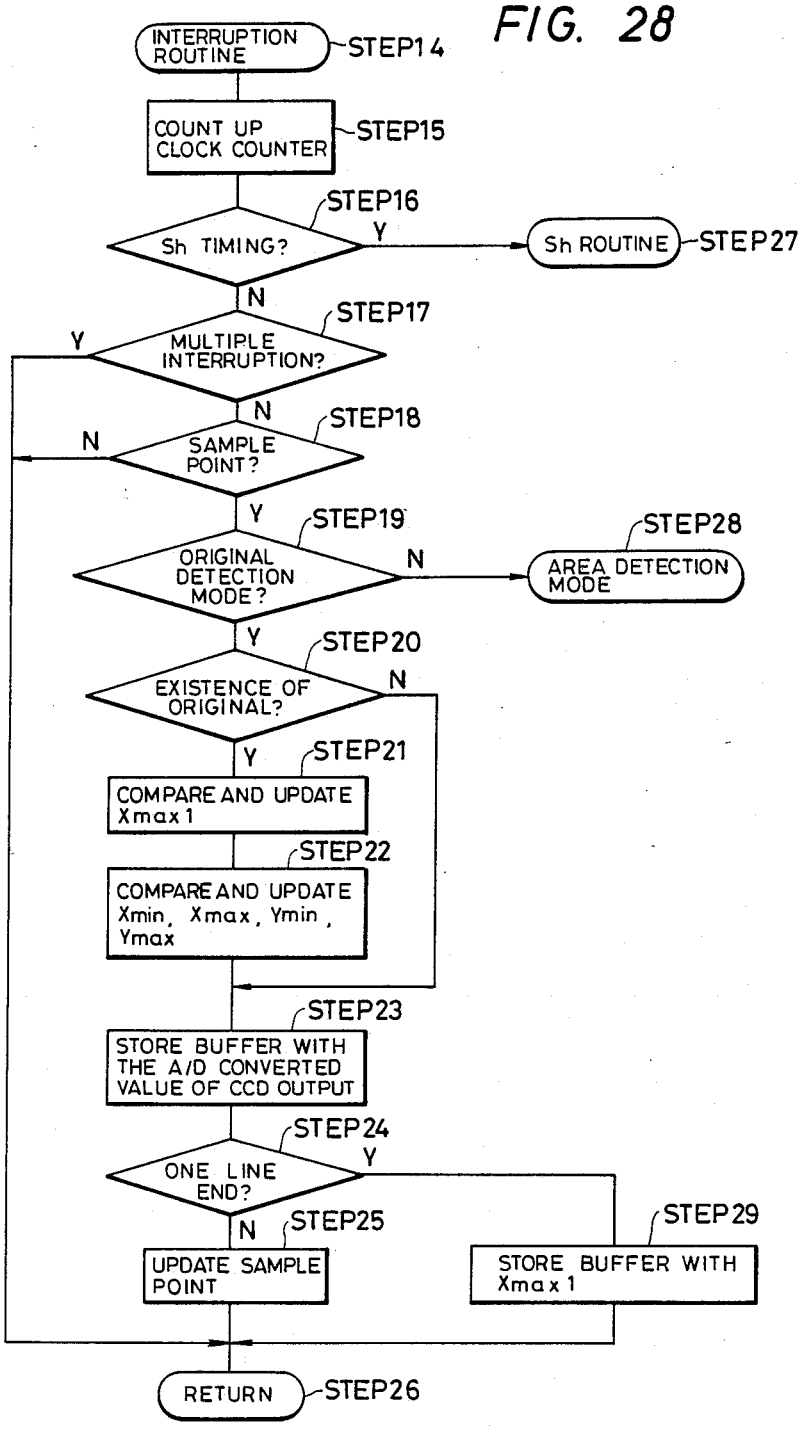

FIG. 28 shows a part of the interruption routine of the programs for the original detection and area recognition and is a flow which is executed at the timings as shown in FIG. 18. When the interruption occurs, this flow is started from step 14. The clock counter which counts the number for every series of the output data which is time-sequentially outputted from the CCD image sensor is counted up in step 15. A check is made in step 16 to see if it comes the timing to output the shift pulse 407 from the value of the clock counter. If it came the timing, the sh routine is executed as shown in step 27. If it is NO, a check is made by the flag to see if the program which is at present being executed is the multiple interruption or not in step 17. In the case of the multiple interruption, step 26 follows and the interruption program is ended. If it is NO, step 18 follows and a check is made to see if it comes the data reading position or not by comparing the value of the sample point with the value of the clock counter. If these values differ, step 26 follows and the interruption program is ended. If they coincide, it is determined that the reading position came and step 19 follows to determine the mode by the original/area mode switching signal 404. If it is the area detection mode, the routine of the area detection mode is executed as shown in step 28. If it is the original detection mode, step 20 follows and the A/D converted value of the output of the CCD image sensor is compared with the value of the set threshold level, thereby detecting whether the original has been set at the position on the original plate 12 which is indicated by the current values of the line and clock counters or not. If no original is set, step 23 follows. If the original existed, step 21 follows. The value of the clock counter is stored as $X_{max1}$ into the buffer in step 21. This value is updated each time the existence of the original was detected in one line. The value of the clock counter in the case of the data in which it was finally determined that the original existed among the data of the line is finally all stored for every line.

In the next step 22, the maximum value $X_{max}$ and the minimum value $X_{min}$ among the values of the clock counter and the maximum value $Y_{max}$ and the minimum value $Y_{min}$ among the values of the line counter when it was determined that the original existed in all of the lines processed so far are compared with the current values of the clock and line counters. These values are updated as necessary.

In the next step 23, the A/D converted value of the output of the CCD image sensor is stored into the buffer of one page. A check is made by the value of the clock counter to see if the data processes of one line have been completed or not in step 24. If it is NO, the sample point is updated in step 25 and step 26 then follows and the interruption program is ended. If it is YES, the value of $X_{max1}$ which is the last data when it was determined that the original existed among the A/D converted values of the output of the CCD image sensor of one line is stored into the RAM which is peculiar to this line in step 29 such that it is not updated by the next line process. Then step 26 follows and the interruption program is ended.

Figure 29:
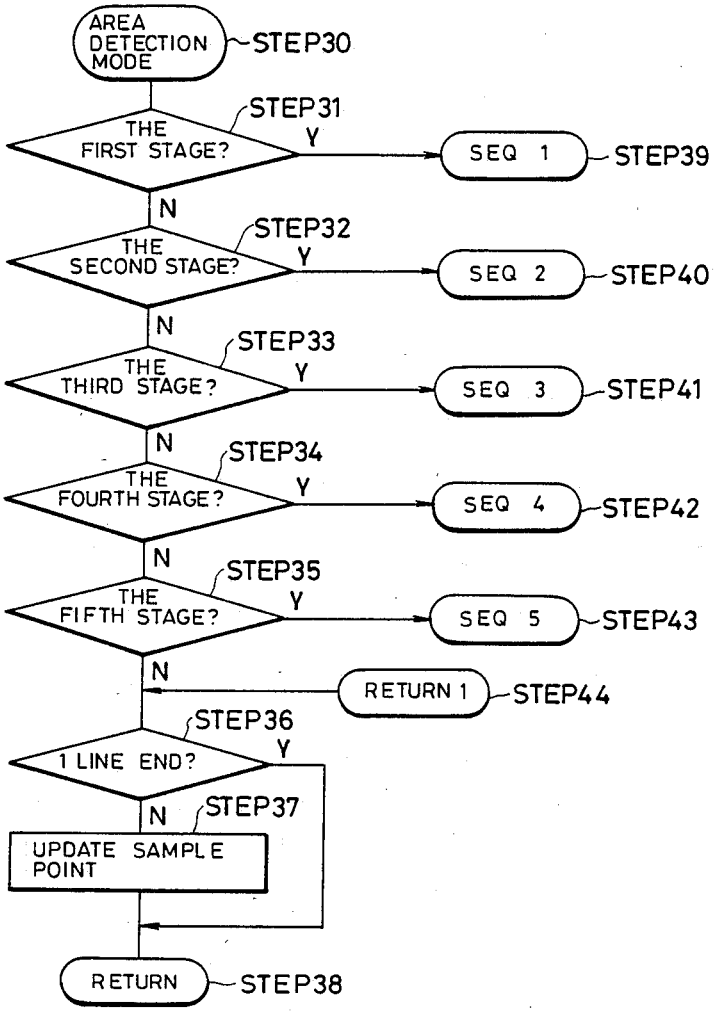

FIG. 29 shows a part of the interruption routine of the programs for the original detection and area recognition. In the case of the area detection mode in step 19 in FIG. 28, step 30 in FIG. 29 is executed as shown in step 28 in FIG. 28. In step 31, a check is made to see if the first stage in FIG. 29 has been set or not from the flag. In the case of the first stage, the $SEQ_1$ routine is executed as shown in step 39. In a manner similar to the above, checks are made by the flags to see if the second, third, fourth, and fifth stages in FIG. 29 have been set or not in steps 32 to 35, respectively. If they are YES, the $SEQ_2$, $SEQ_3$, $SEQ_4$, and $SEQ_5$ routines are executed as shown in steps 40 to 43, respectively. If they are NO, step 36 follows.

In step 36, a check is made by the value of the clock counter to see if the data processes of one line have been finished or not. If it is YES, step 38 follows and the interruption program is finished. If it is NO, the sample point is updated in step 37 and then step 38 follows and the interruption program is finished.

Figure 30:
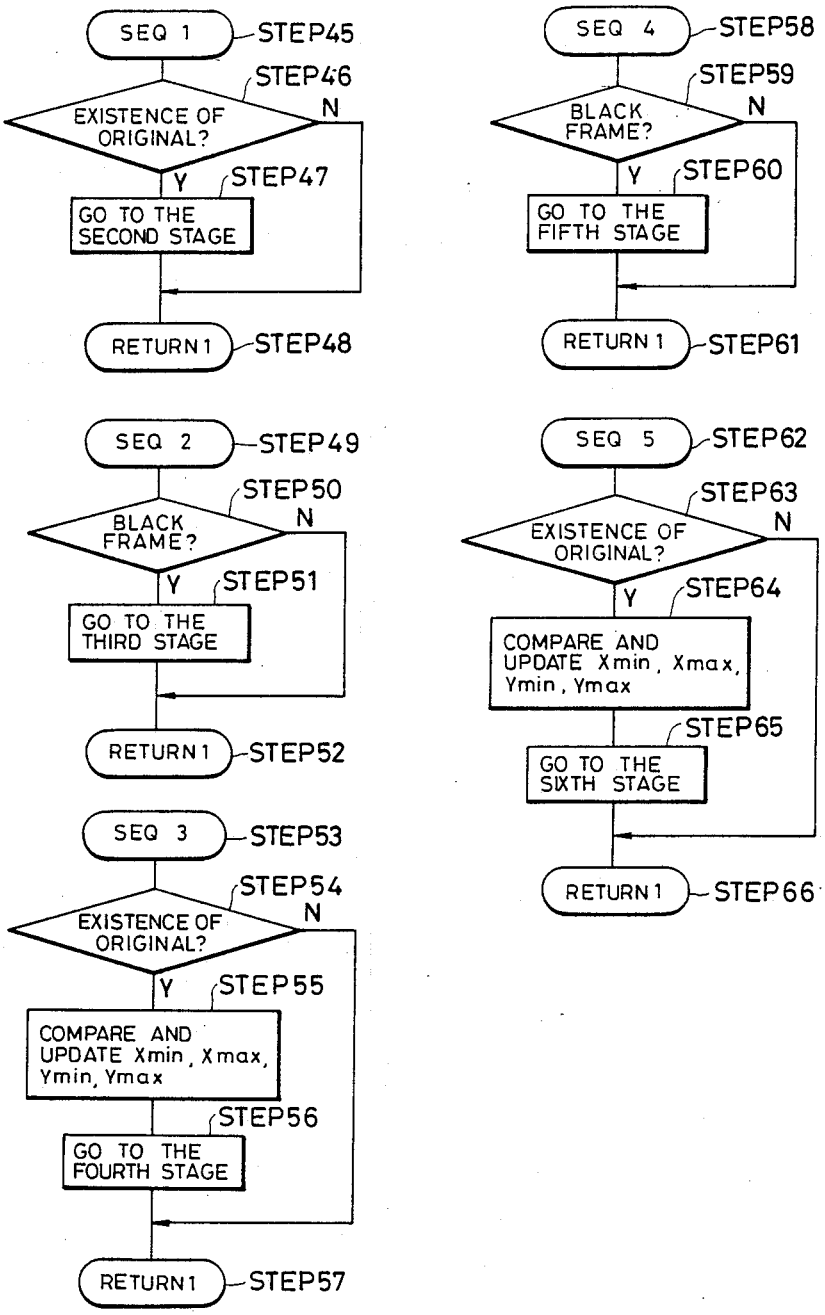

FIG. 30 shows a part of the interruption routine of the programs for the original detection and area recognition. After steps 39, 40, 41, 42 and 43 in FIG. 29, steps 45, 49, 53, 58, and 62 in FIG. 30 are executed.

When the processing routine advances to step 45, the A/D converted value of the output of the CCD image sensor is then compared with the value of the set threshold level and a check is made to see if the original has been set at the position on the original plate 12 which is indicated by the current values of the line and clock counters or not in step 46. If no original is set, step 48 follows and then step 44 in FIG. 29 is executed. If the original existed, the flag is set to the second stage in step 47 and then step 48 follows and step 44 in FIG. 29 is executed.

When the processing routine advances to step 49, the A/D converted value of the output of the CCD image sensor is then compared with the value of the set threshold level and a check is made to see if the level is the black frame level or not in step 50. If it is NO, step 44 in FIG. 29 is executed after step 52. If it is the black frame level, the flag is set to the third stage in step 51. Then step 52 follows and step 44 in FIG. 29 is executed.

When the processing routine advances to step 53, the existence of the original is similarly discriminated in step 54. If no original is set, step 57 follows and then step 44 in FIG. 29 is executed. If the original existed, the values of $X_{min}$, $X_{max}$, $Y_{min}$, and $Y_{max}$ are compared with the current values of the line and clock counters and updated in step 55. In the next step 56, the flag is set to the fourth stage and step 44 in FIG. 29 is executed through step 57.

When the processing routine advances to step 58, a check is made to see if the level is the black frame level or not in step 59 in a manner similar to the above. If it is NO, step 44 in FIG. 29 is executed from step 61. If it is YES, the flag is set to the fifth stage in step 60 and then step 44 in FIG. 29 is executed through step 61.

When the processing routine advances to step 62, and the presence or absence of the original is similarly discriminated in step 63. If no original is set, step 66 follows and then step 44 in FIG. 29 is executed. If the original existed, the values of $X_{min}$, $X_{max}$, $Y_{min}$, and $Y_{max}$ are then compared with the current values of the line and clock counters and updated in step 64. The flag is set to the sixth stage in step 65 and then step 44 in FIG. 29 is executed through step 66.

Figure 31:
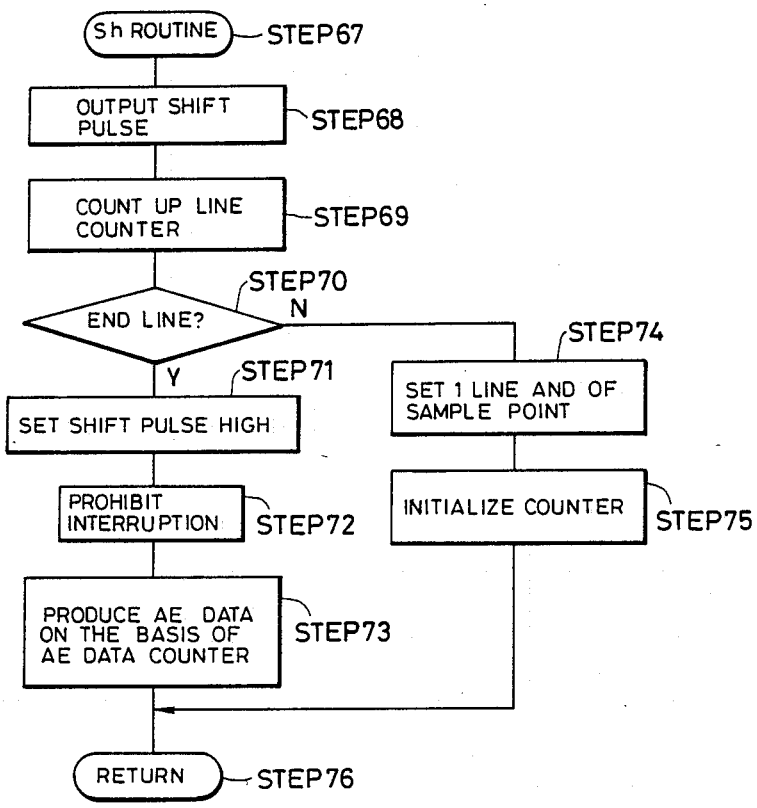

FIG. 31 shows a part of the interruption routine of the programs for the original detection and area recognition. If it was determined in step 16 in FIG. 28 that it came the timing to output the shift pulse 407, step 67 in FIG. 31 is executed as shown in step 27 in FIG. 28. The shift pulse 407 is outputted at the timing as shown in FIG. 18 in step 68. The line counter is counted up in step 69. A check is then made by the value of the line counter to see if the data process of the last line to be processed has been completed or not in step 70. If it is YES, step 74 follows and the output level of the shift pulse 407 is fixed to high. The interruption is inhibited in step 72. The AE data is produced in step 73. The interruption program is then ended through step 76. If it is NO in step 70, step 74 follows and the sample point and the value of the one line end are set. The counters and the like are initialized in step 75 and the interruption program is finished through step 76.

Figure 32:
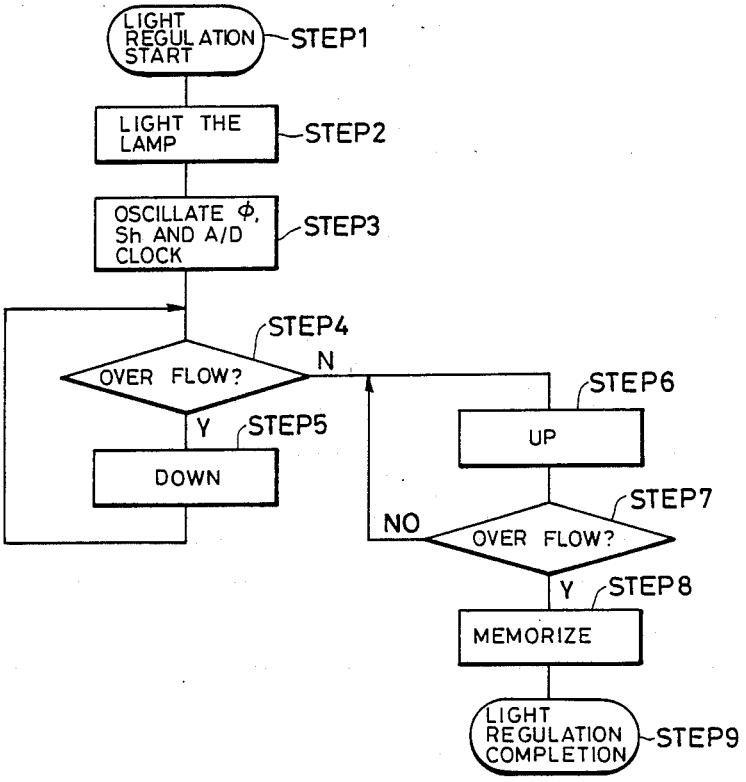
FIG. 32 is a sequence flowchart for the light regulation.

FIG. 32 shows a flowchart of the light regulation program. If the light regulation for the CCD image sensor is needed in the sequence, the program based on this flowchart is executed. After step 1, the lamp is first lit up by the ON/OFF signal of the lamp in step 2. The light regulation data at this time has a predetermined value. In the next step 3, the reference clock $\phi$ 408, A/D converter clock A/D CLK 413, and shift pulse sh 407 are outputted and the CCD image sensor is driven. Then, a check is made in step 4 to see if the value of the digital signal DATA 414 after the A/D conversion of the output of the CCD image sensor has overflowed or not. If it has overflowed, the light regulation data 417 is counted down by only one in step 5 and the processing routine is returned to step 4. This loop is continued until the value of the DATA 414 doesn't overflow. If it is NO in step 4, the light regulation data 417 is counted up in step 6. In the next step 7, the overflow is checked and the processing routine is returned to step 6 when no overflow occurs This loop is continued until the overflow occurs. When the overflow occurs, the light regulation data is stored in step 8 and the light regulation program is ended in step 9.

Figure 33:
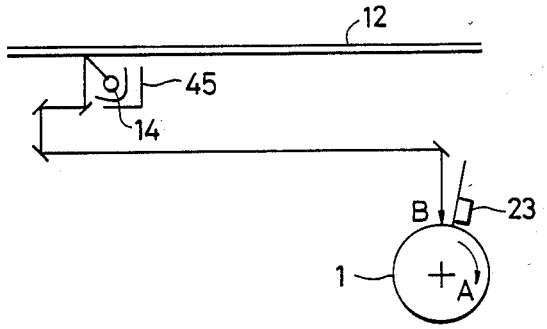
FIG. 33 is a view showing the relationship of a movable optical system and a photosensitive drum.
Figure 34:
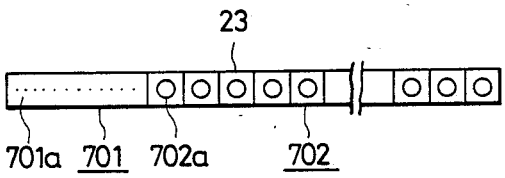
FIG. 34 is a view showing the details of a blank exposure unit.

Now there will be given an explanation on the process of writing characters on a copy sheet while making reference to the attached drawings. In FIG. 33, a photosensitive drum 1 is rotated in a direction A. There are also provided an original glass 12, a movable optical system or scanner 45 movable in the lateral direction, an original illuminating lamp 14 movable with said optical system 45 and emitting light as indicated by an arrow B, and a blank exposure unit 23 constituting erasure means. FIG. 34 illustrates the blank exposure unit 23, in which small LED's 701*a* are arranged with a high density, for example in the order of 4 dots/mm, along the axial direction of the photosensitive drum 1 to constitute an array 701. On said array there is provided an unrepresented celfoc lens array for focusing the light from LED's 701 onto the photosensitive drum. Also relatively large LED's 702*a* are arranged, for example with a pitch of 2.5 mm, along the axial direction of the photosensitive drum 1, and will be hereinafter called blank LED array 702.

Figure 35:
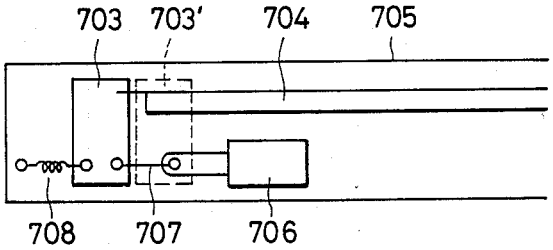
FIG. 35 is a schematic view of a slit device.

In FIG. 35 there are shown a slit device 705 provided in the movable optical system 45, a slit 704, a shield member 703, a spring 708 connecting the slit device 705 with the shield member 703, and a solenoid 706 linked with the shield member 703 through a rod 707. When the solenoid 706 is energized, the shield member 703 is moved to a broken-lined position 703' to shield a part of the slit 704, thereby intercepting a part of the light illuminating the original. On the other hand, when the solenoid 706 is deactivated, the shield member 703 returns to the illustrated full-linked position by means of the spring 708, thus allowing full illumination of the original.

Figure 36:
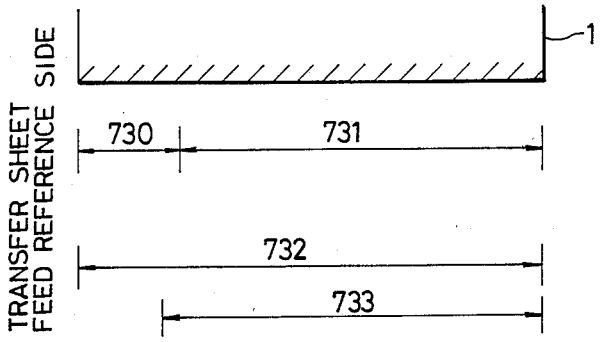
FIG. 36 is a view for showing an irradiation area on a photosensitive drum.

FIG. 36 shows the illumination areas by the blank LED array and the LED array on the drum 1. There are shown an area 730 to be illuminated by the LED array 701, an area 731 to be illuminated by the blank LED array 23, and area 732 of illumination of the original when the above-mentioned solenoid 706 is not energized, and an area 733 of illumination of the original when said solenoid 706 is energized. The area 730 and 731, or 730 and 733, are so selected as to mutually slightly overlap. The black triangle mark indicates a reference side for the feeding of transfer sheet, and a sheet end is aligned with said mark for sheet feeding, regardless of the sheet size. Thus, by placing the LED array 701 at said reference side, the writing operation of character or the like can be achieved regardless of the sheet size or magnification of transferred image. Independently from the image exposure, there ca be formed a white latent image in the area 730 by lighting all the LED array 701, or in the area 731 by lighting all the blank LED array 702. On the other hand, at the original exposure, a latent image corresponding to the original is formed in the entire area 732 if the solenoid 706 is deactivated and the LED array 701 and the blank LED array 702 are all turned off. Also a latent image of the original is formed in the area 733 if the solenoid 706 is energized and the blank LED array 702 is turned off. The area 730 does not receive the light from the original, and a latent image of a desired pattern such as characters can be formed by selectively lighting the LED array 701 in synchronization with the process speed. The pattern writing by selective lighting of the LED array 701 is called a writing mode.

Figure 37:
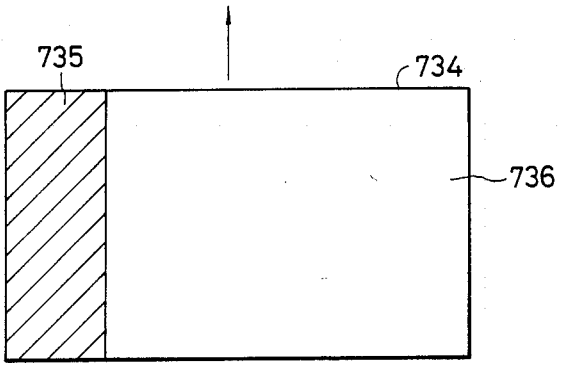
FIG. 37 is a view showing a state in which a pattern such as characters is formed on a transfer sheet.
Figure 38:
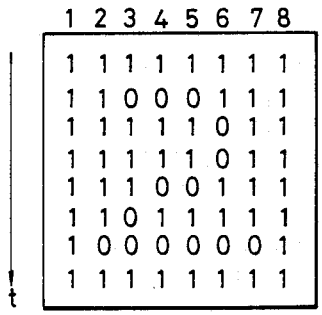
FIG. 38 is a view showing an example of lighting of an LED array.
Figure 39:
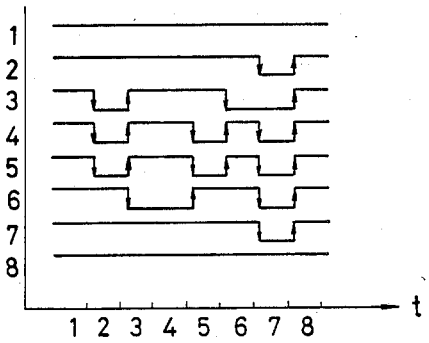
FIG. 39 is a timing chart showing the function of the LED array.

FIG. 37 shows a copy (transfer) sheet after the image transfer with a pattern such as characters. The transfer sheet 734 proceeds in a direction indicated by an arrow, and bears a desired pattern in an area 735 and a copied original image in an area 736. FIG. 38 shows an example of lighting of the LED array 701, shown in an $8\times8$ matrix for the purpose of simplicity, wherein "1" and "0" respectively indicate that a small LED is turned on or off. Numbers from 1 to 8 represent respective LED's in the LED array 701, and arrow indicates time. FIG. 39 is a timing chart of the pattern forming operation.

In this example a numeral "2" is written. It can be written in various rotational angles, by employing patterns obtained by rotating the pattern shown in FIG. 38.

Figure 40:
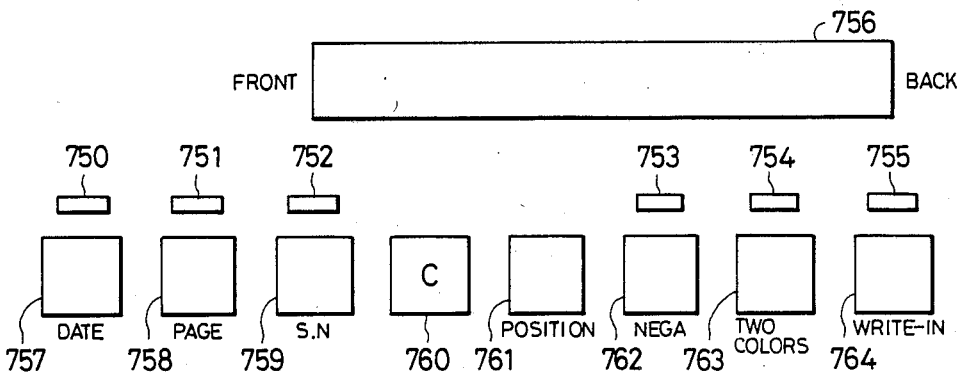
FIG. 40 is a view of an example of the operation section of copying apparatus.

FIG. 40 shows an operating section for executing the writing operation by the LED array 701. Said operating section may be incorporated in the operating section shown in FIG. 10. There are provided LED display elements 750–755; a dot-matrix liquid crystal display (LCD) 756; and key switches 757–764. The keys 757, 758 and 759 are mode designation keys for selecting data to be written. Depression of the key 757 turns on the LED 750 and enables data writing. Depression of the key 758 turns on the LED 751 and enables page number writing. Also depression of the key 759 turns on the LED 752 and enables writing of serial numbers.

Figure 41:
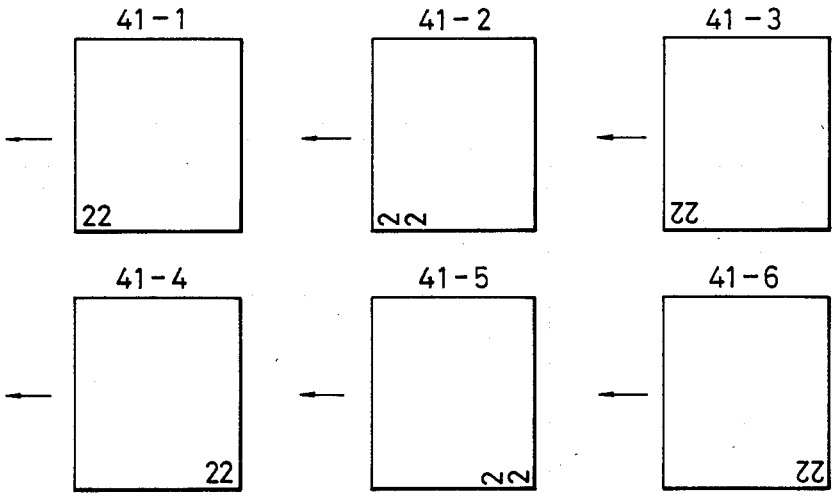
FIG. 41 is a view showing the position and direction of pattern writing on a transfer sheet.

The key 760 is used for setting a number "1" in the mode of writing page numbers or serial numbers. The key 761 designates the position and direction of character writing, as shown in FIG. 41, wherein states 41-1 to 41-6 are enabled in succession by repeated depressions. Consequently the characters can be written in a desired end portion, by suitably changing the direction of the original. Depression of the key 762 turns on the LED 753 and enables negative character writing.

For example a white numeral "2" in black background can be obtained by inverting "1" and "0" in the lighting pattern shown in FIG. 38. The key 763 is depressed in case of using different colors for the original image and for the characters to be written, and the LED 754 is turned on upon depression. The key 764 is depressed when designating the writing mode, and the LED 755 is turned on upon depression. A repeated depression of said key turns off the LED 755 and cancels the writing mode. The LCD 756 displays the data to be written, for example a date in the date mode, in position and direction corresponding to those designated by the key 761.

Figure 42:
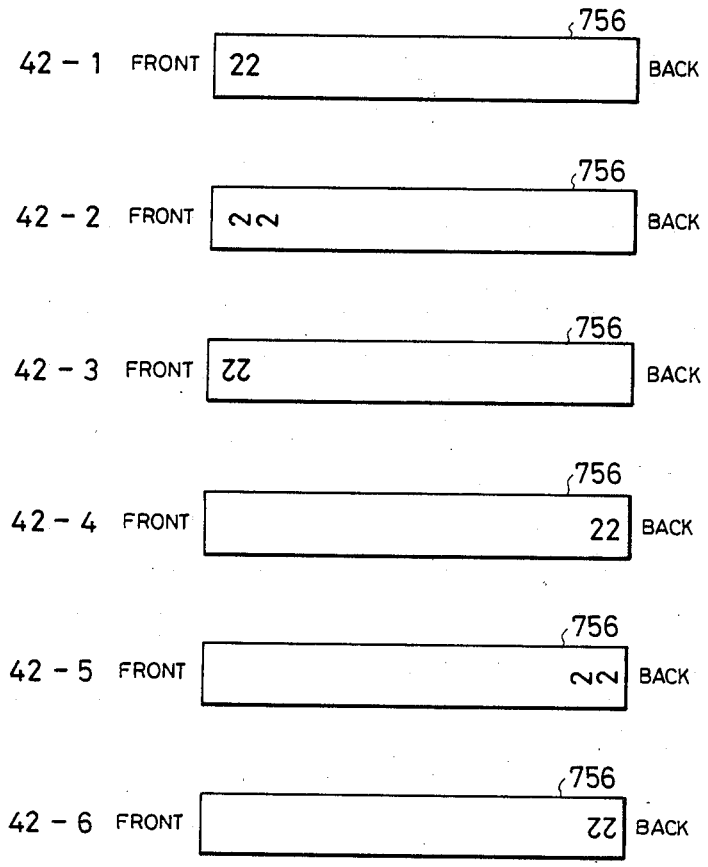
FIG. 42 is a view showing display modes of an LCD device.

FIG. 42 shows the mode of display, wherein 42-1 to 42-6 respectively correspond to the writing positions 41-1 to 41-6 shown in FIG. 41.

Figure 43:
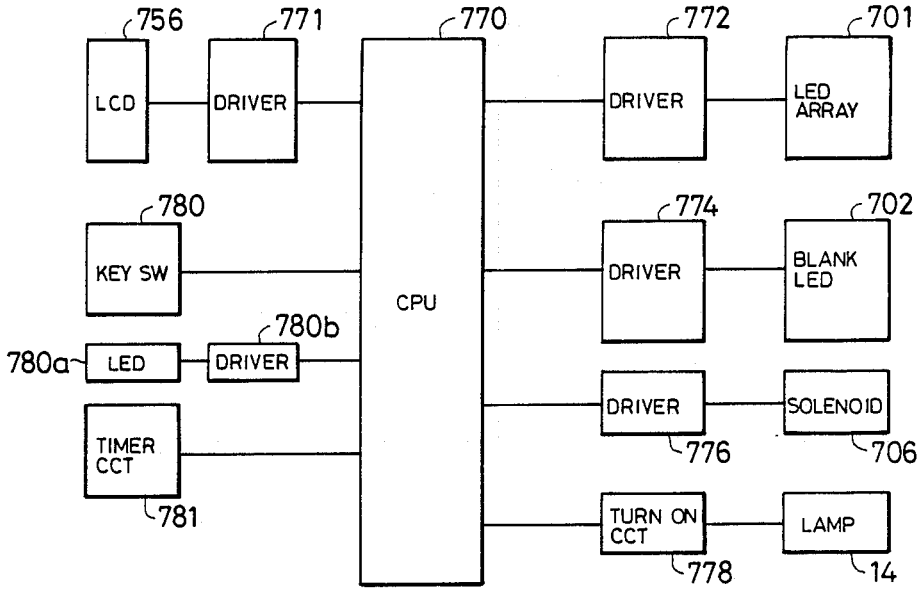
FIG. 43 is a block diagram of a control circuit for pattern writing in the present embodiment.

FIG. 43 shows an example of a control circuit for character/pattern writing in the present embodiment, wherein provided are a central processing unit (CPU) 770 composed of a microprocessor; an LCD driver 771 connected to said CPU 770; an LCD 756 explained before, key switches 780 corresponding to those 757–764 explained before; an LED driver **780*b*; LED's 780*a* corresponding to those 750–755 explained before; a timer circuit 781 having a function as a clock; a driving circuit 772 for driving the LED array 701 and capable of selectively driving each of the small LED's; and a driving circuit 774 for driving the blank LED array 702 of which LED's can be arbitrarily turned on under the control by the CPU 770**.

There are further shown a solenoid driving circuit 776; a solenoid 706 explained before; and a lamp turn-on circuit 778 for lighting the lamp 14. The solenoid 706 and the lamp 14 are turned on and off under the control by the CPU.

In the following there will be explained a mode not involving character writing.

Figure 44:
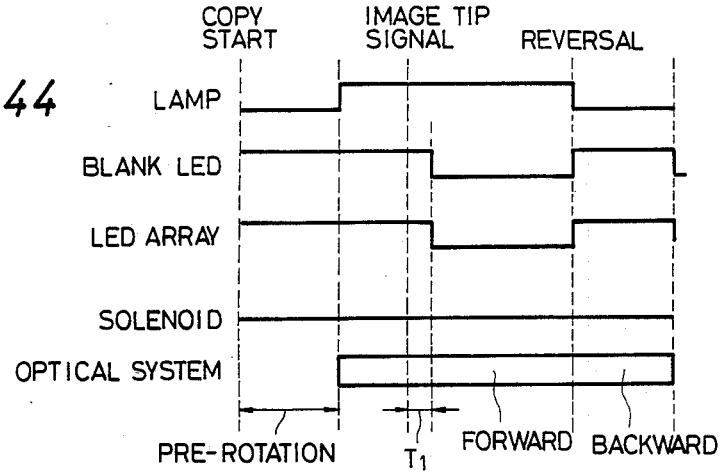
FIG. 44 is a timing chart of a normal copying operation.

FIG. 44 is a corresponding time chart. In response to a copy start instruction, the drum starts to rotate, and the blank LED array 702 and the LED array 701 are turned on. After the completion of the pre-rotation step, the lamp 14 is turned on, and the optical system 45 starts a forward motion. The blank LED array 702 and the LED array 702 are turned off after t time T1, corresponding to the distance between the optical axis and the blank unit, from an image front end signal released from the sensor 30, whereby the photosensitive is exposed to the light from the image to initiate the formation of latent image. When the optical system reaches a reversing position, the lamp 14 is turned off and the blank LED 702 and the LED array 701 are turned on, in order to avoid unnecessary image formation in the reverse motion of the optical system. A full cycle of operation is completed when the optical system returns to the home position.

In the following there will be explained an operation of writing characters at an end portion of the transfer sheet as shown by 41-1 in FIG. 41.

Figure 45:
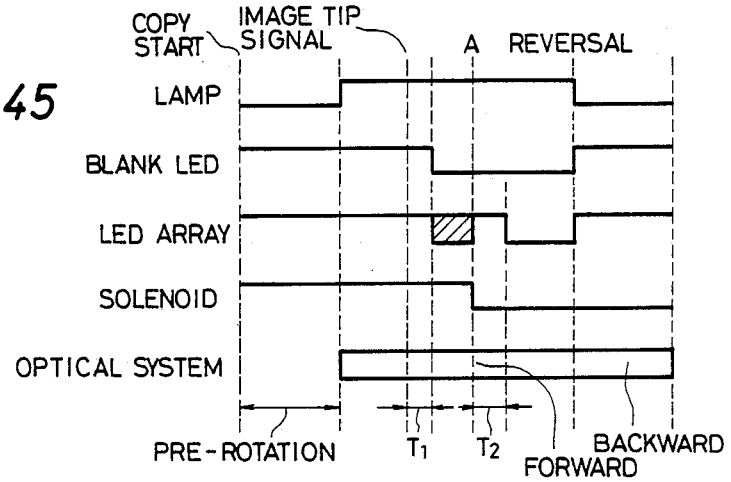
FIGS. 45, 46 and 47 are timing charts of a pattern writing operation.

FIG. 45 shows a corresponding timing chart, wherein a hatched area indicates selective lighting of the LED array 701. In response to a copy start instruction, the blank LED 702 and the LED array 701 are turned on and a pre-rotation step is conducted. Also the solenoid 706 is energized in this state. The optical system starts forward motion, then the blank LED 702 is turned off after a time T1 from the image front end signal and the LED array 701 starts selective lighting in synchronization to form a latent image of characters. At a time A when the formation of desired characters is completed, the LED array 701 is entirely turned on and the solenoid 706 is deactivated. After a time T2, taking the response time of the solenoid 706 in consideration, from the time A, the LED array 701 is totally turned off to copy the original image also on the end portion of the transfer sheet. This sequence prevents unnecessary smear at the boundary between the character area and original image area. When the optical system reaches the reversing position, the lamp 14 is turned off and the blank LED 702 and the LED array 701 are entirely turned on. A full cycle is completed when the optical system returns to the home position.

Figure 46:
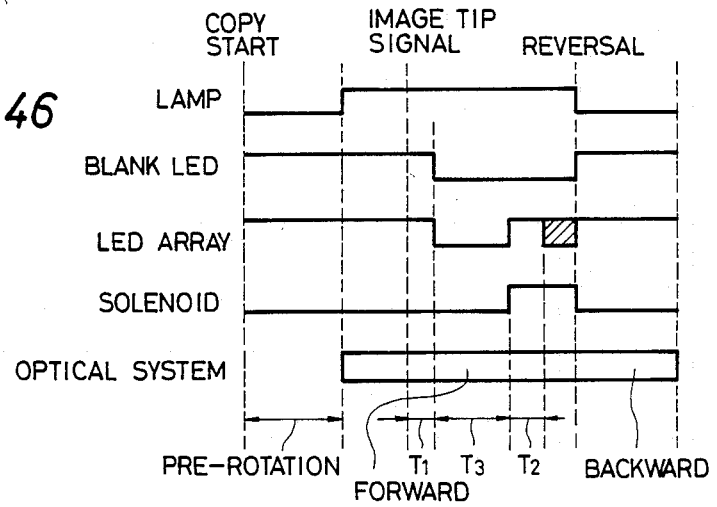

In the following there will be explained a case of character writing in the rear end portion of the transfer sheet. FIG. 46 is corresponding timing chart. In response to a copy start instruction, the blank LED 702 and the LED array 701 are turned on and the pre-rotation step is conducted. After the completion thereof, the lamp 14 is turned on and the optical system starts forward motion. After the time T1 from the image front end signal, the blank LED 702 and the LED array 701 are turned off. After the lapse of a time T3, which is equal to {(sheet size−length of character portion)/-process speed−T2}, the solenoid 706 is energized and the LED array 701 is entirely turned on.

Then after the lapse of time T2 thereafter, the LED array 701 is selectively turned on in synchronization to form characters. When the optical system reaches the reversing position, the lamp 14 is turned off while the blank LED 702 and the LED array 701 are entirely turned on, and the solenoid 706 is deactivated. A full cycle is completed when the optical system 45 returns to the home position.

Figure 47:
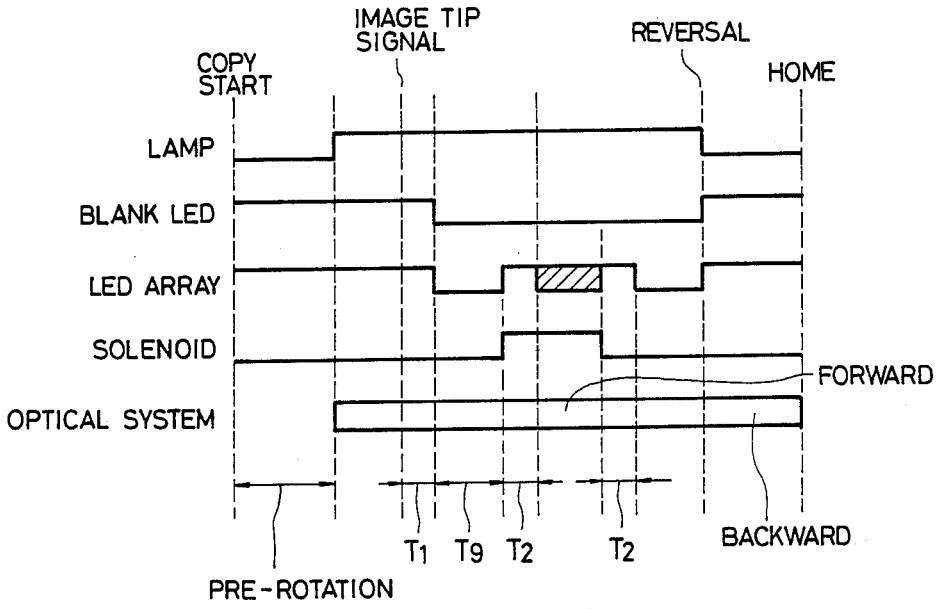

As explained in the foregoing, the characters can be recorded either in the front end portion or in the rear end portion of the transfer sheet. It is likewise possible to record the characters in a middle portion of the transfer sheet by regulating the timing of character writing. FIG. 47 shows a timing chart in such case. In response to a copy start instruction, the blank LED 702 and the LED array 701 are turned on. After the pre-rotation step, the lamp 14 is turned on and the optical system starts forward motion. After a time T1 from the image front end signal, the blank LED 702 and the LED array 701 are turned off to form the latent image of the original over the entire area. After the lapse of a time T9 corresponding to the writing position, the solenoid 706 is energized and the LED array 701 is entirely turned on. After the lapse of time T2, the LED array is selected turned on to form a latent image of desired characters. Thereafter the solenoid 706 is deactivated and the LED array 701 is turned on. After the lapse of time T2, the LED array 701 is turned off to effect the original exposure also on the end portion. When the optical system reaches the reversing position, the lamp 14 is turned off and the blank LED 702 and the LED array 701 are turned on. A full cycle is completed when the optical system returns to the home position.

In the following there will be explained each of the writing modes.

In the date mode, a date is always recorded.

In the page mode, the page number is increased by one after a predetermined number of copies are made from an original. Consequently the recorded page number is increased by one each time the original is exchanged, so that the transfer sheets will bear serial page numbers.

Figure 48:
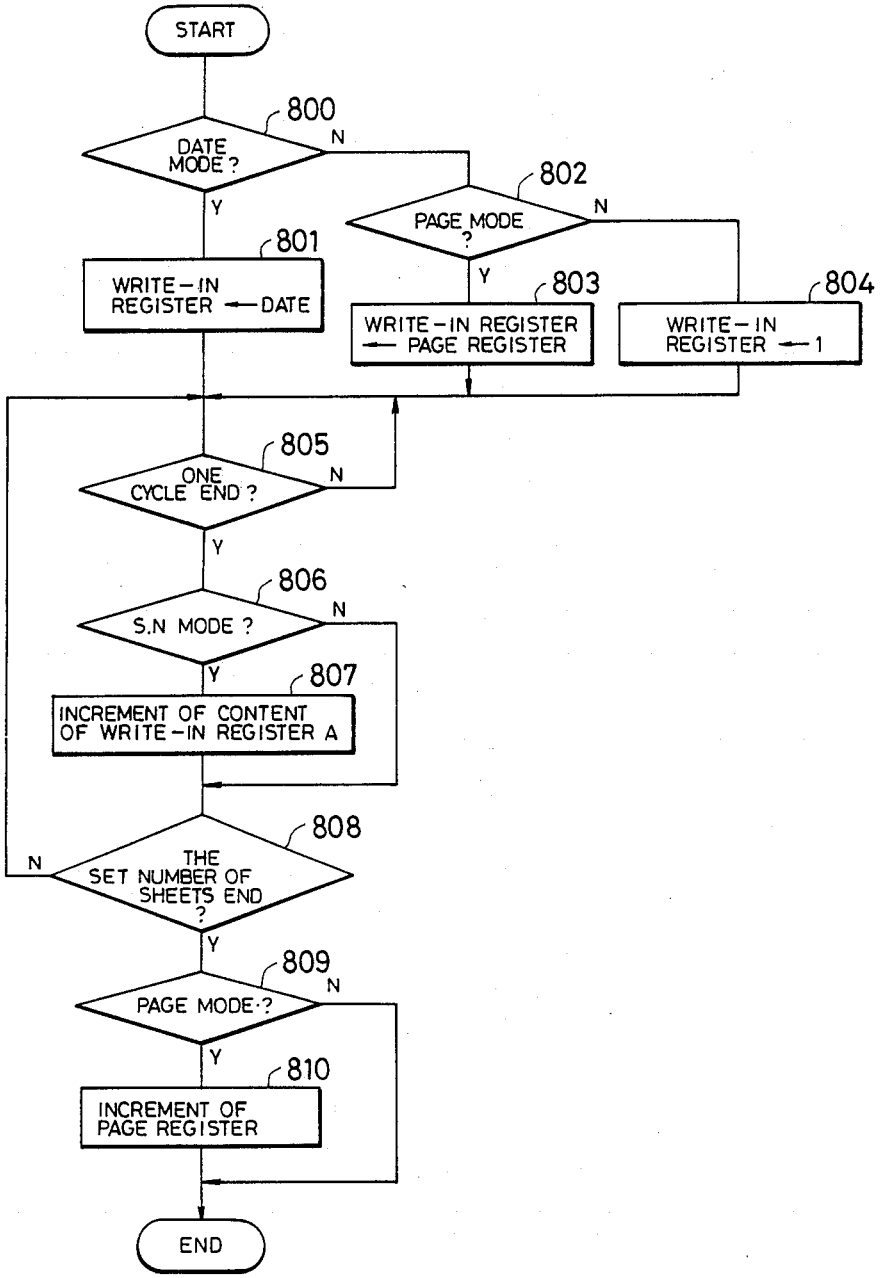
FIG. 48 is a flow chart showing the control procedure for pattern writing.

In the serial number mode, the number is serially increased for a predetermined number of copies made from an original, and is reset to "1" when the copying operation is started for a next original. Consequently the copies made from an original bear serially increased numbers. Also serial numbers starting from "1" are attached also to the copies obtained from the next original. FIG. 48 is a flow chart showing the control sequence after the copying operation is started.

In FIG. 48, there is employed a write-in register for storing data relating to various modes, and the data stored therein are recorded on the transfer sheet by means of the LED array 701 as explained before. A PAGE register stores the page number.

Said register is set to "1" at the initializing or when the page mode is assumed anew. At first there will be explained the function in the date mode. At first a step 800 discriminates whether the date mode is assumed, and, if affirmative, a step 801 sets a date in the write-in register. A step 805 discriminates whether a full cycle is completed, and the loop of the step 805 is repeated until an affirmative discrimination is obtained. After the completion of a full cycle, a step 806 discriminates whether the serial number mode is assumed. As the discrimination is negative in this case, the program proceeds to a step 808 for discriminating whether copies of a preset number have been made. If not a loop of steps 805, 806 and 808 is repeated until the copies of such preset number are obtained. Thereafter a step 809 discriminates whether the page mode is adopted, and, since the discrimination is negative in this case, the process is terminated.

Consequently, in the date mode, a date is always stored in the write-in register and is recorded in a predetermined position of the transfer sheet.

Now there will be explained the page mode. In this case, since the step 800 provides a negative result while the step 802 provides a positive result, the program proceeds to a step 803 to store the content of the PAGE register in the write-in register. For example, immediately after the selection of the page mode, a number "1" is set in the write-in register. Then the loop of the step 805 is repeated until a full cycle is completed, as explained before. After the completion of a full cycle, the program proceeds to steps 806–808 to discriminate whether copies of a preset number have been obtained, and said steps 806–808 are repeated until the copies of such preset number are obtained. Thereafter a step 809 discriminates whether the page mode is selected, and, since the discrimination is affirmative in this case, the content of the PAGE register is increased by one, and the process is thus terminated.

Consequently, in the page mode, a same number, "1" in this case, is recorded on the copies of the preset number obtained from a same original. Also in case of entry of a succeeding copy instruction, the program proceeds through the steps 800, 802 and 803 to store an increased number, "2" in this case, in the write-in register, thereby recording "2" on the transfer sheet.

The function of the serial number mode is as follows. When the copying operation is started, the program proceeds through the steps 800, 802 and 804 to set "1" in the write-in register. After the completion of a full cycle, the step 806 discriminates whether the serial number mode is selected, and, since the discrimination is affirmative in this case, the program proceeds to a step 807 to add one to the content of the write-in register, thus obtaining "2" therein. A loop of the steps 808, 805, 806 and 807 is repeated until copies of the preset number are obtained, and the number recorded on the transfer sheet is increased by one for each cycle. After the copies of the preset number are obtained, the program proceeds to a step 809 to terminate the process. Consequently in the serial number mode, serial numbers starting from "1" are recorded on the copies obtained from a same original. Also for a next series of copies, serial numbers are similarly recorded starting from "1".

In the following there will be explained a two-color mode in which different colors are used for the character portion and the original image portion.

In this case the character portion is at first exposed, with the blank LED 702 turned on, and developed with read-color toner. Subsequently the original exposure is conducted by the multi-copy mechanism, with the LED array 701 turned on in already recorded portion to obtain a white latent image therein, and the obtained latent image is developed with black-color toner.

Figure 49:
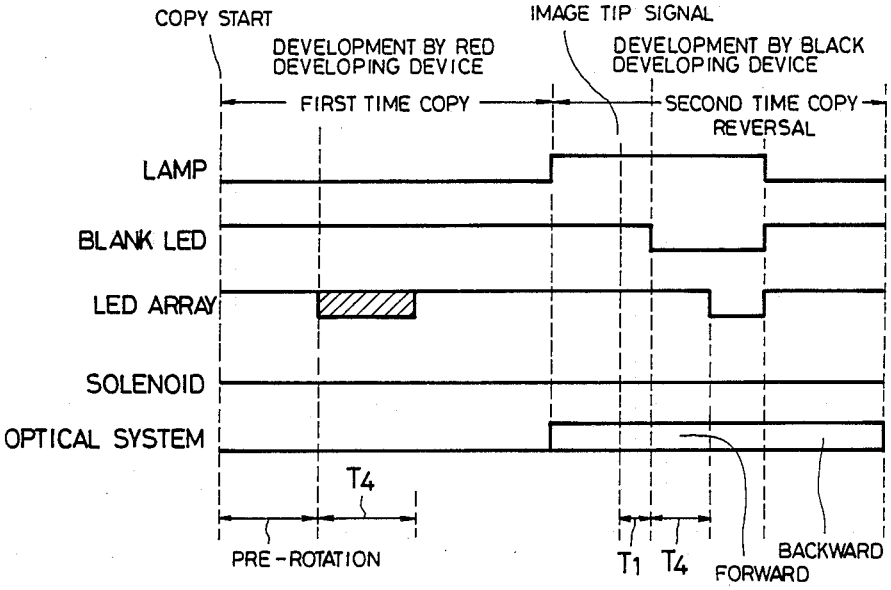
FIG. 49 is a timing chart of a pattern writing operating in a two-color mode.

FIG. 49 is a timing chart of such two-color mode.

In response to a copy start instruction, the drum starts to rotate and the blank LED 702 and the LED array 701 are turned on. After the pre-rotation step, the LED array 701 is selectively turned on while the blank LED 702 is entirely turned on to form a latent image of a pattern such as characters, during a period T4. The image development is conducted with a read-color development device and the registration rollers are activated at a suitable timing, thereby obtaining red characters in a desired position on the transfer sheet In this sequence the optical system 45 does not perform scanning motion, and the lamp 14 is not turned on.

Then the transfer sheet, bearing the recorded characters thereon, is stored on the middle tray and a second copying sequence is started. Thus the optical system 45 starts forward motion and the lamp 14 is turned on. The blank LED 702 and the LED array 701 are also turned on in this state. The blank LED 702 is turned off after a time T1 from the image front end signal, and the LED array 701 is turned off after further lapse of the time T4 required for character writing. When the optical system reaches the reversing position, the lamp 14 is turned off and the blank LED 702 and the LED array 701 are turned on. A full cycle is completed when the optical system 45 returns to the home position.

In the following there will be explained another embodiment. In the foregoing embodiment, the LED array for recording pattern such as characters is also used for erasing unnecessary image area. However, in the current state of technology, the LED array with a high dot density can only emit a smaller amount of light, in comparison with the LED's employed for blanking. For this reason, for example in the erasure by the LED array and the blank LED during reverse motion of the optical system, the amount of light received by the drum is not uniform, thus leaving unnecessary charge on the photosensitive member. Thus a suitable image cannot be obtained if the write-in mode is continued for a long time.

This drawback can be resolved by employing an LED array for pattern writing and a separate blank LED array for erasure.

Figure 50:
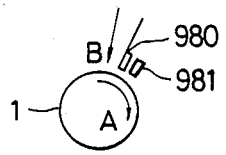
FIG. 50 is a view of an embodiment in which LED's for pattern writing are separately provided.
Figure 51:
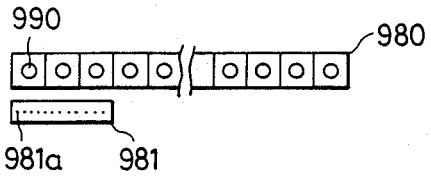
FIG. 51 is a view showing the arrangement of blank LED's and an LED array.

FIG. 50 is a view of the structure around the drum, wherein shown are a drum 1, a blank LED 980 for erasure, and an LED array 981 for writing. FIG. 51 shows the arrangement of the erasing blank LED 980 and the writing LED array 981. The blank LED 980 contains LED's 990 arranged with a pitch of 2.5 mm in the present embodiment.

Figure 52:
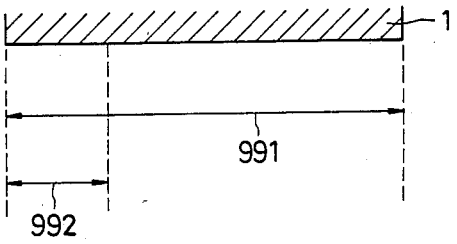
FIG. 52 is a view showing an irradiation area on the photosensitive drum.

FIG. 52 shows the illumination areas on the drum. The erasing blank LED 980 can illuminate an area 991, i.e., the entire surface of the drum, while the LED array 981 can only illuminate an area 992. In the following there will be explained a case of recording characters in the front end portion of the transfer sheet.

Figure 53:
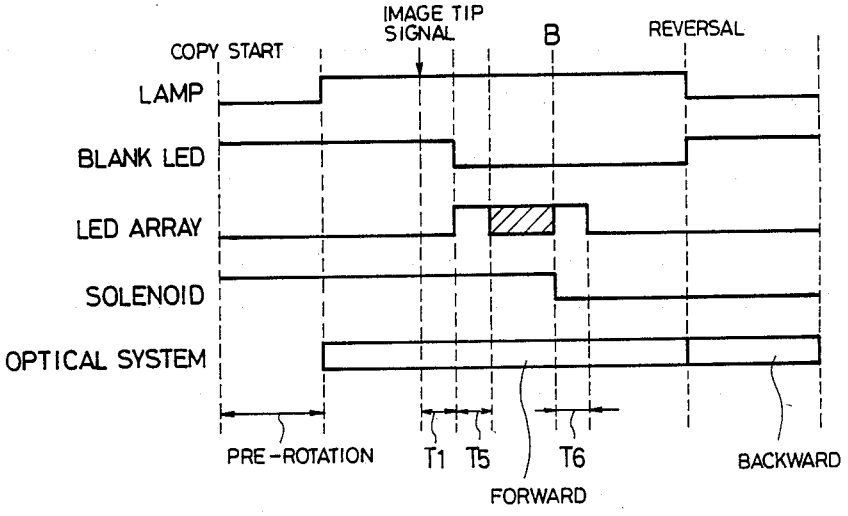
FIGS. 53 and 54 are timing charts of a pattern writing operation.

FIG. 53 is a corresponding timing chart. Simultaneously with the start of a copying operation, the blank LED 980 is turned on and the solenoid 706 is energized. After the pre-rotation step, the lamp 14 is turned on and the optical system 45 starts forward motion.

After a time T1 from the image front end signal, the blank LED 980 is turned off and the LED array 981 is entirely turned on. After the lapse of a time T5 corresponding to the distance between the blank LED 980 and the LED array 981 shown in FIG. 50, the LED array 981 is selectively turned on to start formation of a latent image of characters At a time B when the writing of characters is completed, the LED array 981 is entirely turned on and the solenoid 706 is deactivated. The LED array 981 is totally turned off after the lapse of a time T6 equal to the sum of the response time of the solenoid 706 and the moving time between the optical axis and the LED array 981. When the optical system reaches the reversing position, the lamp 14 is turned off and the blank LED 980 is turned on. A full cycle is completed when the optical system returns to the home position. The use of erasing blank means separate from the pattern writing means in this manner allows to illuminate the drum in erasing an unnecessary image during the reverse motion of the optical system, thereby ensuring formation of satisfactory images.

The above-explained structure can also be utilized for superposing characters and original image by a multi-copy mode as explained before. Since the LED array often has an insufficient light quantity as explained before, the process speed will become insufficient if it is determined from the performance of the LED array.

This drawback can however be resolved by employing different process speeds for the character writing and for the original exposure.

In the following there will be explained a case of writing characters in the front end portion of the transfer sheet.

Figure 54:
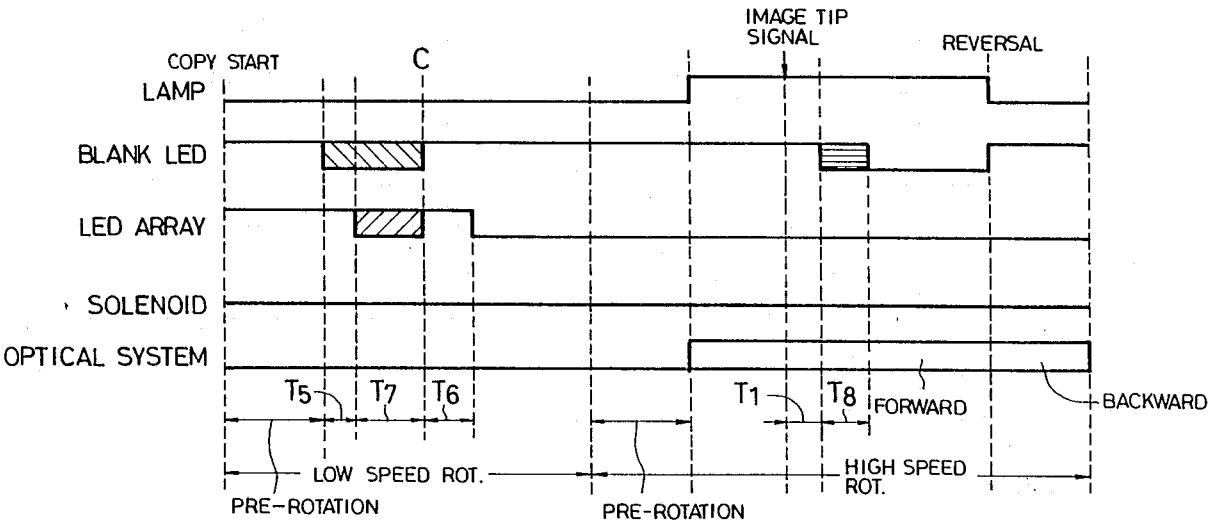

At first a character writing cycle is conducted with a relatively low process speed, and an original exposure step is conducted then with a relatively high process speed. FIG. 54 shows a corresponding timing chart, wherein a diagonally hatched area indicates a state in which the blank LED 980 is turned off only in the area 992 shown in FIG. 52, and a horizontally hatched area indicates a state in which it is turned on only in the area 992. In response to a copy start instruction, the drum starts rotation with a relatively low process speed, and the blank LED 980 and the LED array 981 are turned on. Also the high-voltage is supplied with a value matching such low process speed. After the pre-rotation step, the blank LED 980 is partially turned off, and, after the time T5, the LED array 981 is selectively turned on to start the formation of latent image of characters. After the lapse of a time T7, at C when the output of predetermined characters is completed, the blank LED 980 and the LED array 981 are entirely turned on. Then, after the lapse of a time T6, the LED array 981 is totally turned off. The registration rollers are activated at a predetermined timing to form characters on the leading end portion of the transfer sheet. When the transfer sheet reaches the middle tray, there is initiated a succeeding sequence whereby the drum starts to rotate with a relatively high process speed. The high voltage is supplied with a value matching said high process speed. After the prerotation step, the lamp 14 is turned on and the optical system starts forward motion. After a time T1 from the image front end signal, the blank LED 980 is turned off except for a part thereof. Then after the lapse of a time $T8=T7+T5$, the blank LED 980 is totally turned off. This sequence forms a white latent image in the portion where characters are written in the first cycle, thereby enabling to clearly recorded characters regardless of the original. When the optical system 45 reaches the reversing position thereafter, the lamp 14 is turned off, and the blank LED 980 is turned on. A full cycle is completed when the optical system returns to the home position.

In the foregoing embodiments the pattern writing LED is provided to cover only a part of the image area, but it may be so constructed as to cover the entire image area.

Also in the foregoing embodiments means for intercepting the image exposure is composed of a slit and a mechanical shutter. Said shutter may be positioned close to the photosensitive member, or may be replaced by a liquid crystal shutter. Also the write-in operation may be achieved by a combination of a light source and a liquid crystal shutter, instead of the LED array.

In the following there will be explained an image synthesis mode.

In this embodiment there will be explained a case of conducting image synthesis on a face of A3-sized transfer sheet from two-sided A4-sized original.

After an original is set on the automatic original feeding device 9, a predetermined key in the operation section is depressed to select a mode for forming two images of the two-sided original on a same face of the transfer sheet, without mutual overlapping. After the selection of a cassette storing A3-sized transfer sheet, the copy start key is depressed.

Figure 55A:
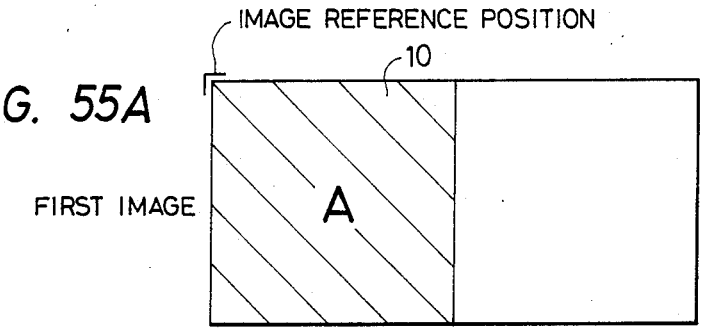
FIGS. 55A, 55B and 55C are views showing an example of copying a two-sided original on different portions of a same face of a transfer sheet.
Figure 55B:
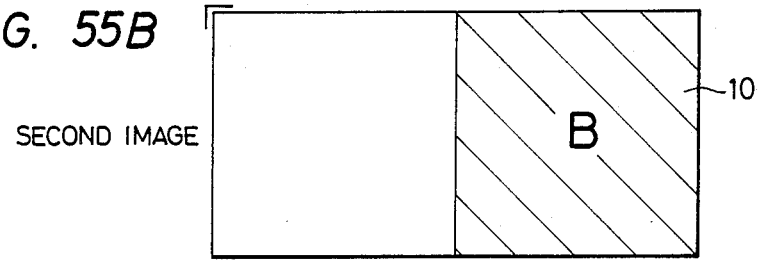
Figure 55C:
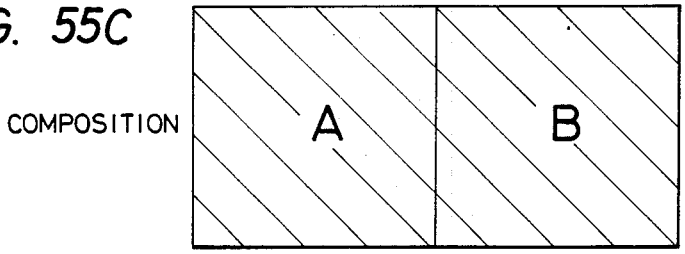

The original 10 set on the original feeding device 9 is advanced to an image reference position on the original glass 12 as shown in FIG. 55(*a*). For said original there is conducted an operation same as in the aforementioned multi-copy mode, thus obtaining copy of the first face. Then the original 10 on the original glass is guided through paths, D, E and F of the automatic original feeding device 9 and supplied again to the original glass, as shown in FIG. 55 (*b*). In this state the original is displaced by A4 size as shown in FIG. 55(*b*), and a copying operation is conducted in the same manner as in the second cycle in the aforementioned continuous copying operation. In this operation, after the sensor 30 detects a member 29 mounted on the movable optical system 45, the erasure lamp is turned on for a predetermined period T2 corresponding to the width of A4 size, thereby erasing the potential in the unnecessary area generated by the scanning motion of the optical system. After the lapse of the period T2, the erasure lamp is turned off and a latent image of the second face of the original is formed on the photosensitive drum. The transfer sheet supplied from the middle tray 8 by means of feed roller 37 is transported through a path G to a position in front of the registration rollers 28. Also after a predetermined time T3 from the image front end signal from the sensor 30, the registration rollers 28 are activated to advance the transfer sheet toward the photosensitive drum 1 with an exact timing. Consequently the front end of the latent image coincides with the center of the transfer sheet to achieve image synthesis. Thereafter the image transfer and image fixation are conducted in the manner as explained before to complete the copying operation.

FIG. 55 shows a example in which characters "A" and "B" are respectively recorded on the top and bottom faces of the original, and the character "A" is at first copied on a front half of the transfer sheet while the character "B" is then copied on a rear half of said transfer sheet. In the present embodiment, therefore, a synthesized image is obtained finally on the transfer sheet as shown in FIG. 55(*c*).

Figure 56:
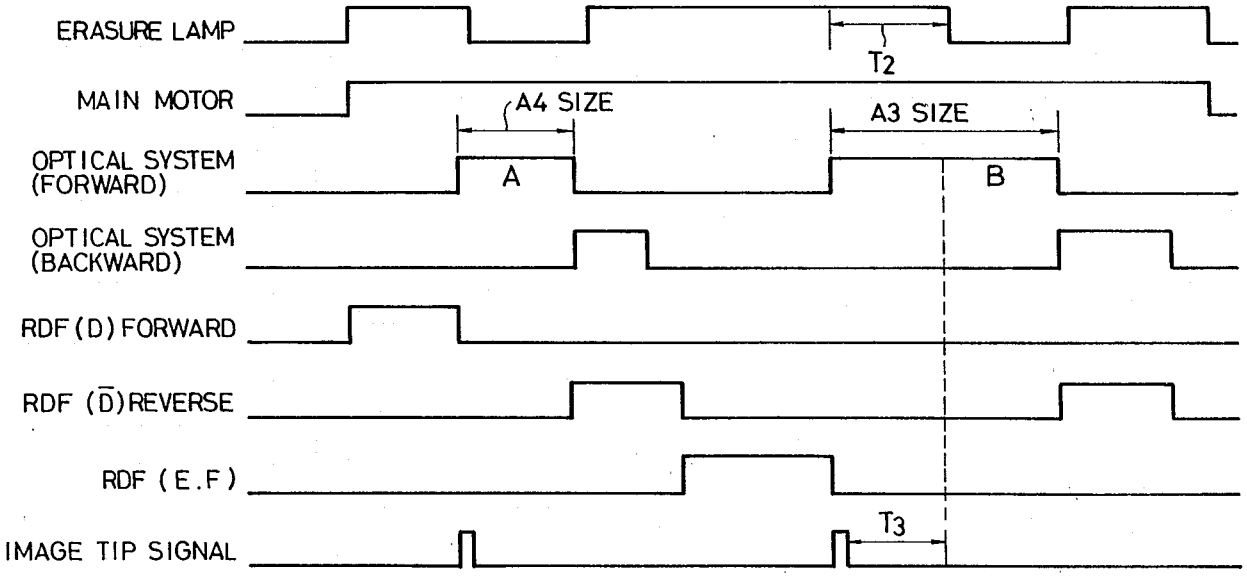
FIG. 56 is a timing chart of a synthesis mode.

FIG. 56 is a timing chart showing the above-explained image synthesis operation. Upon depression of the copy start key, the original feeding device 9 transports the original 10 to a predetermined position on the original glass 12. At the same time the main motor 4 is activated to rotate the drum 1 by a full turn. After the original is set to the image reference position, there is conducted a copying operation for the first face in the multi-copy mode as explained before, and the original feeding device discharges the original and sets, through switch-back paths E and F, the rear face of the original on the original glass 12. In this state the original is displaced from the image reference position by a certain time, and there is conducted a copying operation for the second face in the aforementioned multi-copy mode. However, in this case the erasure lamp is turned on during a time T2 from the image front end signal to erase unnecessary charge on the drum thereby preventing undesired toner deposition, and the registration rollers are activated at a time T3.

In this case the optical system performs a scanning motion for A3 size, and the original exposure is conducted in the latter half of the scanning motion to achieve image synthesis.

What is claimed is:

1. An image forming apparatus comprising:

image forming means for forming an image on a recording member;

erasure means provided with plural light-emitting elements for erasing unnecessary electric charges on said recording member said erasure means comprising a first light-emitting section in which light-emitting elements are arranged with a first pitch and a second light-emitting section in which light-emitting elements are arranged with a larger second pitch; and drive means for selectively driving the plural light-emitting elements of said first light-emitting section in accordance with a predetermined image to obtain a composite image of the image formed by said image forming means and said predetermined image.

2. An image forming apparatus according to claim 1, wherein said recording member is a photosensitive drum, and said erasure means is provided with plural light-emitting elements arranged along the direction of rotary axis of said photosensitive drum.

3. An image forming apparatus according to claim 1, wherein said drive means is operable to selectively drive the light-emitting elements of said first light-emitting section in accordance with a desired pattern.

4. An image forming apparatus according to claim 1, wherein said predetermined image comprises one of a date, page number and serial number.

5. An image forming apparatus comprising:

first image forming means for forming an image on a recording member;

second image forming means for forming a desired pattern on said recording member;

designation means for designating a desired mode from among a plurality of pattern formation modes; and control means for selecting a desired pattern selected from among plural patterns which are able to be generated in the pattern formation mode designated by said designating means, and for supplying a signal corresponding to the selected pattern to said second image forming means.

6. An image forming apparatus according to claim 5, wherein said designation means comprises key input means corresponding to said plural pattern modes.

7. An image forming apparatus according to claim 5, wherein said plural pattern modes comprise one of a mode for data formation, a mode for page number formation, and a mode for serial number formation.

8. An image forming apparatus according to claim 5, wherein said recording member is a photosensitive drum and said second image forming means comprises plural light-emitting elements arranged along a direction of rotary axis of said photosensitive drum.

9. An image forming apparatus according to claim 8, wherein said second image forming means is operable to selectively drive said plural light-emitting elements in accordance with the signal corresponding to the selected pattern from said control means.

10. An image forming apparatus comprising:

first image forming means for forming a first image on a sheet;

second image forming means for forming a second image on said sheet; and selection means for selecting either a first mode in which formations of said first and second images on the sheet are carried out in the same image formation cycle, or a second mode in which formations of said first and second images on the sheet are carried out in different image formation cycles; and control means for controlling said first and second image forming means in accordance with the mode selected by said selection means.

11. An image forming apparatus according to claim 10, wherein said first image forming means is operable to form a first electrostatic latent image corresponding to an original image on a recording member by a first exposure means, and thereafter developing, and transferring a first developed image onto the sheet; said second image forming means is operable to form a second electrostatic latent image corresponding to a predetermined pattern image on said recording member by a second exposure means, and thereafter developing, and transferring a second developed image onto the sheet, and said control means controls said first and second image forming means, in a first image forming cycle, to form and develop an electrostatic latent image on the recording member corresponding to said desired pattern by said second exposure means and transfer the second developed image onto the sheet, and in a second image forming cycle, to form and develop an electrostatic latent image on the recording member corresponding to the image of the original by said first exposure means and transfer the first developed image onto the same face of the sheet.

12. An image forming apparatus according to claim 11, wherein said control means controls said first and second image forming means to employ different image forming speeds in said first and second image forming cycles.

13. An image forming apparatus according to claim 10, wherein said recording member is a photosensitive drum, and said second exposure means comprises plural light-emitting elements arranged along a direction of the rotary axis of said photosensitive drum and drive means for selectively driving said plural light-emitting elements in accordance with a desired pattern.

14. An image forming apparatus comprising:

first image forming means for forming a first image on a sheet;

second image forming means for forming a second image on said sheet;

designation means for designating a direction of the second image to be formed on the sheet by said second image forming means; and control means for controlling said second image forming means in accordance with the direction of the second image designated by said designation means.

15. An image forming apparatus according to claim 14, wherein said first image forming means is operable to form a first electrostatic latent image corresponding to an original image on a recording member by first exposure means, and thereafter developing, and transferring a first developed image onto the sheet; said second image forming means is operable to form a second electrostatic latent image corresponding to a predetermined pattern on said recording member by second exposure means, and thereafter developing, and transferring a second developed image onto the sheet.

16. An image forming apparatus according to claim 15, wherein said recording member is a photosensitive drum, and said second exposure means comprises plural light-emitting elements arranged along a direction of the rotary axis of said photosensitive drum.

17. An image forming apparatus according to claim 15, wherein said second image forming means comprises drive means for selectively driving said plural light-emitting elements in accordance with said predetermined pattern.

18. An image forming apparatus according to claim 17, wherein said control means controls said drive means to control the timing of selective driving of said plural light-emitting elements in accordance with an input from said designation means.

19. An image forming apparatus according to claim 14, further comprising means for designating a position of the second image to be formed on the sheet.

20. An image forming apparatus comprising:

exposure means for exposing an original;

image forming means for forming an image on a recording member in accordance with an image exposed by said exposure means;

pattern forming means for forming a desired pattern on said recording member;

shield means for permitting the interception of light from said exposure means in accordance with a pattern forming area defined by said pattern forming means on said recording member; and drive means for driving said shield means so as to prevent forming area during formation of said desired pattern by said pattern forming means.

21. An image forming apparatus comprising:

first image forming means for forming an image on a recording member;

second image forming means for forming a desired pattern on said recording member;

designating means for designating a mode in which the image formed by said first image forming means and the pattern formed by said second image forming means are recorded with mutually different colors; and control means for supplying a signal corresponding to said desired pattern to said second image forming means.

22. An image forming apparatus according to claim 21, wherein said first image forming means is operable to form a first electrostatic latent image corresponding to an original image on a recording member by a first exposure means, and thereafter developing, and transferring a first developed image onto the sheet; said second image forming means is operable to form a second electrostatic latent image corresponding to a predetermined pattern image on said recording member by second exposure means, and thereafter developing, and transferring a second developed image onto the sheet.

23. An image forming apparatus according to claim 22, wherein said control means is operable, when said mode is designated by said designating means, to select different developing means between a developing time of said first electrostatic latent image and a developing time of said second electrostatic latent image.

24. An image forming apparatus according to claim 22, wherein said recording medium is a photosensitive drum, and said second exposure means has a plurality of light emission elements arranged along an axis direction of said photosensitive drum and driving means for selectively driving said plurality of light emission elements in accordance with a desired pattern.

25. An image forming apparatus according to claim 24, wherein said control means outputs a signal according to the desired pattern to said driving means.

* * * * *

UNITED STATES PATENT AND TRADEMARK OFFICE

CERTIFICATE OF CORRECTION

PATENT NO. : 4,916,489

DATED : April 10, 1990

INVENTOR(S) : Hiroaki TAKEDA et al.

It is certified that error appears in the above-identified patent and that said Letters Patent is hereby corrected as shown below:

COLUMN 2:

Line 15, "is" (second occurrence) should read --is executed in--.

COLUMN 3:

Line 18, "drum" should read --drum 1--.

COLUMN 6:

Line 42, "first scan mirror" should read --first scan mirror 13--.

COLUMN 9:

Line 7, "started" should read --starts--.

COLUMN 12:

Line 50, delete "now".

UNITED STATES PATENT AND TRADEMARK OFFICE

CERTIFICATE OF CORRECTION

PATENT NO. : 4,916,489

DATED : April 10, 1990

INVENTOR(S) : Hiroaki TAKEDA ET AL.

It is certified that error appears in the above-identified patent and that said Letters Patent is hereby corrected as shown below:

COLUMN 18:

Line 18, "maker side" should read --maker--.

Line 43, "these" should read --This--.

COLUMN 19:

Line 2, "distant point" should read --more distant point--.

Line 18, "tee" should read --the--.

Line 56, "lines" should read --lies--.

COLUMN 20:

Line 9, "divided" should read --dividend--.

COLUMN 22:

Line 47, "transfer clocks" should read --transfer clock signals--.

COLUMN 25:

Line 53, "stag" should read --stage--.

UNITED STATES PATENT AND TRADEMARK OFFICE

CERTIFICATE OF CORRECTION

PATENT NO. : 4,916,489 Page 3 of 3

DATED : April 10, 1990

INVENTOR(S) : Hiroaki TAKEDA ET AL.

It is certified that error appears in the above-identified patent and that said Letters Patent is hereby corrected as shown below:

COLUMN 26:

Line 35, "step 70" should read --step 71--.

COLUMN 28:

Line 59, "step 63. If" should read --step 63, if--.

COLUMN 30:

Line 20, "ca" should read --can--.

COLUMN 31:

Line 46, "LED array 702" should read --LED array 701--.

COLUMN 32:

Line 52, "selected" should read --selectively--.

Signed and Sealed this

Thirty-first Day of March, 1992

*Attest:*

HARRY F. MANBECK, JR.

*Attesting Officer*

*Commissioner of Patents and Trademarks*